US011421971B2

(12) United States Patent
Vabnick

(10) Patent No.: US 11,421,971 B2
(45) Date of Patent: Aug. 23, 2022

(54) ROUNDED PROJECTILES FOR TARGET DISRUPTION

(71) Applicant: Federal Bureau of Investigation, Washington, DC (US)

(72) Inventor: Ian B. Vabnick, Quantico, VA (US)

(73) Assignee: The United States of America as Represented by the Federal Bureau of Investigation, Department of Justice, Washington, DC (US)

( * ) Notice: Subject to any disclaimer, the term of this patent is extended or adjusted under 35 U.S.C. 154(b) by 0 days.

(21) Appl. No.: 17/138,661

(22) Filed: Dec. 30, 2020

(65) Prior Publication Data

US 2021/0389107 A1 Dec. 16, 2021

Related U.S. Application Data

(60) Provisional application No. 63/033,475, filed on Jun. 2, 2020.

(51) Int. Cl.

| | |
|---|---|
| ***F42B 33/06*** | (2006.01) |
| ***F42B 12/76*** | (2006.01) |
| ***F42B 12/74*** | (2006.01) |
| ***F41A 21/02*** | (2006.01) |

(52) U.S. Cl.
CPC ..... *F42B 33/06* (2013.01); *F41A 21/02* (2013.01); *F42B 12/745* (2013.01); *F42B 12/76* (2013.01)

(58) Field of Classification Search
CPC .. F42D 5/04; F41A 21/02; F42B 33/06; F42B 12/745; F42B 12/76; F41H 11/12
See application file for complete search history.

(56) References Cited

U.S. PATENT DOCUMENTS

| | | | | |
|---|---|---|---|---|
| 115,498 A * | 5/1871 | Milbank | F42B 14/061 102/521 |
| 780,003 A * | 1/1905 | King | F42B 8/10 102/446 |
| 2,491,516 A | 12/1949 | Piggot et al. | |
| 3,138,102 A * | 6/1964 | Meyer | F42B 7/10 102/509 |
| 3,180,265 A * | 4/1965 | Rybak | F42B 7/08 102/451 |

(Continued)

FOREIGN PATENT DOCUMENTS

| | | |
|---|---|---|
| ES | 2083894 A2 | 4/1996 |
| GB | 2083894 A2 | 3/1982 |

*Primary Examiner* — Joshua E Freeman
(74) *Attorney, Agent, or Firm* — Leydig, Volt & Mayer, Ltd.

(57) ABSTRACT

Provided are methods and related devices for disrupting an explosive device using a propellant driven disrupter (PDD) that propels a rounded projectile (RP) toward an explosive device. The RP travels along a linear trajectory and impacts the target, including a barrier portion of the explosive device. The impacting between the RP and barrier forms a composite projectile via a solid state weld between a portion of the barrier and the RP distal end, thereby minimizing or avoiding spall and fragment generation into the explosive device. The projectile traverses a penetration distance along the linear trajectory, or a defined-angle relative thereto, to disrupt the explosive device without unwanted explosive detonation.

21 Claims, 38 Drawing Sheets

(56) References Cited

U.S. PATENT DOCUMENTS 3,200,751 A * 8/1965 Vitt ..... F42B 10/22 102/519
3,670,651 A * 6/1972 Mertens ..... F42B 7/08 102/452
3,786,753 A * 1/1974 Eckstein ..... F42B 7/08 102/449
3,802,108 A * 4/1974 Mainhardt ..... F42B 8/02 42/77
4,046,055 A 9/1977 McDonalds et al.
4,169,403 A 10/1979 Hanson
4,779,511 A 10/1988 Proctor et al.
4,864,934 A * 9/1989 Theising ..... F42B 7/08 102/430
4,895,076 A * 1/1990 Looger ..... F42B 8/12 102/439
4,955,939 A 9/1990 Petrousky et al.
4,957,027 A 9/1990 Cherry
5,009,166 A * 4/1991 Bilsbury ..... F42B 12/78 102/516
5,134,921 A 8/1992 Breed et al.
5,146,043 A * 9/1992 Means ..... F42B 33/001 86/23
5,210,368 A 5/1993 Heller, Jr. et al.
5,230,324 A 7/1993 Van Horssen et al.
5,443,010 A * 8/1995 Dahlitz ..... F42B 14/04 102/501
5,460,154 A 10/1995 Mattern et al.
5,460,155 A 10/1995 Hobbs, II
5,686,686 A * 11/1997 Woodall, Jr. ..... B63G 7/02 102/403
5,785,038 A 7/1998 Mattern
5,792,977 A 8/1998 Chawla
6,269,725 B1 8/2001 Cherry
6,439,127 B1 8/2002 Cherry
6,490,957 B1 * 12/2002 Alexander ..... F41B 11/00 86/50
6,532,947 B1 3/2003 Rosa et al.
6,584,908 B2 7/2003 Alford
6,644,166 B2 11/2003 Alexander et al.
6,973,879 B1 * 12/2005 McElroy ..... F42B 12/74 102/501
7,401,766 B2 7/2008 Schorloff et al.
8,091,479 B1 1/2012 Jakaboski et al.
8,245,430 B1 * 8/2012 Owenby ..... F42B 33/06 42/84
8,276,495 B1 10/2012 Chiu et al.
8,677,902 B1 3/2014 Rock et al.
8,844,444 B1 * 9/2014 Hooke ..... F42B 35/00 102/502
8,915,004 B1 * 12/2014 Langner ..... F42B 33/06 42/69.01
9,322,624 B2 4/2016 Alford et al.
9,322,625 B1 4/2016 Langner
9,404,718 B1 8/2016 Shaver et al.
9,453,713 B1 9/2016 Langner
9,976,838 B1 5/2018 Langner
10,054,388 B1 8/2018 Langner
10,066,916 B1 9/2018 Vabnick et al.
10,451,378 B2 10/2019 Vabnick et al.
10,495,433 B1 12/2019 Langner
10,760,872 B2 9/2020 Vabnick
10,794,660 B2 10/2020 Vabnick
10,921,089 B1 2/2021 Vabnick et al.
11,105,597 B1 * 8/2021 Swanson ..... F42B 5/02
11,150,063 B1 * 10/2021 Swanson ..... F42B 12/44
11,187,487 B1 11/2021 Vabnick et al.
11,262,155 B2 3/2022 Vabnick
11,274,908 B2 3/2022 Vabnick
2001/0025584 A1 * 10/2001 Saxby ..... F42B 12/34 102/441
2001/0027619 A1 * 10/2001 Randall ..... F42B 35/00 42/76.01
2005/0183617 A1 * 8/2005 MacDougall ..... F42B 12/78 102/514
2006/0163544 A1 7/2006 Schlorff et al.
2006/0260500 A1 * 11/2006 Engel ..... F42B 5/03 102/448
2008/0121097 A1 * 5/2008 Rudakevych ..... F41A 19/58 89/28.05
2009/0013892 A1 * 1/2009 Judson ..... F42B 12/76 102/502
2010/0083862 A1 * 4/2010 Ciesiun ..... F42B 12/78 102/513
2011/0061521 A1 3/2011 Gardner et al.
2013/0008335 A1 * 1/2013 Menefee, III ..... F42B 7/08 102/460
2013/0305950 A1 * 11/2013 Coffman, II ..... F42B 5/16 102/464
2014/0109791 A1 * 4/2014 Whitworth ..... F42B 5/24 102/529
2015/0000545 A1 * 1/2015 Sorensen ..... F42B 5/03 102/439
2015/0192394 A1 * 7/2015 Fritz ..... F42B 5/025 102/439
2015/0268017 A1 * 9/2015 Diemer ..... F42B 12/36 102/439
2016/0305752 A1 * 10/2016 Achiaz ..... F42B 12/80
2017/0160060 A1 * 6/2017 Purvis ..... F41H 13/0006
2019/0106364 A1 * 4/2019 James ..... C06B 23/00
2020/0141706 A1 * 5/2020 Fox ..... F42B 12/06
2020/0141708 A1 * 5/2020 Morse ..... F42B 7/046
2021/0041205 A1 2/2021 Vabnick
2021/0270586 A1 * 9/2021 Maricaille ..... F42B 7/08
2021/0404777 A1 12/2021 Vabnick

* cited by examiner

ROUNDED PROJECTILES FOR TARGET DISRUPTION

CROSS-REFERENCE TO RELATED APPLICATIONS

This application claims the benefit of and priority to U.S. Provisional Patent Application No. 63/033,475 filed Jun. 2, 2020, which is specifically incorporated by reference in its entirety to the extent not inconsistent herewith.

STATEMENT OF GOVERNMENT INTEREST

The inventions described herein were invented by employees of the United States Government and thus, may be manufactured and used by or for the U.S. Government for governmental purposes without the payment of royalties.

BACKGROUND OF INVENTION

In the art of hazardous devices access and disablement, including explosive ordnance disposal, a common tool, particularly for neutralizing improvised explosive devices (IEDs), is the propellant driven disrupter. A propellant driven disrupter may be used to fire a solid projectile or a jet of fluid at an IED with the goal of disrupting the explosive and avoiding its detonation. A solid projectile may penetrate tougher casing materials compared to a fluid jet. However, use of solid projectiles comes with significant risks. Conventionally, solid projectiles have a high risk of causing undesired initiation or detonation of the explosive material in an explosive device directly or indirectly. Conventional solid projectiles are likely to change trajectory upon impact, leading to lack of predictability and a significant chance of impacting with the explosive material in the device. Also conventional solid projectiles can have secondary projectiles, such as pieces of the solid projectile itself, ejected ahead and which may detonate the explosive before disruption may occur. Other undesired effects may be the spallation and/or fragmentation of the solid projectile and/or of a barrier upon impact can create secondary projectiles that detonate the explosive before disruption may occur.

Disclosed herein are methods, projectiles, and cartridges having said projectiles that address these and other challenges for disrupting and disabling explosive ordinances.

SUMMARY OF THE INVENTION

Included herein are rounded projectiles, projectile cartridges comprises the rounded projectiles, and methods of disrupting an explosive device (such as an improvised explosive device, IED) with a rounded projectile using a propellant driven disrupter (PDD), also known as a dearmer. The rounded projectiles and projectile cartridges disclosed herein are compatible with a wide variety of PDDs and barrels, including smooth bore barrels and rifled bore barrels. The rounded projectiles are accurate, precise, and can penetrate barriers, including steel barriers, and ultimately disrupt an explosive device without initiating or detonating an explosive material of the explosive device. The rounded projectile follows the same trajectory during flight and notably during penetration of the explosive device with minimal deviation or error. Additional benefits include the lack of secondary projectiles being propelled ahead of the projectile, such that explosive is not initiated/detonated by any secondary projectiles, or at least any such projectiles are minimal, with well-controlled direction so that there is no reasonable risk of inadvertent detonation. In some embodiments, the rounded projectile forms a composite projectile via solid state welding with a portion of the hazardous device's barrier.

Aspects of the invention include a method for disrupting an explosive device using a propellant driven disrupter (PDD), the method comprising the steps of: loading a rounded projectile (RP) into a disrupter barrel of the PDD; aiming the PDD at a target portion of the explosive device; propelling the RP out of the barrel and toward the target portion of the explosive device; wherein the RP travels along a linear trajectory defined by a barrel longitudinal axis extending between a barrel muzzle end and the target portion; impacting the RP with a barrier portion of the explosive device, the barrier portion being between the barrel muzzle end and the target portion along said linear trajectory; wherein the step of impacting comprises forming a composite projectile via a solid state weld between the barrier portion of the explosive target to a RP distal end; and traversing the composite projectile a penetration distance through the explosive device; wherein the composite projectile traverses the penetration distance along said linear trajectory, such that the RP follows said linear trajectory during the steps of propelling, impacting, and traversing; and disrupting the explosive device without detonating an explosive of the explosive device. Preferably, the step of impacting is free of generation or propelling of spalls and fragments into the explosive device. The linear trajectory may be perpendicular relative to the point of impact on an outer-facing surface of the target. The methods and devices provided herein are also compatible with an oblique angle trajectory, wherein the trajectory is not perpendicular relative to the point of impact on an outer-facing surface of the target. The outer facing surface of the target is also generally referred herein as a "barrier layer". This oblique angle aspect is relevant because in real-world situations, it may not be practical, or even possible, to achieve a perpendicular shot on target. Accordingly, provided herein are methods that can accommodate a non-perpendicular on-target geometry without sacrificing explosive disruption reliability.

Aspects of the invention include a method for disrupting an explosive device using a propellant driven disrupter (PDD), the method comprising the steps of: loading a rounded projectile (RP) into a disrupter barrel of the PDD; aiming the PDD at a target portion of the explosive device; propelling the RP out of the barrel and toward the target portion of the explosive device; wherein the RP travels along a linear trajectory defined by a barrel longitudinal axis extending between a barrel muzzle end and the target portion; impacting the RP with a barrier portion of the explosive device, the barrier portion being between the barrel muzzle end and the target portion along said linear trajectory; wherein the step of impacting comprises forming a composite projectile via a solid state weld between the barrier portion of the explosive target to a RP distal end, and avoids generation of spalls and fragments into the explosive device; and traversing the composite projectile a penetration distance through the explosive device; wherein the composite projectile traverses the penetration distance along said linear trajectory, such that the RP follows said linear trajectory during the steps of propelling, impacting, and traversing; and disrupting the explosive device without detonating an explosive of the explosive device.

Optionally in any of the methods disclosed herein, the step of disrupting comprises disabling a power source, an electrical connection, and/or a switch of the explosive device. Optionally in any of the methods disclosed herein, the step of disrupting comprises forming a portal in the barrier layer and/or destroying a latch, hasp, connection junction, or other structural component of a container, door, access point, or sub-compartment.

Advantageous aspects of the invention include a variety of features of the flight, impact, and penetration behaviors of the disclosed projectiles.

Preferably in any of the methods disclosed herein, the RP follows the linear trajectory during the steps of propelling, impacting, and traversing with a deviation distance from the linear trajectory less than or equal to 0.3 inches, preferably less than or equal to 0.2 inches, such as, but not necessarily, when a standoff distance between the barrel muzzle end and the barrier portion is selected from the range of 2 ft. and 60 ft. Preferably in any of the methods disclosed herein, the RP follows the linear trajectory during the steps of propelling, impacting, and traversing with a deviation distance from the linear trajectory less than or equal to 0.3 inches (preferably less than or equal to 0.2 inches) for a standoff distance between the barrel muzzle end and the barrier portion is selected from the range of 2 ft. and 60 ft. Preferably in any of the methods disclosed herein, the deviation characterizes the entire path of the RP within the explosive device. Optionally in any of the methods disclosed herein, the penetration distance is at least 3 inches, more preferably at least 6 inches, still more preferably 12 inches, further more preferably at least 24 inches.

Optionally in any of the methods disclosed herein, the composite projectile is characterized by a momentum that is within 50%, optionally within 70%, optionally within 80%, optionally within 90%, optionally within 95%, of the momentum of the RP after the step of propelling and before the step of impacting. Optionally in any of the methods disclosed herein, the composite projectile is characterized by a mass that is 15% to 100% greater than the mass of the RP. Optionally in any of the methods disclosed herein, the composite projectile is characterized by a mass that is 30% to 100% greater than the mass of the RP. Preferably in any of the methods disclosed herein, the composite projectile is characterized by a mass that is 15% to 100% greater than the mass of the RP.

Optionally in any of the methods disclosed herein, almost no secondary projectiles or components of a projectile cartridge contact the explosive device prior to the impacting between the composite projectile and the explosive device, and those few fragments that may contact with the explosive device do not cause damage to the bomb and initiate it. Preferably in any of the methods disclosed herein, no secondary projectiles or components of a projectile cartridge contact the explosive device prior to the impacting between the composite projectile and the explosive device.

Optionally in any of the methods disclosed herein, a wadding, patch or cloth surrounds at least a portion of the RP when the RP is loaded in the barrel, optionally a smooth bore barrel; and wherein the wadding does not impact with nor substantially interact with the explosive device or any portion thereof prior to the impacting between the composite projectile and the explosive device and will not cause damage to the bomb and initiate it. Preferably in any of the methods disclosed herein, a wadding surrounds at least a portion of the RP when the RP is loaded in the barrel; and wherein the wadding does not impact with nor interact with the explosive device or any portion thereof prior to the impacting between the composite projectile and the explosive device.

Optionally in any of the methods disclosed herein, a wadding and/or a tamp is propelled out of the barrel and follow behind the RP between the barrel muzzle end and the explosive device. Preferably in any of the methods disclosed herein, any mass that is displaced or ejected from the explosive device via energy transfer from the composite projectile during the impacting and traversing steps is displaced or ejected backwards with respect to the linear trajectory of the composite projectile.

Preferably in any of the methods disclosed herein, the RP maintains a core integrity throughout the method.

Preferably in any of the methods disclosed herein, the RP has a velocity selected from the range of 1600 ft./s to 6,000 ft./s, 1600 ft./s to 5000 ft./s, optionally 1800 ft./s to 5,000 ft./s, optionally 1800 ft./s to 6,000 ft./s, 1600 ft./s to 3,500 ft./s, outside the barrel during the step of propelling and before the step of impacting. Optionally in any of the methods disclosed herein, the RP has a supersonic velocity outside the barrel during the step of propelling and before the step of impacting. Preferably in any of the methods disclosed herein, the RP deforms by less than 1.5% in radius at least during the steps of propelling and impacting compared to the same RP prior to the step of propelling.

Preferably in any of the methods disclosed herein, the RP experiences drag stabilization or both drag stabilization and spin stabilization between the steps of propelling and impacting. Optionally in any of the methods disclosed herein, the explosive device has a barrier layer characterized by a thickness selected from the range of 0.035 in. to 0.75 in., wherein the barrier layer is formed of a metal, such as a steel, and the barrier portion is a portion of the barrier layer. Optionally, the barrier layer has a thickness selected from the range of 0.01 in. to 1 in., or any range therebetween inclusively, such as optionally 0.03 in. to 0.8 in., optionally 0.06 in. to 0.08 in.

The rounded projectile (RP) can have different geometries, but generally has a rounded frontal or distal geometry, with the rounded geometry generally being at an entirety of the distal region such as between an area of maximal outer diameter and the very tip of the distal end of the RP. Preferably in any of the methods, projectiles, and/or projectile cartridges disclosed herein, the RP has a spherical geometry between a maximal outer diameter of the RP and a distal end of the RP. Preferably in any of the methods, projectiles, and/or projectile cartridges disclosed herein, the RP has a spherical geometry or a half-capsule geometry. Preferably in any of the methods, projectiles, and/or projectile cartridges disclosed herein, the RP has a spherical geometry. Preferably in any of the methods, projectiles, and/or projectile cartridges disclosed herein, the RP is spherical. Preferably in any of the methods disclosed herein, the RP has a spherical geometry and the bore region is smooth. Optionally in any of the methods, projectiles, and/or projectile cartridges disclosed herein, the RP has a half-capsule geometry and the bore region is rifled or is smooth. Optionally in any of the methods, projectiles, and/or projectile cartridges disclosed herein, the RP has a half-capsule geometry and the bore region is rifled. Optionally in any of the methods, projectiles, and/or projectile cartridges disclosed herein, the RP has a half-capsule geometry and an outer surface of the RP that is in contact a rifled-bore disrupter has a liner material.

Optionally in any of the methods, projectiles, and/or projectile cartridges disclosed herein, the RP is characterized by a tensile strength selected from the range of 160 KSI to 390 KSI. Optionally in any of the methods, projectiles, and/or projectile cartridges disclosed herein, the RP is characterized by a Rockwell hardness selected from the range of C30 to C70, preferably C40 to C70. Preferably in any of the methods disclosed herein, the RP is characterized by a tensile strength selected from the range of 160 KSI to 390 KSI and a Rockwell hardness selected from the range of C30 to C70, preferably C40 to C70. Optionally in any of the methods, projectiles, and/or projectile cartridges disclosed herein, the RP is characterized by a tensile strength selected from the range of 5 KSI to 320 KSI, optionally 5 KSI to 300 KSI, optionally 8 KSI to 300 KSI, optionally 10 KSI to 300 KSI, optionally 50 KSI to 300 KSI, optionally 100 KSI to 300 KSI, optionally 150 KSI to 390 KSI, optionally 150 KSI to 300 KSI, and a Rockwell hardness selected from the range of C30 to C70, preferably C40 to C70. Optionally in any of the methods, projectiles, and/or projectile cartridges disclosed herein, the RP is characterized by a tensile strength selected from the range of 5 KSI to 320 KSI, optionally 5 KSI to 300 KSI, optionally 8 KSI to 300 KSI, optionally 10 KSI to 300 KSI, optionally 50 KSI to 300 KSI, optionally 100 KSI to 300 KSI, optionally 150 KSI to 390 KSI, optionally 150 KSI to 300 KSI.

Optionally in any of the methods, projectiles, and/or projectile cartridges disclosed herein, the RP has a patterned or roughened outer surface. Optionally in any of the methods, projectiles, and/or projectile cartridges disclosed herein, the RP has a knurled outer surface, a brushed or tumbled outer surface, a pitted outer surface, or a polished outer surface. Optionally in any of the methods, projectiles, and/or projectile cartridges disclosed herein, the RP has an outer rough surface characterized by a surface roughness characterized by each of a spacing between surface texture peaks and a height between surface texture and surface texture valleys selected from the range of 0.0001" to 0.01". Optionally in any of the methods, projectiles, and/or projectile cartridges disclosed herein, the outer rough surface comprises texture features having a cross-sectional shape characterized triangular, rectangular, quadrilateral, parabolic, arc, polygonal, such as quadrilateral, pentagon, hexagon, octagon, or linear patterns such as grooves and lands. The surface roughness pattern can be in the form of surface pitting.

Optionally in any of the methods, projectiles, and/or projectile cartridges disclosed herein, the RP has a half-capsule geometry; and wherein the RP comprises an internal low-density region. Optionally in any of the methods, projectiles, and/or projectile cartridges disclosed herein, the RP has a half-capsule geometry; and wherein the RP comprises an internal low-density region; wherein the internal low-density region is an empty cavity or a cavity filled with a filler material, the filler material having a lower density than that of the rest of the RP. Optionally in any of the methods, projectiles, and/or projectile cartridges disclosed herein, the RP has a half-capsule geometry; and wherein the RP comprises an internal low-density region; wherein the internal low-density region is an empty cavity.

Optionally in any of the methods, projectiles, and/or projectile cartridges disclosed herein, the RP comprises a case hardened outer layer. Optionally in any of the methods disclosed herein, the RP comprises an outer coating later. Optionally in any of the methods, projectiles, and/or projectile cartridges disclosed herein, the RP comprises an outer coating layer comprising nickel, copper, a titanium alloy, and/or a ceramic.

The rounded projectile, or projectile cartridge having the rounded projectile, can be loaded in different ways into the PDD, where aspects of how the projectile is loaded, such as the position of the RP within the barrel, influence the flight, impact, penetration, and disruption behavior or features thereof of the RP. Preferably in any of the methods, projectiles, and/or projectile cartridges disclosed herein, the disrupter barrel has a chamber region at the barrel breech end, a bore region between the chamber region and the barrel muzzle end, and optionally a forcing cone region between the chamber region and the bore region; wherein the chamber region is characterized by a chamber wall and a chamber inner diameter, the chamber wall and the chamber inner diameter defining a chamber lumen; wherein the bore region is characterized by a bore wall and a bore inner diameter, the bore wall and the bore inner diameter defining a bore lumen; wherein the forcing cone region, if present, is characterized by a forcing cone wall and at least one forcing cone inner diameter, the forcing cone wall and at least one forcing cone inner diameter defining a forcing cone lumen; and wherein: during the step of loading, the RP is loaded into the disrupter barrel such that the RP is at least partially positioned in the forcing cone lumen and/or the bore lumen of the disrupter barrel when loaded. Preferably in any of the methods, projectiles, and/or projectile cartridges disclosed herein, the RP is positioned at least partially in the bore lumen when loaded. Optionally in any of the methods, projectiles, and/or projectile cartridges disclosed herein, the RP is positioned at least partially in the forcing cone lumen when loaded. Optionally in any of the methods, projectiles, and/or projectile cartridges disclosed herein, the RP is positioned at least partially in the bore lumen and in the forcing cone lumen when loaded. Preferably in any of the methods, projectiles, and/or projectile cartridges disclosed herein, the disrupter barrel comprises the forcing cone region.

Optionally in any of the methods disclosed herein, the step of loading the RP comprises loading a cartridge into the disrupter barrel, the cartridge comprising at least one cylindrical shell and a propellant; wherein the RP, when loaded, is operably connected to the distal end of the at least one cylindrical shell. Optionally in any of the methods disclosed herein, the step of loading the RP comprises muzzle-loading the RP. Preferably in any of the methods disclosed herein, the step of loading the RP comprises wrapping at least a portion of the RP proximal end. Preferably in any of the methods disclosed herein, the step of loading the RP comprises wrapping at least a portion of the RP proximal end but not the RP distal end with a wadding, cloth or patch. Optionally in any of the methods disclosed herein, the step of loading the RP comprises loading a tamp, such that the tamp is positioned in the barrel between the RP and a barrel breech end, preferably between a wadding surrounding a portion of the RP and the barrel breech end. In general, a tamp is placed between the propellant and the wrapped RP. If using a blank shell, the steps optionally include inserting the tamp in the chamber region which is final seated by pushing it with the blank cartridge. The wrapped RP can be breech loaded or muzzle loaded. If breech loaded, it can be wrapped and pushed into the breech, the tamp then being inserted with the final seating of the tamp and RP is completed by fully inserting the cartridge. Optionally in any of the methods, projectiles, and/or projectile cartridges disclosed herein, the cartridge comprises the RP. Optionally in any of the methods, projectiles, and/or projectile cartridges disclosed herein, the cartridge comprises the RP, such that the RP is at least partially inside the cartridge or a shell thereof.

Also provided herein are projectile cartridges having a rounded projectile and which can be loaded into a PDD for disrupting an explosive target. Aspects of the invention include a projectile cartridge for use in a propellant driven disrupter (PDD) for disrupting an explosive device, the cartridge comprising: a first cylindrical shell having a first shell proximal end and a first shell distal end, the first shell proximal end configured to face a barrel breech end of a barrel of the PDD, and the first shell distal end configured to face a barrel muzzle end of the PDD; wherein the first cylindrical shell is at least partially formed of a metallic material; a rounded projectile (RP) having: a RP proximal end facing toward the disrupter barrel breech end when loaded in the barrel; a RP distal end opposed to the proximal end and facing toward the disrupter barrel muzzle end when loaded in the barrel; and a RP maximal outer diameter being between 90% and 100% of an inner diameter of the disrupter barrel; wherein the RP is characterized by a tensile strength selected from the range of 160 KSI to 390 KSI and/or a Rockwell hardness selected from the range of C40 to C70; and wherein the RP is positioned at least partially within the first cylindrical shell at the first shell distal end; a wadding or liner in physical contact with and covering the RP proximal end; and a propellant region comprising a propellant; wherein the propellant region is inside the first cylindrical shell. A preferred RP maximal outer diameter, depending of course on the disrupter, is 23/32" with an attendant clearance of 0.05" relative to the barrel bore diameter, or about 93.5% bore diameter occupancy. In this configuration, high speed RP exiting the disrupter is reliably achieved, including above 4950 fps, and above 5100 fps.

The rounded projectiles are preferably used with a wadding or a liner. A wadding helps to keep the RP centered in the barrel, especially in the case of a spherical projectile and a smooth bore. The wadding preferably also acts as a gas seal and preferably keeps the shell internal components behind the projectile in flight by not allowing them to pass through the gap between the bore and the RP. The wadding preferably can be made of a low friction material or a self-lubricating textile. For example, textile wadding can be constructed from silk, cotton, synthetic fibers, Kevlar™ Dyneema™, a similar material, or any combination of these. The reduced friction results in increased projectile velocity. A liner, if used, also helps to keep the projectile centered but may have additional benefits of minimizing or eliminating creation of secondary projectiles by minimizing or eliminating pieces of the RP coming off due to interaction with the rifling.

Preferably for any of the rounded projectiles and/or projectile cartridges disclosed herein comprising the wadding, the wadding is formed of a textile or other flexible material. For the wadding, a high strength textile material, such as but not limited to Kevlar™, is preferably and important for projectiles traveling above 2700 fps. The wadding material is preferably heat resistant, has a low friction coefficient, and has a high tensile strength. Preferably for any of the rounded projectiles and/or projectile cartridges disclosed herein comprising the wadding, the wadding is in physical contact with and covers at least 50% of a surface area of the RP. Preferably for any of the rounded projectiles and/or projectile cartridges disclosed herein comprising the wadding, the wadding physically separates the first cylindrical shell and the RP. Preferably for any of the rounded projectiles and/or projectile cartridges disclosed herein comprising the wadding, the wadding is in physical contact with a proximal surface area region of the RP and the wadding is not in physical contact with the RP distal end.

Preferably for any of the rounded projectiles and/or projectile cartridges disclosed herein, the RP is at least partially positioned within a forcing cone lumen and/or within a bore lumen of the PDD barrel when the cartridge is loaded in the PDD barrel. Preferably for any of the rounded projectiles and/or projectile cartridges disclosed herein, the cartridge has a longitudinal length selected from the range of 2.75 in. to 4.5 in. Preferably for any of the rounded projectiles and/or projectile cartridges disclosed herein, the cartridge has a longitudinal length selected such that a scaling ratio of the cartridge longitudinal length to an internal diameter of the PDD barrel's bore selected from the range of 3.5 to 6.5. Preferably for any of the rounded projectiles and/or projectile cartridges disclosed herein, the first cylindrical shell is at least partially formed of a steel alloy.

Optionally for any of the rounded projectiles and/or projectile cartridges disclosed herein, the cartridge comprises a cartridge outer layer surrounding at least a portion of the first cylindrical shell or being an outer surface layer of at least a portion of the first cylindrical shell. Optionally for any of the rounded projectiles and/or projectile cartridges disclosed herein, the cartridge outer layer is a coating or lubricant. Optionally for any of the rounded projectiles and/or projectile cartridges disclosed herein, the cartridge outer layer comprises a carbon fiber reinforced polymer. Optionally for any of the rounded projectiles and/or projectile cartridges disclosed herein, the cartridge outer layer is a second cylindrical shell surrounding at least a portion of the first cylindrical shell and configured to physically separate the first cylindrical shell from an interior surface of the PDD barrel of the PDD when the cartridge is loaded in the barrel. Optionally for any of the rounded projectiles and/or projectile cartridges disclosed herein, the cartridge outer layer is a non-galling layer.

Optionally for any of the rounded projectiles and/or projectile cartridges disclosed herein, the first cylindrical shell has a longitudinally varying wall thickness and a (correspondingly) longitudinally varying diameter of the propellant region. With the longitudinally varying wall thickness of the first cylindrical shell there is a corresponding longitudinally varying inner diameter of the first cylindrical shell. Preferably, though not necessarily, at least a portion of the lumen, or internal volume, of the first cylindrical shell corresponds to the propellant region inside the first cylindrical shell. Thus, typically, though not necessarily the longitudinally varying inner diameter of the first cylindrical shell corresponds to a longitudinally varying propellant region diameter. Preferably, at the propellant region of the first cylindrical shell, the first shell inner diameter is equal to or substantially equal to the propellant region diameter. Optionally for any of the rounded projectiles and/or projectile cartridges disclosed herein, the longitudinally varying wall thickness increases from the first shell proximal end toward the first shell distal end such that the longitudinally varying diameter of the propellant region decreases from the first shell proximal end toward the first shell distal end. Optionally for any of the rounded projectiles and/or projectile cartridges disclosed herein, the cartridge comprises a primer operably connected to the propellant in the propellant region. Optionally for any of the rounded projectiles and/or projectile cartridges disclosed herein, the cartridge propellant region comprises a plurality of types of propellant grains arranged as a mixture and/or as a plurality of layers; wherein the cartridge propellant region comprises more of a first type of propellant grains toward the cartridge proximal end and more of a second type of propellant grains toward the cartridge distal end; and wherein the first type of propellant grains are characterized by a higher characteristic burn rate than the second type of propellant grains. Optionally for any of the rounded projectiles and/or projectile cartridges disclosed herein, the propellant region comprises at least one non-propellant additive mixed with propellant grains and/or arranged in one or more layers, each layer adjacent to a layer of propellant grains; wherein the cartridge propellant region comprises a higher concentration of at least one non-propellant additive toward a propellant region distal end and a lower concentration of the at least one non-propellant additive toward a propellant region proximal end. Optionally for any of the rounded projectiles and/or projectile cartridges disclosed herein, the propellant region comprises a plurality of propellant sub-regions, each propellant sub-region comprising a different propellant or propellant mixture than each other propellant sub-region. Optionally for any of the rounded projectiles and/or projectile cartridges disclosed herein, a propellant sub-region closer to the cartridge proximal end comprises a propellant having a higher characteristic burn rate than that of a different propellant-region closer to the cartridge distal end. Optionally for any of the rounded projectiles and/or projectile cartridges disclosed herein, any two propellant sub-regions are physically separated by a separator. Optionally for any of the rounded projectiles and/or projectile cartridges disclosed herein, the separator is formed of a moisture-repellant material. Optionally for any of the rounded projectiles and/or projectile cartridges disclosed herein, the separator is formed of a waterproof material. Optionally for any of the rounded projectiles and/or projectile cartridges disclosed herein, the first cylindrical shell further comprises a tamp at the cartridge distal end positioned between the propellant region and the wadding or liner; wherein the tamp is formed of a material that is non-combustible. Optionally for any of the rounded projectiles and/or projectile cartridges disclosed herein, the first cylindrical shell further comprises a tamp at the cartridge distal end positioned between the propellant region and the wadding or liner; wherein the tamp is formed of a material that is non-combustible and water-repellant. Optionally for any of the rounded projectiles and/or projectile cartridges disclosed herein, the first cylindrical shell further comprises a tamp at the cartridge distal end positioned between the propellant region and the wadding or liner; wherein the tamp is formed of or comprises a material that is non-combustible, water-repellant, and incompressible. Preferably, the tamp is formed of or comprises a material that is non-combustible, water-repellant, and incompressible. Optionally for any of the rounded projectiles and/or projectile cartridges disclosed herein, the tamp comprises silicone, sand, clay, hollow ceramic microspheres, and/or a high cell density closed cell foam.

Optionally for any of the rounded projectiles and/or projectile cartridges disclosed herein, the RP is operably connected to the first cylindrical shell via a friction fit between the RP and the first cylindrical shell, an epoxy layer positioned between the RP and the first cylindrical shell, one or more magnets positioned in a wall of the first cylindrical shell configured to magnetically connect the RP with the cylindrical shell, and/or via a crimp in the first cylindrical shell. Optionally for any of the rounded projectiles and/or projectile cartridges disclosed herein, the first cylindrical shell distal end comprises a crimp configured to trap the RP within the first cylindrical shell. Optionally for any of the rounded projectiles and/or projectile cartridges disclosed herein, the RP is magnetic and wherein the first cylindrical shell comprises one or more magnets and/or a magnetic coating at the first cylindrical shell distal end configured to magnetically hold the RP in operable connection with the first cylindrical shell.

Optionally for any of the rounded projectiles and/or projectile cartridges disclosed herein, the projectile cartridge comprises a rupture disk screwed into the first cylindrical shell at the first shell distal end; wherein the rupture disk is positioned between the propellant region and the RP. Optionally for any of the rounded projectiles and/or projectile cartridges disclosed herein, the RP has a spherical geometry between the RP maximal outer diameter and the RP distal end. Optionally for any of the rounded projectiles and/or projectile cartridges disclosed herein, the RP has a spherical geometry or a half-capsule geometry. Optionally for any of the rounded projectiles and/or projectile cartridges disclosed herein, the RP has a spherical geometry and the PDD barrel's bore is not rifled. Optionally for any of the rounded projectiles and/or projectile cartridges disclosed herein, the RP has a half-capsule geometry and PDD barrel's bore is rifled.

Optionally for any of the rounded projectiles and/or projectile cartridges disclosed herein, the RP has a half-capsule geometry; and wherein the RP comprises an internal low-density region; wherein the internal low-density region is an empty cavity or a cavity filled with a filler material, the filler material having a lower density than that of the rest of the RP. Optionally for any of the methods, rounded projectiles, and/or projectile cartridges disclosed herein comprising the liner, the RP has a half-capsule geometry; and the liner is adhered to the RP such that the liner does not detach from the RP when the RP is fired out of the barrel and when the RP impacts with the explosive device. Optionally for any of the methods, rounded projectiles, and/or projectile cartridges disclosed herein comprising the liner, the RP has a half-capsule geometry; and wherein the liner is adhered to the RP via being screwed onto the RP. Optionally for any of the methods, rounded projectiles, and/or projectile cartridges disclosed herein comprising the liner, the RP has a half-capsule geometry; and wherein the liner is formed of a heat and friction resistant plastic, polycarbonate, aluminum, copper, and/or brass. Preferably for any of the methods, rounded projectiles, and/or projectile cartridges disclosed herein, 20% to 100% of the RP is seated within the first cylindrical shell. Optionally for any of the methods, rounded projectiles, and/or projectile cartridges disclosed herein, the RP has a maximal outer diameter selected from the range of 0.22 to 2 inches. Optionally for any of the methods, rounded projectiles, and/or projectile cartridges disclosed herein, the RP has a maximal outer diameter that is between 90% and 99.99%, preferably between 96% and 99.9%, of an internal diameter of the PDD barrel's bore. Optionally for any of the methods, rounded projectiles, and/or projectile cartridges disclosed herein, the RP has a maximal outer diameter that is between 96% and 99.99% of an internal diameter of the PDD barrel's bore. Optionally for any of the methods, rounded projectiles, and/or projectile cartridges disclosed herein, the RP has a maximal outer diameter that is less than and within 0.04 in. of an internal diameter of the PDD barrel's bore.

Preferably for any of the methods, rounded projectiles, and/or projectile cartridges disclosed herein, the RP is formed of one or more steel alloys, a chromium steel, S2 steel, S4 steel, C300 steel, C350 steel, other tool steels, armor steel, one or more titanium alloys, Ti-6Al-4V, one or more nickel alloys, one or more tungsten alloys, or any combination of these. Preferably for any of the methods, rounded projectiles, and/or projectile cartridges disclosed herein, the RP is characterized by a tensile strength selected from the range of 160 KSI to 390 KSI and a Rockwell hardness selected from the range of C40 to C70. Optionally for any of the methods, rounded projectiles, and/or projectile cartridges disclosed herein, the RP is characterized by a durameter selected from the range of 70 to 90. Optionally for any of the methods, rounded projectiles, and/or projectile cartridges disclosed herein, RP is characterized by a density selected from the range of 4.5 to 16 g/cm$^3$. Optionally for any of the methods, rounded projectiles, and/or projectile cartridges disclosed herein, the RP is chemically, physically, and/or magnetically adhered to the first cylindrical shell. Optionally for any of the methods, rounded projectiles, and/or projectile cartridges disclosed herein, the RP is configured for use with a smooth PDD barrel or configured for use with a smooth and rifled PDD barrel. Optionally for any of the methods, rounded projectiles, and/or projectile cartridges disclosed herein, the RP is configured for use with a smooth PDD barrel. Optionally for any of the methods, rounded projectiles, and/or projectile cartridges disclosed herein, the RP is configured for use with a smooth and a rifled PDD barrel. Optionally for any of the methods, rounded projectiles, and/or projectile cartridges disclosed herein, the RP has a patterned or roughened outer surface. Optionally for any of the methods, rounded projectiles, and/or projectile cartridges disclosed herein, the RP has a knurled outer surface, a brushed or tumbled outer surface, a pitted outer surface, or a polished outer surface. Optionally for any of the methods, rounded projectiles, and/or projectile cartridges disclosed herein, the RP has an outer rough surface characterized by a surface roughness characterized by each of a spacing between surface texture peaks and a height between surface texture and surface texture valleys selected from the range of 0.0001" to 0.01". Optionally for any of the methods, rounded projectiles, and/or projectile cartridges disclosed herein, the RP comprises a case hardened outer layer. Optionally for any of the methods, rounded projectiles, and/or projectile cartridges disclosed herein, the RP is a composite comprising a core material and an outer layer that surrounds the core material selected to: avoid target barrier secondary fragments or spall; minimize interaction between shell elements and target, and have a decreased risk of unwanted shock initiation of a target explosive. Optionally for any of the methods, rounded projectiles, and/or projectile cartridges disclosed herein, the RP is formed of a material or materials configured to be non-frangible during use, such that the RP is not fractured or disintegrated upon impact with a metal barrier of the explosive device.

Aspects of the invention also include a method for disrupting an explosive device using a propellant driven disrupter (PDD), the method comprising the steps of: loading a rounded projectile (RP) into a disrupter barrel of the PDD; aiming the PDD at a target portion of the explosive device; propelling the RP out of the barrel and toward the target portion of the explosive device; wherein the RP travels along a linear trajectory defined by a barrel longitudinal axis extending between a barrel muzzle end and the target portion; impacting the RP with the explosive device or a portion thereof; traversing the RP a penetration distance through the explosive device or the portion thereof; wherein the RP traverses the penetration distance along said linear trajectory, such that the RP follows said linear trajectory during the steps of propelling, impacting, and traversing; and disrupting the explosive device without detonating an explosive of the explosive device. Optionally, the RP follows said linear trajectory during the steps of propelling, impacting, and traversing with a deviation distance from said linear trajectory less than or equal to 0.2 inches; and wherein a standoff distance between the barrel muzzle end and the barrier portion is selected from the range of 2 ft. and 20 ft., including up to 60 ft. For higher accuracy and larger stand-off distances, an optical sight may be used to facilitate alignment. Optionally, a wadding surrounds at least a portion of the RP when the RP is loaded in the barrel; and wherein the wadding does not impact with nor interact with the explosive device or any portion thereof prior to the impacting between the composite projectile and the explosive device. Optionally, the RP maintains a core integrity throughout the method. Optionally, the RP has a velocity selected from the range of 1800 fps to 5,000 fps outside the barrel during the step of propelling and before the step of impacting. Optionally, the RP deforms by less than 1.5% in radius at least during the steps of propelling and impacting compared to the same RP prior to the step of propelling. Optionally, the RP has a spherical geometry between a maximal outer diameter of the RP and a distal end of the RP. Optionally, the RP has a spherical geometry or a half-capsule geometry. Optionally, the RP is characterized by a tensile strength selected from the range of 160 KSI to 390 KSI and a Rockwell hardness selected from the range of C40 to C70. Optionally, the RP has a half-capsule geometry; and wherein the RP comprises an internal low-density region; wherein the internal low-density region is an empty cavity or a cavity filled with a filler material, the filler material having a lower density than that of the rest of the RP. Optionally, the disrupter barrel has a chamber region at the barrel breech end, a bore region between the chamber region and the barrel muzzle end, and optionally a forcing cone region between the chamber region and the bore region; wherein the chamber region is characterized by a chamber wall and a chamber inner diameter, the chamber wall and the chamber inner diameter defining a chamber lumen; wherein the bore region is characterized by a bore wall and a bore inner diameter, the bore wall and the bore inner diameter defining a bore lumen; wherein the forcing cone region, if present, is characterized by a forcing cone wall and at least one forcing cone inner diameter, the forcing cone wall and at least one forcing cone inner diameter defining a forcing cone lumen; and wherein: during the step of loading, the RP is loaded into the disrupter barrel such that the RP is at least partially positioned in the forcing cone lumen and/or the bore lumen of the disrupter barrel.

Other aspects of the invention disclosed herein include methods, rounded projectiles, and projectile cartridges having any one or any combination of embodiments of methods, rounded projectiles, and projectile cartridges disclosed herein.

Without wishing to be bound by any particular theory, there may be discussion herein of beliefs or understandings of underlying principles relating to the devices and methods disclosed herein. It is recognized that regardless of the ultimate correctness of any mechanistic explanation or hypothesis, an embodiment of the invention can nonetheless be operative and useful.

DETAILED DESCRIPTION OF THE INVENTION

Figure 1:
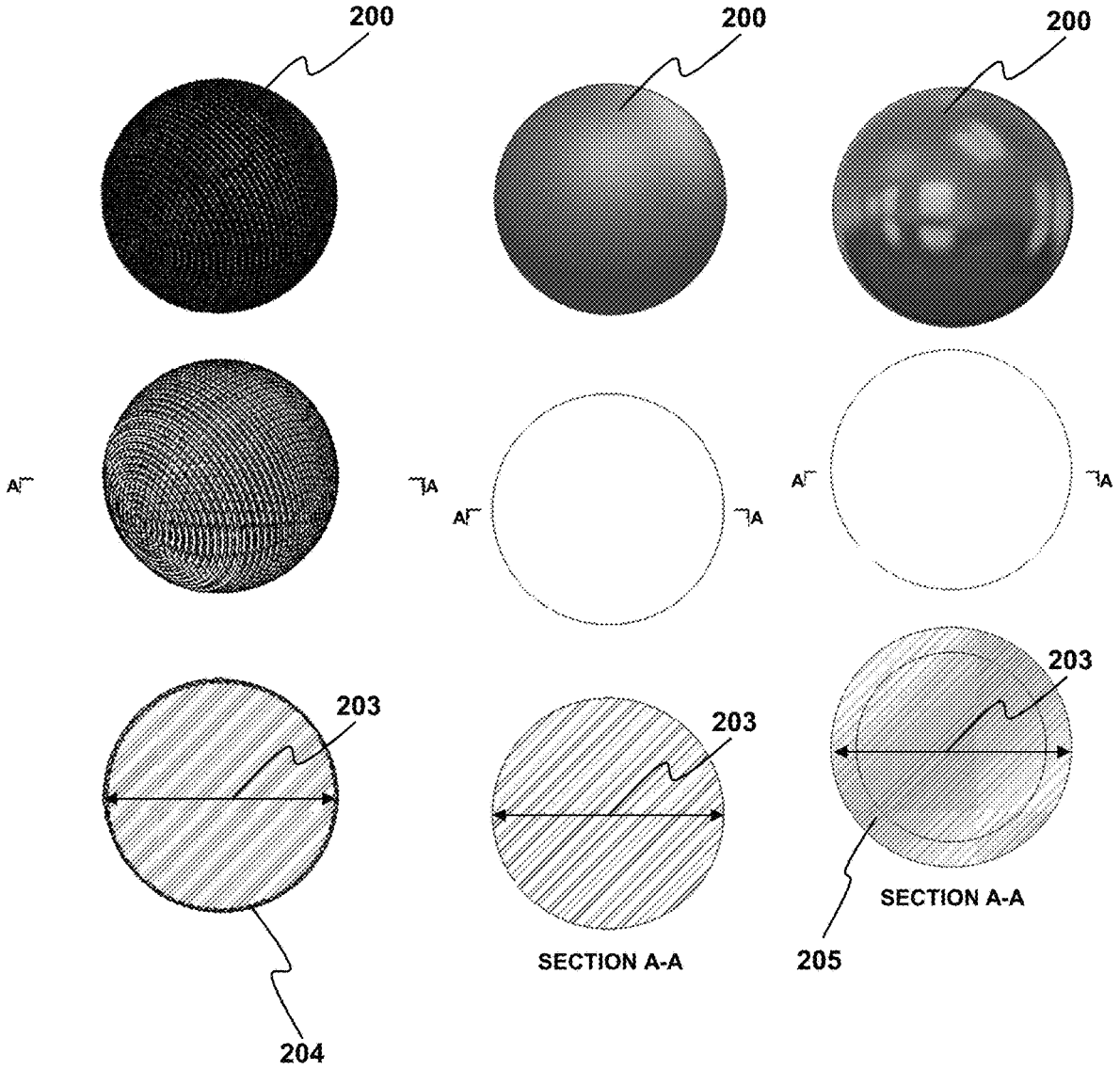
FIG. 1. Illustrations of different perspectives, including cross-sectional views, of rounded projectiles, according to certain embodiments, with various surface roughness patterns: knurled (left), brushed/tumbled (center) and polished (right). A case hardened or coated supersphere would look similar to the drawings on the right side. The coating/hardening layer vary in thickness depending on process used.

In general, the terms and phrases used herein have their art-recognized meaning, which can be found by reference to standard texts, journal references and contexts known to those skilled in the art. Referring to the drawings, like numerals indicate like elements and the same number appearing in more than one drawing refers to the same element. The following definitions are provided to clarify their specific use in the context of the invention.

The term "half-capsule geometry" refers to a geometry resembling a cylinder with one hemispherical end. The half-capsule geometry also resembled a capsule, or spherocylinder, that is cut in half along a plane perpendicular to the capsule's longitudinal axis, or a capsule minus one of the hemispherical ends.

The term "explosive device" refers to a device that comprises an explosive material and which is disrupted by via use of the propellant driven disrupter, or particularly by a rounded projectile. Exemplary explosive devices include IEDs. Typical explosive devices include at least an explosive, a power source, conductors, a switch, and an initiator, or any subcombination of these, wherein an exemplary mechanism for disruption of the explosive device involves destroying or disabling the power source and/or switch and/or a connection between any of these and the explosive material, without detonating the explosive material.

The term "breech" or "breech end" of a barrel refers to the rear end or rear end region of a barrel, the rear end being the barrel's end or portion farthest from the barrel's muzzle and farthest from the target. The barrel is configured with the propellant driven disrupter such that ignition of the propellant occurs at or near the barrel's breech end. The breech end of the barrel is also the proximal-most end of the barrel. The term "muzzle" or "muzzle end" of a barrel refers to the end or region of the barrel that is closest to the target and refers to the opening or region at the opening of the barrel out of which the projectile is propelled and out of which the projectile exits when the projectile is fired at a target.

"Distal" refers to a direction that is furthest from the breech or that is closest to the to-be-disrupted target. "Proximal" refers to a direction that is toward the breech or that is furthest from the to-be-disrupted target. Each of the terms distal and proximal may thus be used to describe portions, regions, and ends of components, systems, devices, and elements, such as portions, regions, and ends of a rounded projectile, a barrel, a projectile cartridge, or portions thereof. For example, a proximal portion or end of a rounded projectile is the portion or end closest to or facing toward the barrel's breech end or that is furthest from the to-be-disrupted target explosive device. For example, a distal portion or end of a rounded projectile is the portion or end furthest from the breech or that is closest to the to-be-disrupted target explosive device.

The term "solid state weld" refers to a weld or bond between two solid materials. Formation of a solid state weld may, but does not necessarily, involve melting of at least one of the two solid materials and/or solid state diffusion of one or both material at the interface between the two. A propelled rounded projectile, according to embodiments herein, can transfer energy between the rounded projectile and a material it impacts (e.g., a barrier portion of the explosive device) that is sufficient to cause the solid state welding between the rounded projectile and the impacted material. For example, the barrier material that is impacted by the rounded projectile may flow and bond to the rounded projectile due to extreme pressure and heat at impact. In this manner, unwanted release of barrier fragments into the explosive device is minimized or avoided, thereby minimizing risk of an uncontrolled detonation of explosive material.

"Core integrity" refers to the RP that to the naked eye remains unchanged throughout the process of firing, impacting the target and traversing the target. For example, the shape of the RP is maintained. With respect to the plastic fluidization and barrier flow that generates the solid state weld, the core integrity of the RP is maintained. That is to say, the chemical nature and macroscopic property is maintained. There may be microscopic perturbation of the RP, but any such perturbation is minor and not readily detectable. In contrast, the macroscopic observable changes is a bulk portion of the impacted barrier is bonded to the distal end of the RP, thereby resulting in an increase mass corresponding to RP plus solid state welded portion of the target barrier. This is further reflected in that the barrier portion bonded to the RP may be pried off the RP without visibly damaging the RP. In fact, if desired the RP is even capable of being reused. This particularly can be the case for impacts below 2500 fps on steel barriers less than or equal to 0.25" thickness. Depending on the RP material, re-use may be possible. C300 balls may be re-used, for example, but chromium steel balls, for example, have fine fracture lines in them and likely would not survive a second impact.

The term "shape" or "geometry" of a rounded projectile may refer to an overall shape of the rounded projectile, such as a cross-sectional shape or cross-sectional contour of an outer surface of the rounded projectile, or a shape of a portion/region of the RP, where the portion of the rounded projectile may be a distal end, an outer surface of the distal end, a proximal end, or an outer surface at the proximal end.

The term "end" in "distal end" and "proximal end" of an element refers to the portion or region at the respective end of the identified element, such as a barrel, shell, cartridge, or projectile. For example, the proximal end of rounded projectile (RP) can refer to the portion of the RP between the middle or a point of maximal outer diameter of the RP and the proximal-most end of the RP. The proximal end includes the proximal-most end, such as the proximal tip, of the identified element.

"Operably connected" refers to a configuration of elements, wherein an action or reaction of one element affects another element, but in a manner that preserves each element's functionality. For example, a rounded projectile (RP) is operably connected to a first cylindrical shell or to a propellant region of a projectile cartridge such that the RP is propelled away from the projectile cartridge and expelled from the disrupter barrel after ignition of the propellant in the projectile cartridge. The connection may be by a direct physical contact between elements. The connection may be indirect, with another element that indirectly connects the operably connected elements. For example, the RP may be in operable connection with the first cylindrical shell and the propellant of the projectile cartridge though the RP is physically separated from the first cylindrical shell and the propellant by at least a wadding or liner, in certain embodiments.

The terms "directly and indirectly" describe the actions or physical positions of one component relative to another component. For example, a component that "directly" acts upon or touches another component does so without intervention from an intermediary. In contrast, a component that "indirectly" acts upon or touches another component does so through an intermediary (e.g., a third component).

The term "substantially equivalent" refers to one or more properties of two or more elements that are within 20%, within 15%, within 10%, within 5%, within 1%, or are equivalent. For example, the diameter of an element A is substantially equivalent to the diameter of an element B if these diameters are within 20%, within 15%, within 10%, within 5%, within 1%, or are equivalent.

Rarefaction is an art-recognized term referring to the reflection of a pressure wave at an interface due to a shock impedance mismatch. The term rarefaction waves refers to the release waves themselves that are reflecting off of free surfaces in the projectile and barrier. Rarefaction waves are tensile waves. If the release wave is of high enough intensity, it can produce a spall fracture zone. Release waves can collide and amplify constructively to produce a spall fracture zone. The term "rarefaction wave amplitude" refers to the absolute value of the pressure at peak.

The term "shock initiation event" refers to an explosion, detonation, or other unwanted failure of the target caused by shock delivered by the projectile onto the target (e.g., the target explosive device may detonate as a result of the imparted shock during transfer of energy from the projectile to the target device). The term "probability of a shock initiation event" refers to the statistical probability of the projectile causing a shock initiation event, for a particular disrupter and projectile system. The probability of a shock initiation event is affected, for example, by the velocity, density, and cross-sectional area, shape, and shock Hugoniot properties of the projectile.

The term "stand-off distance" refers to the maximal distance between the barrel muzzle end and the target explosive device at which the projectile may be fired to achieve target explosive device disruption safely. The nominal stand-off distance refers to the distance resulting in optimum performance.

Incorporated herein by reference in their entirety, to the extent not inconsistent herewith, are the following applications: U.S. application Ser. No. 16/366,487 filed Mar. 27, 2019, Ser. No. 15/731,874 filed Aug. 18, 2017, Ser. No. 16/209,643 filed Dec. 4, 2018, and Ser. No. 15/896,760 filed Feb. 14, 2018. These applications may include certain useful descriptions.

In the following description, numerous specific details of the devices, device components and methods of the present invention are set forth in order to provide a thorough explanation of the precise nature of the invention. It will be apparent, however, to those of skill in the art that the invention can be practiced without these specific details.

FIGS. 1-24 include illustrations showing various non-limiting embodiments of rounded projectiles (RPs), projectile cartridges, propellant driven disrupters, and methods disclosed herein.

FIGS. 4, 10, 13, 23, and 24 show a propellant driven disrupter (PDD) 100, which includes a disrupter barrel 102. Disrupter barrel 102 can be characterized by a longitudinal axis 103 of the disrupter barrel, which is an axis going through the cross-sectional center of the barrel's inner lumen along the length (longest dimension) of the barrel, as illustrated in at least FIG. 23. Disrupter barrel 102 includes a disrupter barrel muzzle end 104 and a disrupter barrel breech end 106. Disrupter barrel 102 has a chamber region 108A, a barrel bore 112A, and optionally a forcing cone 110A. The disrupter barrel chamber region 108A is characterized by a chamber wall 108B and a chamber inner diameter 108C, the chamber wall 108B and chamber inner diameter 108C defining a chamber lumen 108D. Preferably, disrupter barrel 102 includes the forcing cone 110A. Forcing cone 110A is characterized by a forcing cone wall 1108 and a longitudinally varying forcing cone inner diameter 110C, which together define the forcing cone lumen 110D. The disrupter barrel bore 112A is characterized by a barrel bore wall 112B and a barrel bore inner diameter 112C, which together define the barrel bore lumen 112D. The forcing cone lumen 110D corresponds to a transition between the chamber lumen 108D and the disrupter bore lumen 112D. Because the chamber inner diameter 108C is greater than the bore inner diameter 112C, the forcing cone lumen has a correspondingly longitudinally varying inner diameter 110C as part of the transition.

FIG. 1 shows different views of a rounded projectile (RP) 200 having a spherical geometry. A spherical RP 200 is also referred to herein as a supersphere. RP 200 is characterized by a maximal outer diameter 203, which corresponds to a diameter of a sphere representing a spherical RP. The left set of images show views of an RP having a knurled RP outer surface 204. The middle set of images show views of an RP having a brushed or tumbled RP outer surface 204. The right set of images show views of an RP having a polished RP outer surface 204. Any RP 200 (including any RP 220) optionally has an outer layer 205 having a different composition and/or one or more properties compared to the rest of the RP. Outer layer 205 can be an anodized layer, a case hardened layer, or a deposited coating, for example. Illustrations in FIGS. 3-13, 15-16, 20, and 23-24 show RP 200 in relation to projectile cartridge 300A and/or a disrupter barrel 102, where RP proximal end 201 and RP distal end 202 are identified. RP proximal end 201 may refer to a proximal region or proximal portion of RP 200, such as but not necessarily, corresponding to the portion of RP 200 found between a point or plane of having maximal outer diameter 203 and the proximal-most point of RP 200. RP distal end 202 may refer to a distal region or distal portion of RP 200, such as but not necessarily, corresponding to the portion of RP 200 found between a point or plane of having maximal outer diameter 203 and the distal-most point of RP 200. As noted above, proximal end 201 faces barrel breech end 106 when loaded (and away from an explosive device 120 when aimed or fired) and distal end 202 faces barrel muzzle end 104 when loaded (and faces toward explosive device 120 when aimed or fired).

Figure 18:
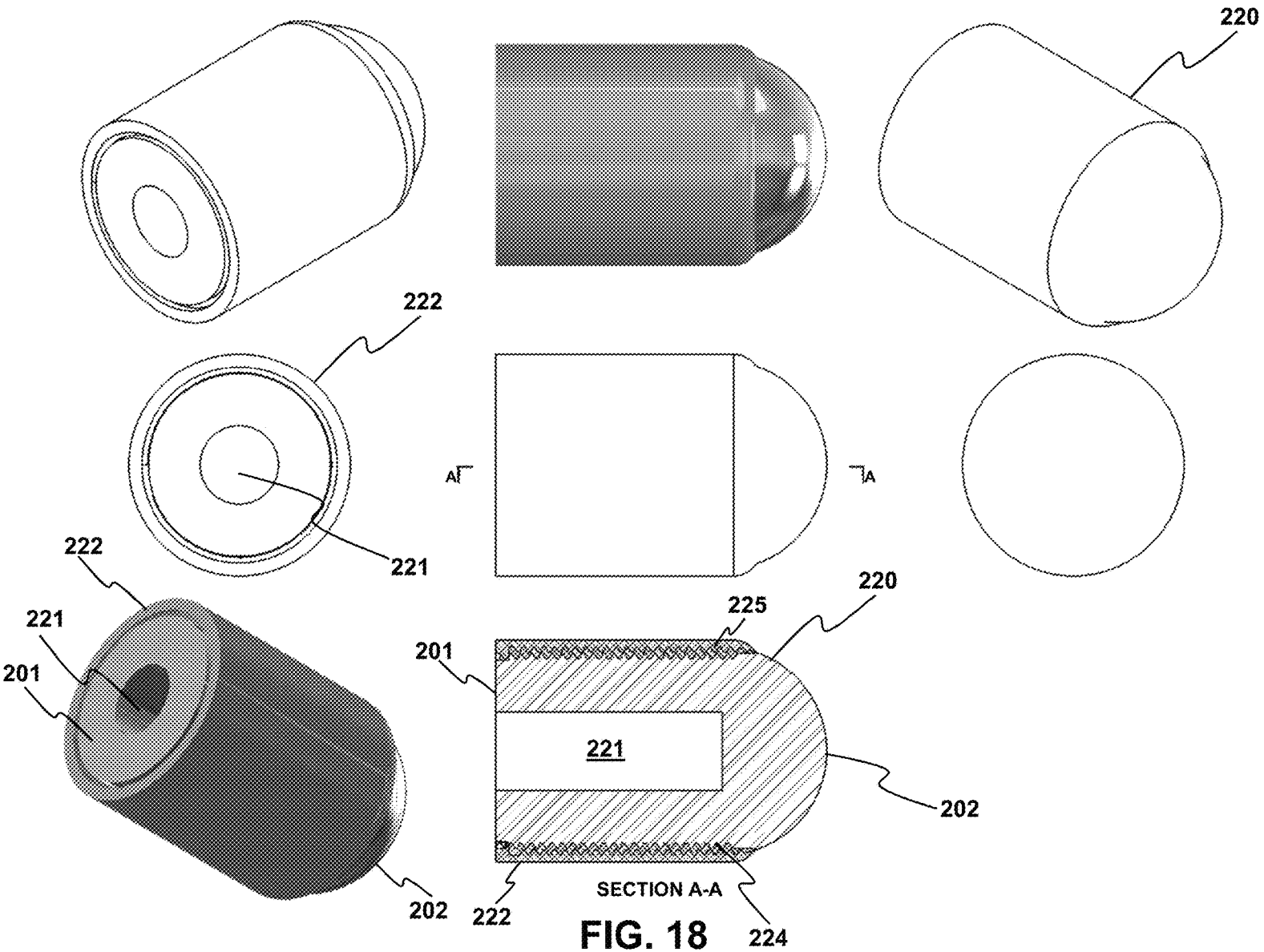
FIG. 18. Illustrations of different perspectives, including a cross-sectional view, of a rounded projectile having a half-capsule geometry, according to certain embodiments. The rounded projectile having the half-capsule geometry includes a thread-on liner plastic or metal. The liner can be formed, for example, of polycarbonate, copper, aluminum, and/or brass.
Figure 19:
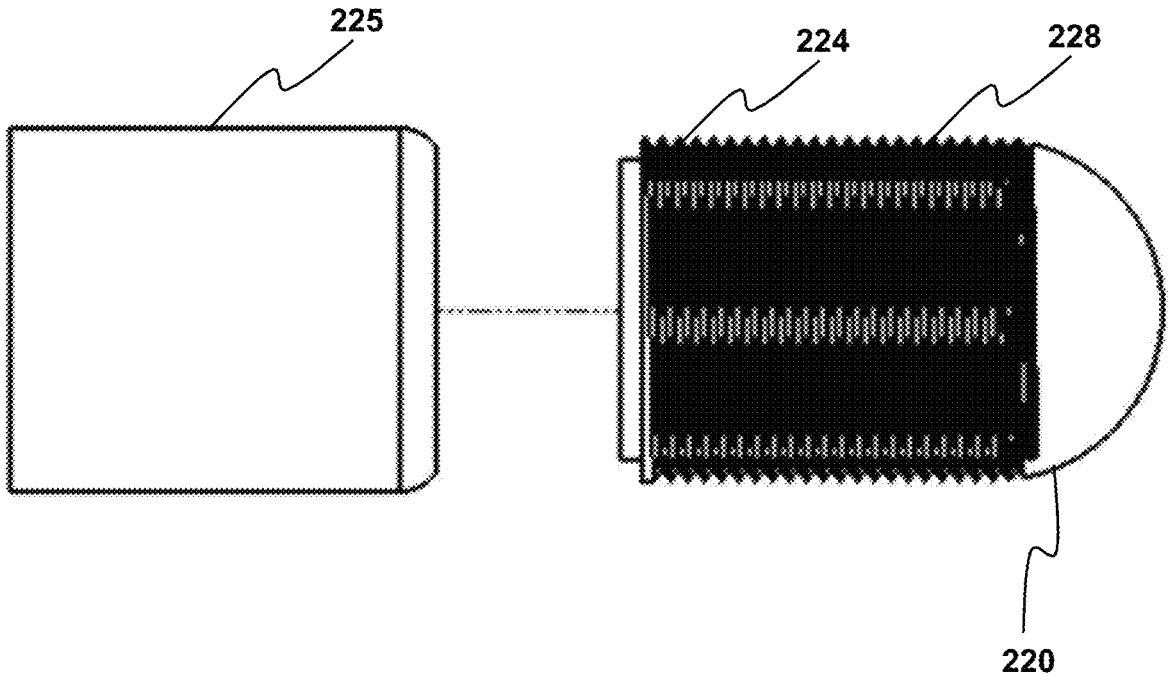
FIG. 19. Illustrations of different perspectives, including a cross-sectional view, of a rounded projectile having a half-capsule geometry, according to certain embodiments. The rounded projectile having the half-capsule geometry can be used with a rifled barrel. The exploded view shows a thread-on liner of plastic such as polycarbonate or soft ductile metal such as copper.
Figure 20:
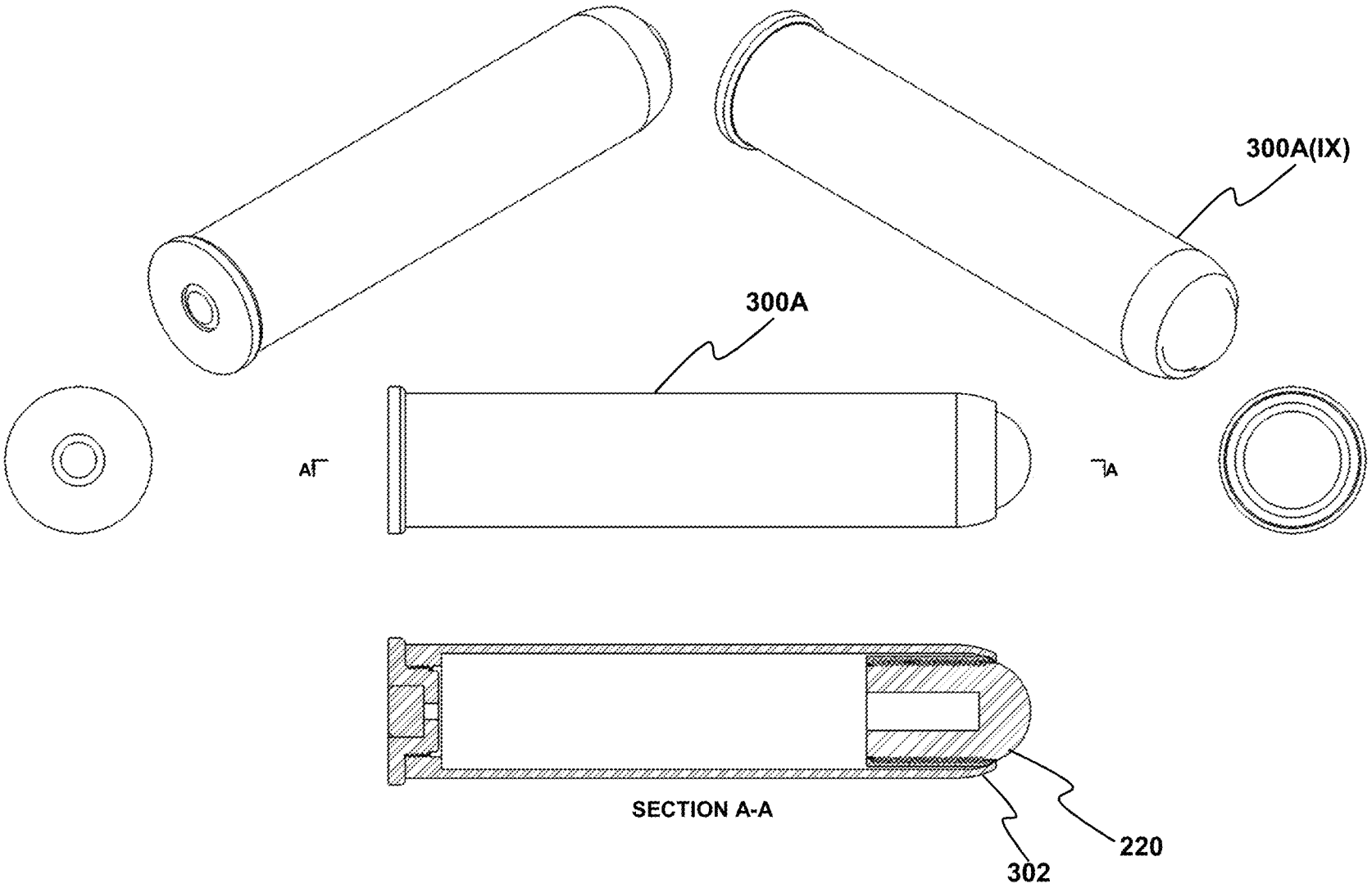
FIG. 20. Illustrations of different perspectives, including a cross-sectional view, of a projectile cartridge with a rounded projectile having a half-capsule geometry, according to certain embodiments. The first cylindrical shell has a straight profile and a crimp. Propellant and fillers not shown but may be present. The rounded projectile having the half-capsule geometry includes a thread-on liner.
Figure 21:
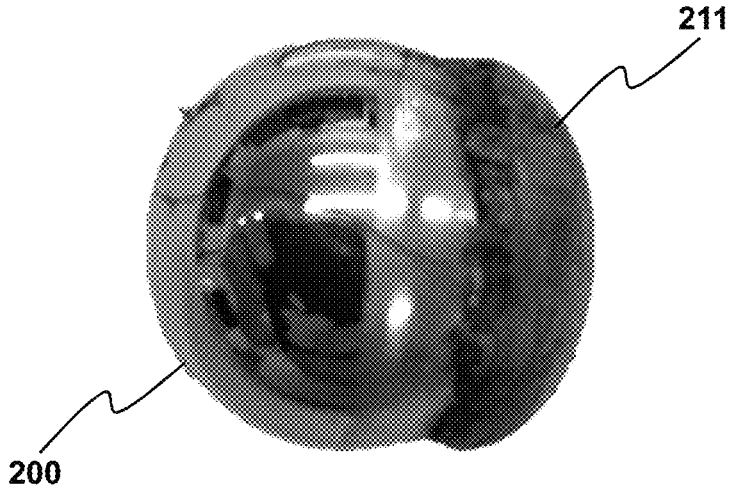
FIG. 21. Photograph of a composite projectile.

RP 200 optionally has a half-capsule geometry. RP 220 is an RP 200 that has a half-capsule geometry. (RP 200 is used generically to refer to any rounded projectile disclosed herein, such as spherical or half-capsule.) RP 220 is also referred to herein as a superslug. Non-limiting embodiments of RP 220 are shown in FIGS. 17-20. RP 220 includes a low-density internal region 221. Internal low-density region 221 is optionally a void, such as shown in FIG. 18, or is optionally at least partially filled with a filler material 226, which has a lower density than the rest of RP 220. Filler material 226 can be, for example, plastic or a carbon fiber reinforced polymer. RP 220 can be surrounded by wadding 303 or a liner 222. RP 220 is compatible with smooth and rifled barrel bores. In contrast, a spherical RP 200 is preferably used with a smooth barrel bore. Liner 222 is optionally threaded onto RP 220, wherein liner 222 has threads 225 and RP 220 has corresponding threads 224. Liner is optionally formed of a plastic material such as polycarbonate or a metal material such as copper, aluminum or brass.

FIGS. 3-13, 15-16, 20, and 23-24 show illustrations of different views of a variety of non-limiting embodiments of projectile cartridges, and portions or elements thereof. FIGS. 3-13, 15-16, 20, and 23-24 shows various non-limiting embodiments of projectile cartridge 300A, with certain combinations of embodiments of projectile cartridge 300A annotated with Roman numerals for clarity (300A(I)-300A(IX)). It is noted however, that projectile cartridges disclosed herein can include any combination of embodiments disclosed herein including any combination of embodiments of projectile cartridges 300A(I)-300A(IX) illustrated in FIGS. 3-13, 15-16, 20, and 23-24. It is also noted that some illustrations of projectile cartridges 300A (such as any of 300A(I)-300A(IX)) may exclude certain features simply for clarity and/or because they are represented elsewhere, and so these illustrations should not be construed as necessarily showing all elements or necessarily showing absence of any elements. All projectile cartridges 300A comprise a first cylindrical shell 302A. All projectile cartridges 300A preferably, but not necessarily, comprise any or all of rounded projectile (RP) 200, a wadding 303 or liner 222, propellant 322, and a primer 312. Examples of projectiles cartridges 300A not included RP 200 or wadding 303 include those where the cartridge 300A, RP 200, and wadding 303 are provided separately, such as in the case of a breech-loaded cartridge 300A, optionally including propellant 322 and primer 312, and muzzle-loaded RP 200 with wadding 303. Any projectile cartridge 300A is characterized by a cartridge longitudinal length 300B and projectile cartridge longitudinal axis 301.

As just noted, any cartridge 300A preferably comprises wadding 303 surrounding at least a portion of RP proximal end 201 or at least an entirety of RP proximal end 201. Preferably, wadding 303 physically separates RP outer surface 204 and a surface of first shell 302A. Wadding 303 helps to center RP 200 in the bore lumen 112D when being propelled out of barrel 102.

Figure 3:
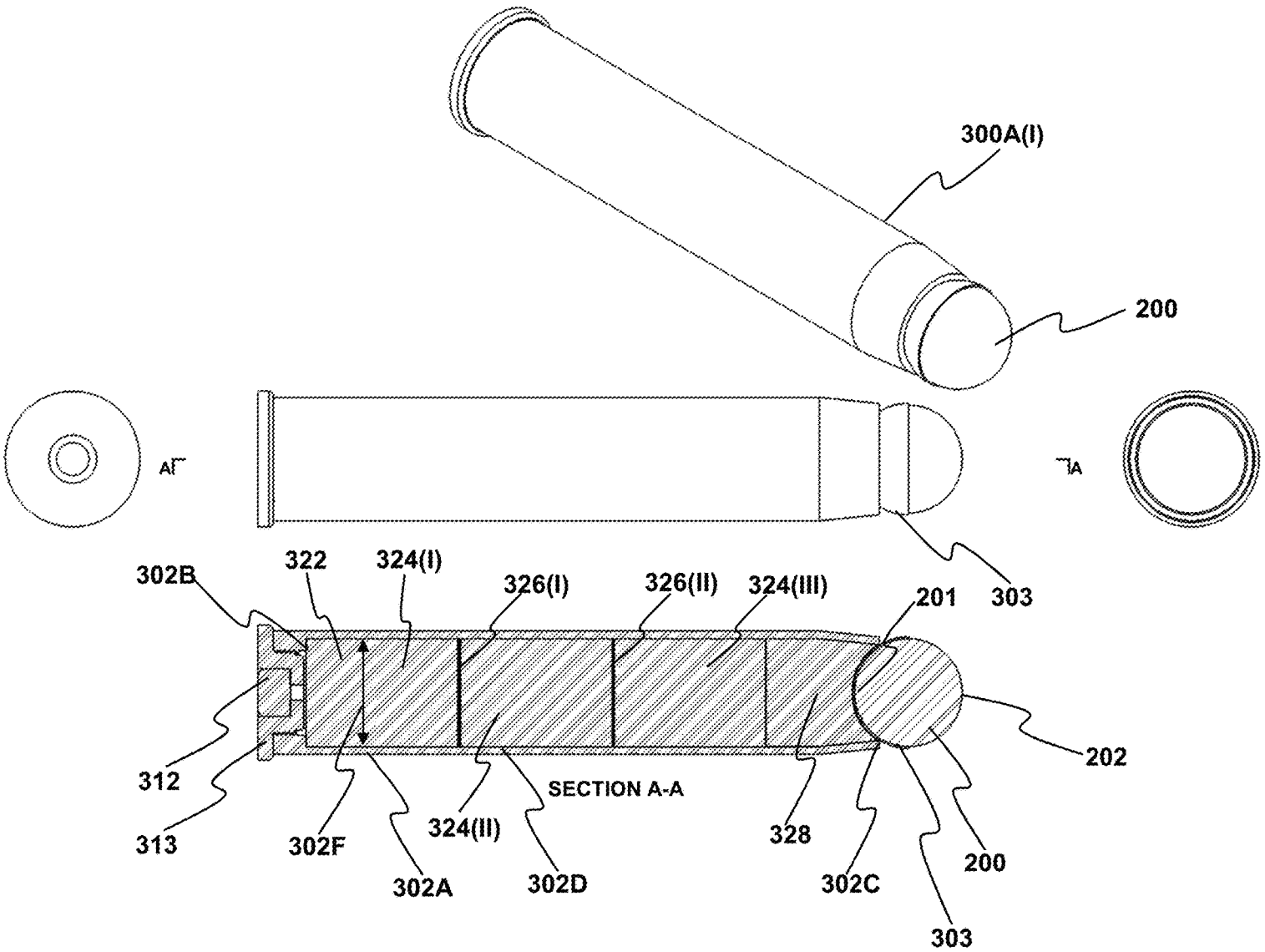
FIG. 3. Illustrations of different perspectives, including a cross-sectional view, of a projectile cartridge, according to certain embodiments, which includes two propellant subregions and a tamp, where the tamp region of the cartridge is configured to be seated at least partially in the forcing cone of the PDD's barrel.
Figure 4:
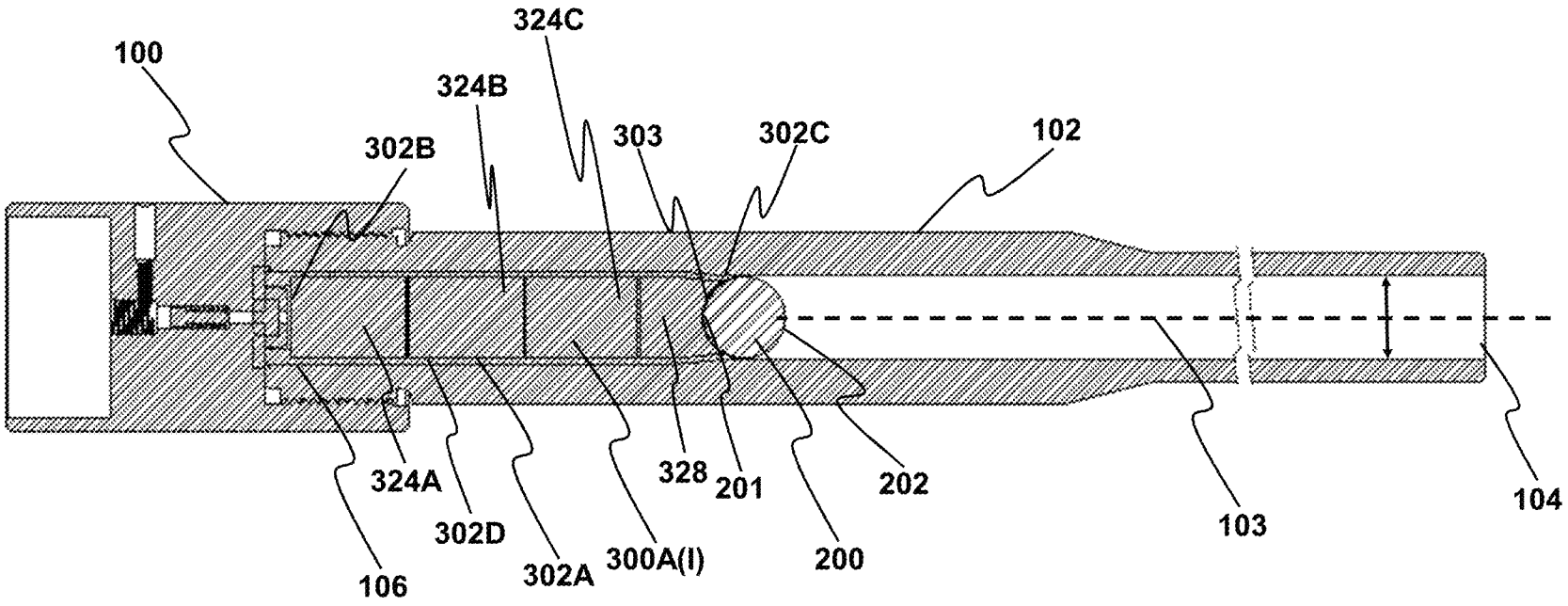
FIG. 4. Cross-sectional illustration of PDD, including a barrel, showing a projectile cartridge, according to certain embodiments, loaded in the barrel. The projectile cartridge shown here has two propellant sub-regions, optionally separated by separators, and a tamp positioned in the forcing cone lumen of the barrel. The forcing cone provides a natural constriction to increase breech pressure. The rounded projectile is positioned at least partially or fully in the barrel's bore lumen.
Figure 5:
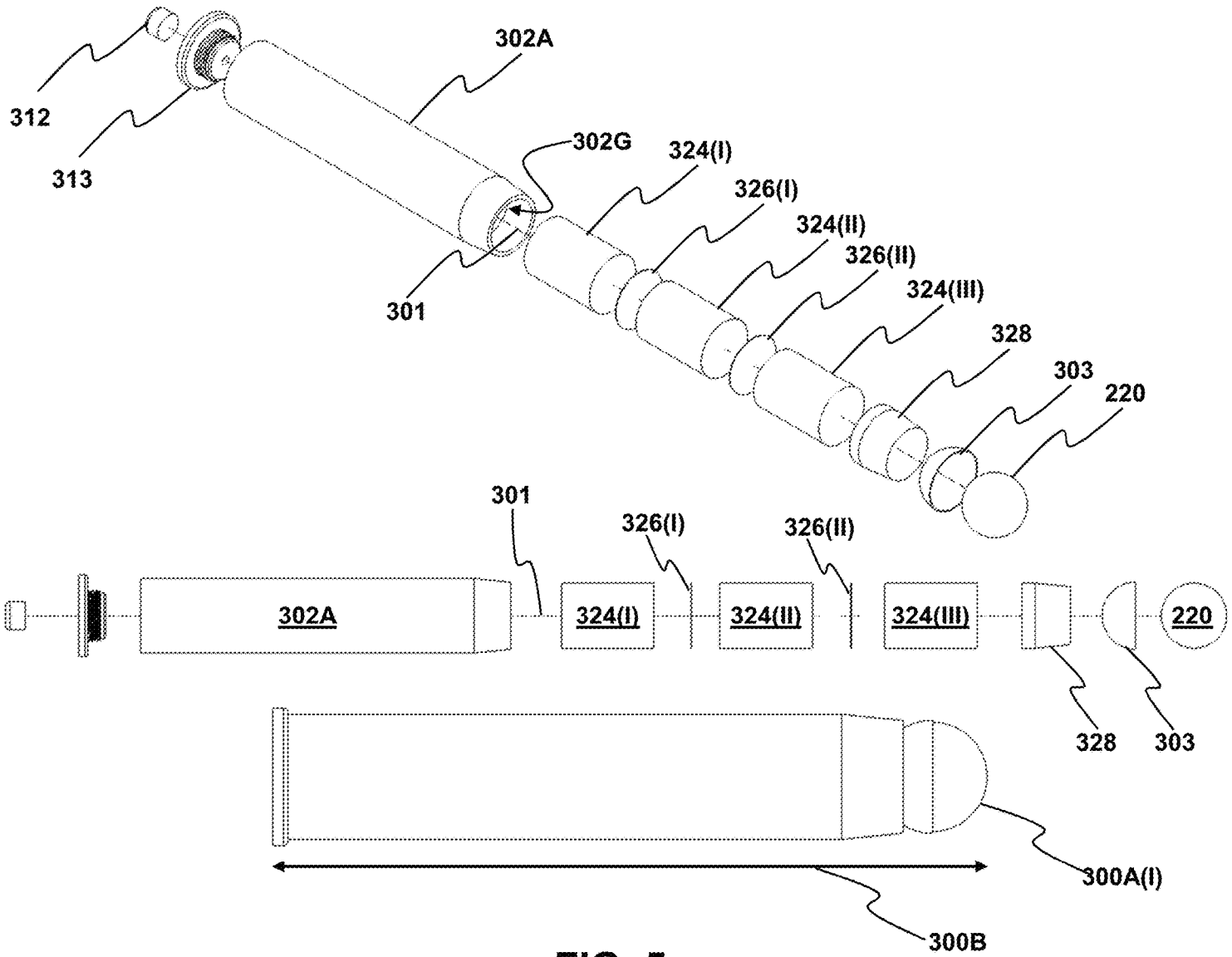
FIG. 5. Illustrations of different perspectives, including exploded views, of a projectile cartridge, according to certain embodiments.
Figure 6:
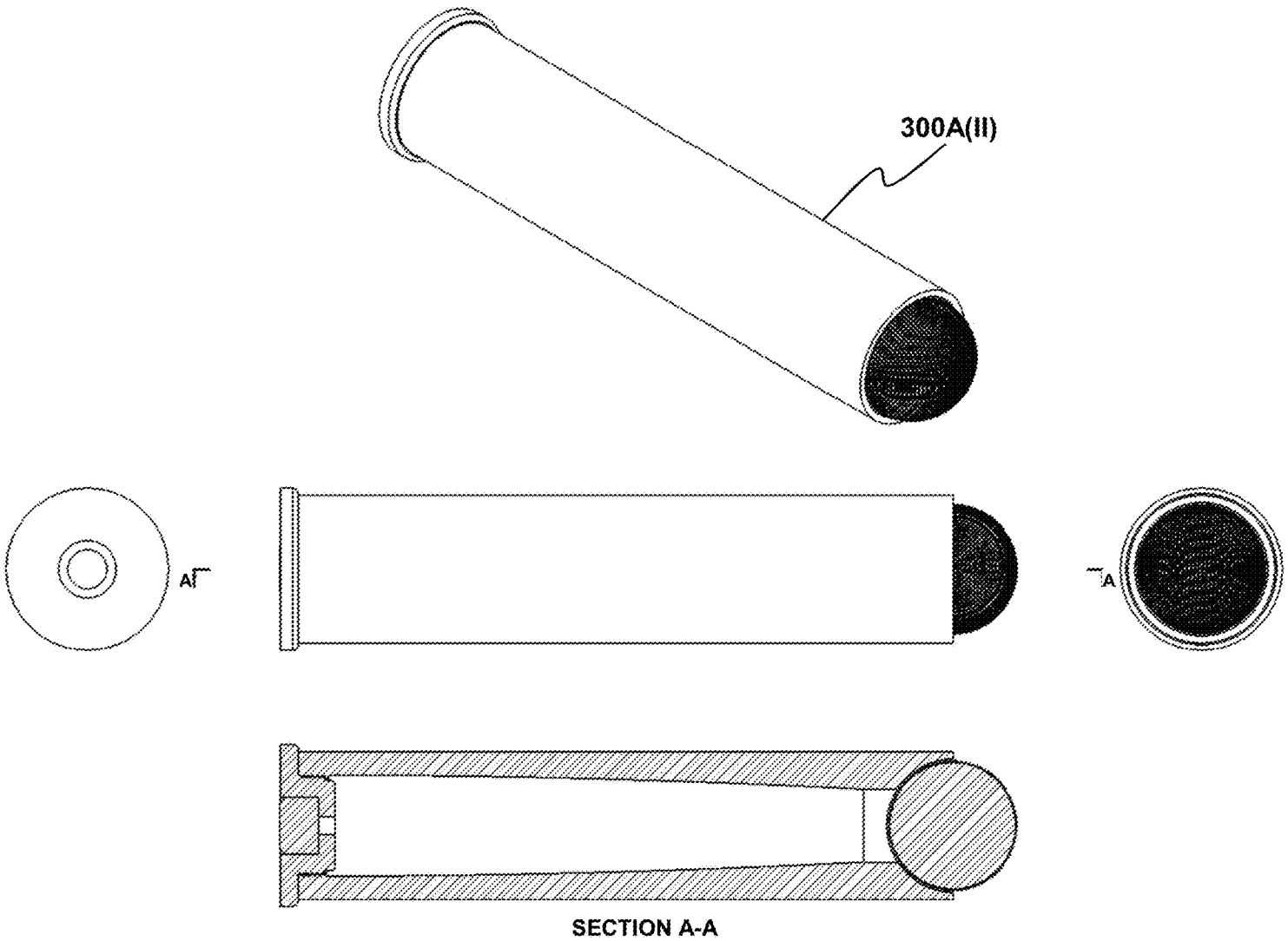
FIG. 6. Illustrations of different perspectives of a projectile cartridge, according to certain embodiments. The first cylindrical shell of this cartridge includes a cavity with curved profile for hosting the rounded projectile. There is a constricting small cylindrical zone, corresponding to the inner lumen of the first cylindrical shell, whose diameter is adjustable to create confinement and produce higher pressures. A constriction zone can be used in straight profile shell volumes as well.

Any first cylindrical shell 302A is characterized by a first shell proximal end 302B, a first shell distal end 302C, a first shell wall 302D, a first shell wall thickness 302E, and a first shell inner diameter 302F. First shell inner diameter 302F and first shell wall 302D define a first shell inner lumen 302G. At least a portion of the inner void volume or lumen 302G of first shell 302A is a propellant region 320A, which is characterized by propellant region diameter 320B. Generally, though not necessarily, propellant region diameter 320B is equivalent or substantially equivalent to first shell inner diameter 302F where the two are co-linear. For example, in a propellant region 320A, propellant region diameter 320B is equivalent or substantially equivalent to first shell inner diameter 302F where the two are co-linear. Thus, preferably, though not necessarily, if first shell inner diameter 302F longitudinally varies/changes in propellant region 320A, then propellant region diameter 320B varies equivalently or substantially equivalently. For example, projectile cartridges 300A(I), 300A(III), 300A(IV), 300A(V), 300A(VII), 300A(VIII), 300A(IX) have a first shell inner diameter 302F that substantially does not have a longitudinal variation at propellant region 320A (or any sub-regions 324 thereof). First shell inner diameter 302F may decrease where approaching first shell distal end, such as seen in FIG. 3, which allows for the first shell distal end to extend into the forcing cone of barrel 102, such that RP 200 is positioned at least partially in the barrel forcing cone lumen 110D, preferably at least partially in the barrel bore lumen 112D, or optionally at least partially in both 110D and 112D, when loaded. For example, projectile cartridges 300A(II) and 300A(VI) have a longitudinally varying first shell inner diameter 302F, and correspondingly a longitudinally varying propellant region diameter 320B. In the case of longitudinal variation thereof, diameters 302F and 320B decrease from first shell proximal end 302B toward first shell distal end 302C. The diameter change can be linear, curved, or any combination of linear and curved. This variation in diameters 302F and 320B forms a confinement zone towards first shell distal end 302C to produce higher gas pressure for propelling RP 200.

Preferably, but not necessarily, the projectile cartridge has a length 300B and geometry (e.g., diameter at distal end) that facilitates positioning the RP 200 is at least partially in the barrel forcing cone lumen 110D, preferably at least partially in the barrel bore lumen 112D, or optionally at least partially in both 110D and 112D, when loaded. Conventionally, and optionally herein, a conventional projectile cartridge is loaded in the chamber such that the projectile is also fully positioned in the chamber lumen 108D, and not in forcing cone lumen 110D, let alone not in bore lumen 112D.

Propellant region 320A optionally comprises two or more propellant sub-regions 324. Propellant sub-regions 324 are optionally separated by a separator 326, which may be formed of a moisture-repellant material, such as a wax and/or silicone impregnated paper. Propellant sub-regions 324 are not necessarily separated by a separator 326. For example, a propellant region 320A can have propellant sub-regions 324(I) and 324(II) are adjacent and in physical contact with each other at their interface, where the sub-regions are differentiated from each other by the composition of propellant 322 in the respective sub-regions. Preferably, a propellant sub-region closer to the first shell proximal end 302B comprises a propellant 322 or mixture of material comprising propellant 322 having a higher characteristic burn rate compared to a propellant sub-region that is closer to the first shell distal end 302C. Any propellant 322 can be layered (thereby optionally forming propellant sub-regions) in propellant region 320A. Any propellant 322 can comprise an additive and/or a mixture of propellants to achieve a desired characteristic burn rate or other propellant characteristic. For example, optionally, a propellant 322 can be a mixture of propellant grains and non-propellant additive powder that together form a propellant mixture 322 that has a lower characteristic burn rate than the propellant grains alone.

Projectile cartridge 300A optionally includes a tamp 328, such as cartridge 300A(I) shown in FIG. 3. Tamp 328 is positioned between RP 200 and propellant region 320A. Tamp 328 is optionally formed of fine clay dust, sand, clay and/or sand impregnated with silicone, and/or a closed cell foam. Tamp 328 can facilitate a desired build-up of gas pressure (from ignited propellant) before RP 200 is released/propelled our of cartridge 300A, such as to maximize burn rate of the propellant and increase the resulting velocity of RP 200. The foam tamp also can reduce the shocking of the projectile that can compromise its integrity.

Figure 7:
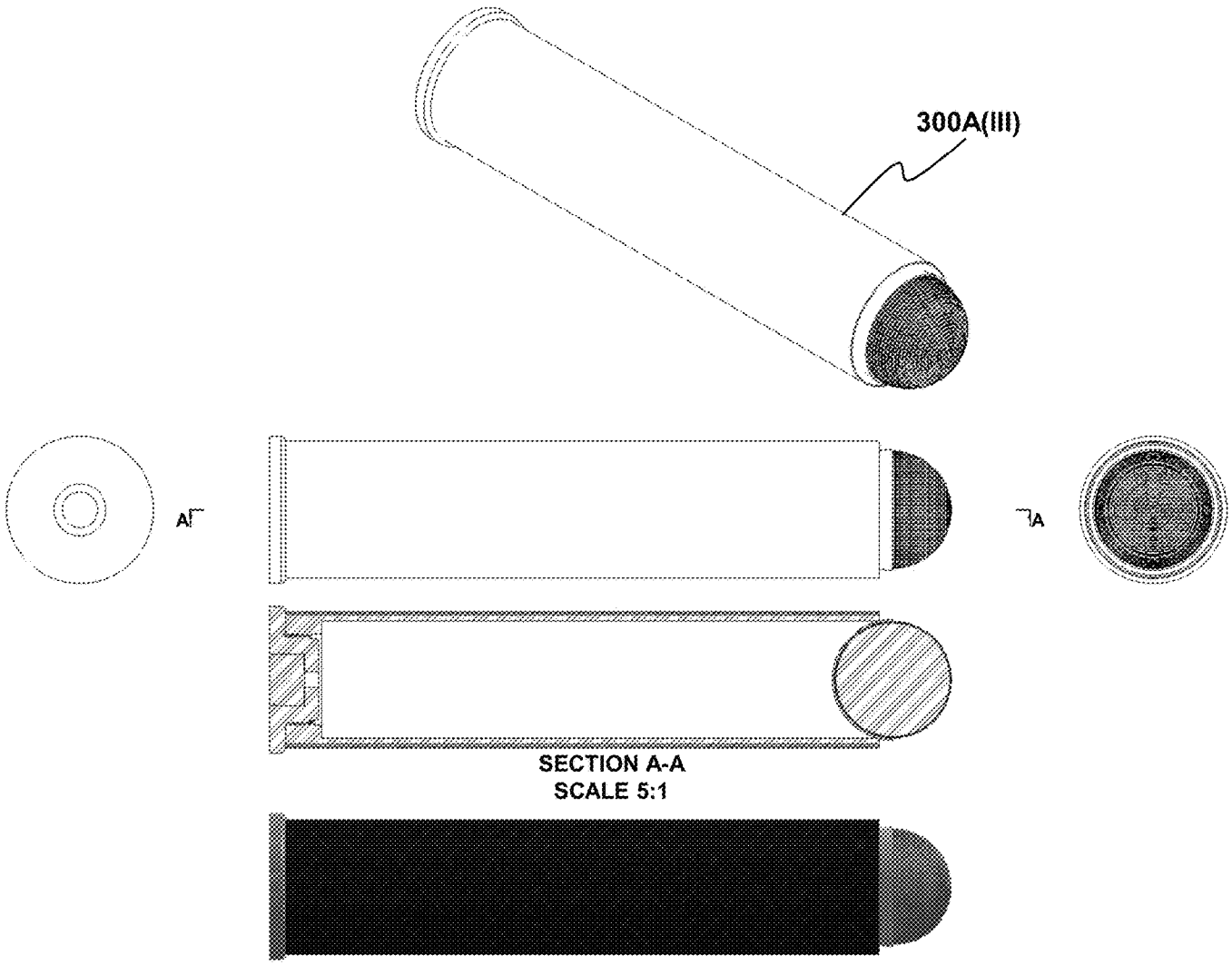
FIG. 7. Illustrations of different perspectives of a projectile cartridge, according to certain embodiments. The projectile cartridge includes a coating or outer layer or liner to prevent galling, such as an anodized layer, a lubricant, paint, or carbon fiber reinforced polymer.
Figure 8:
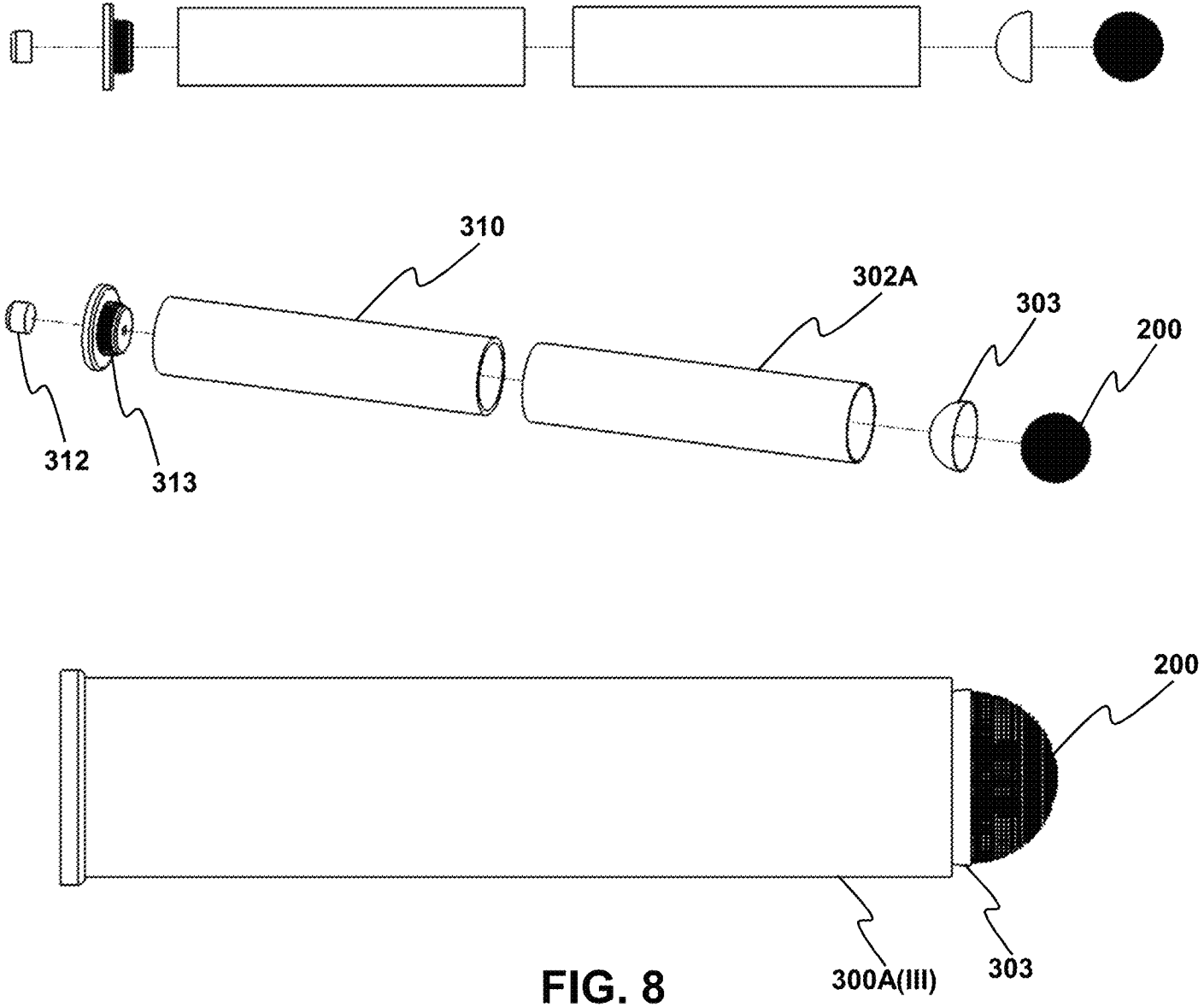
FIG. 8. Illustrations of different perspectives, including exploded views, of a projectile cartridge, according to certain embodiments, that includes a cartridge outer layer.

Optionally, projectile cartridge 300A includes a cartridge outer layer 310, such as cartridge 300(III) of FIGS. 7-8. Outer layer 310 is optionally included for the purpose of being a non-galling layer to prevent galling in the chamber lumen 108D. Cartridge outer layer 310 can be a coating, a shell, and/or an outer layer of first shell 302A. Cartridge out layer 310 can be an anodized layer, a lubricant, a paint, copper, brass, and/or a carbon fiber reinforced polymer, for example.

Figure 9:
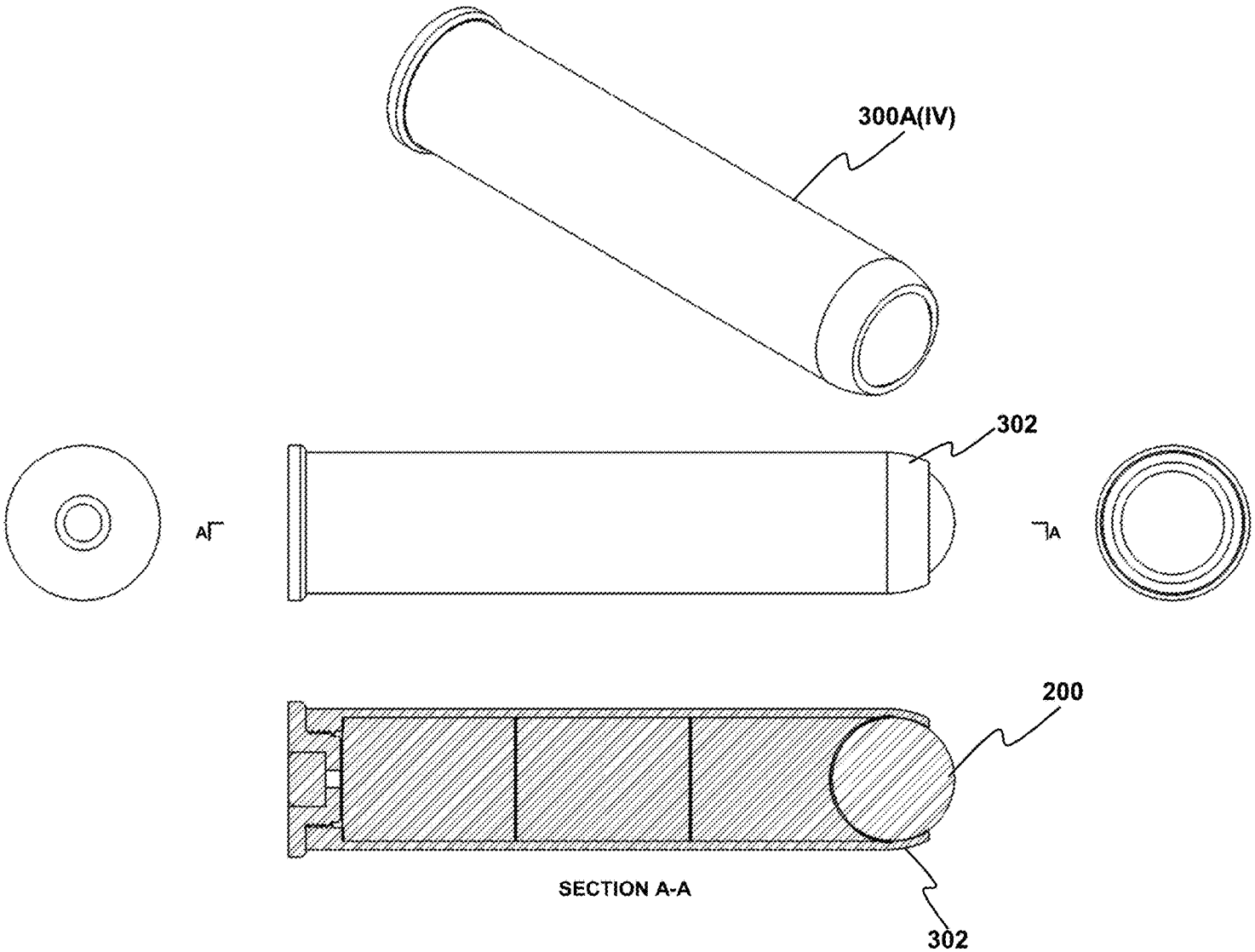
FIG. 9. Illustrations of different perspectives, including a cross-sectional view, of a projectile cartridge, according to certain embodiments. The first cylindrical shell of this cartridge include a crimp at the distal end to trap the rounded projectile until it is propelled out and create resistance. The crimp fails at critical pressure and uncorks the rounded projectile. This produces increased burn rate. The shown projectile cartridge include two different layers, or subregions, of propellant and a tamp, being a layer of fine clay dust or sand impregnated with silicone or closed cell foam plug, which is adjacent to the wadding that surrounds the proximal portion of the rounded projectile and the tamp provides reduced shell volume and inertial confinement.
Figure 10:
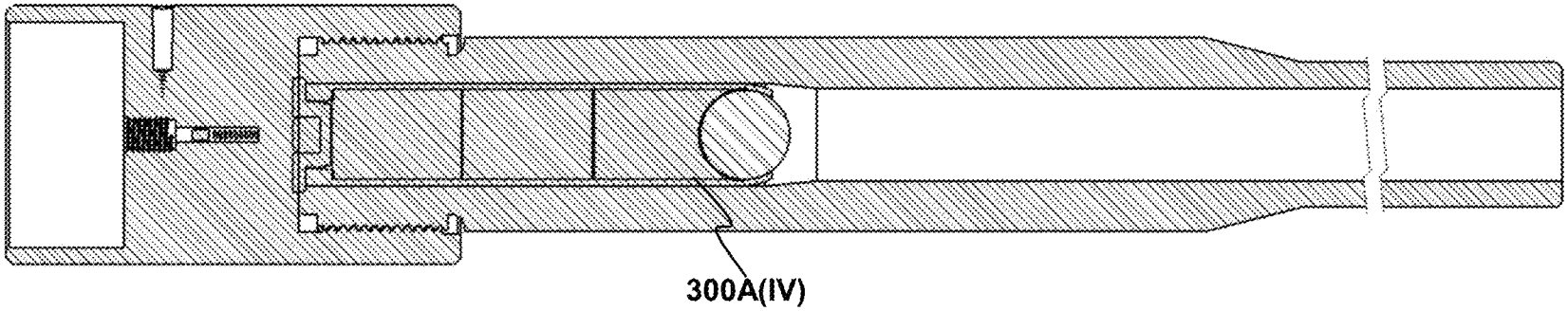
FIG. 10. Cross-sectional illustration of PDD, including a barrel, showing a projectile cartridge of FIG. 9, according to certain embodiments, loaded in the barrel.
Figure 11:
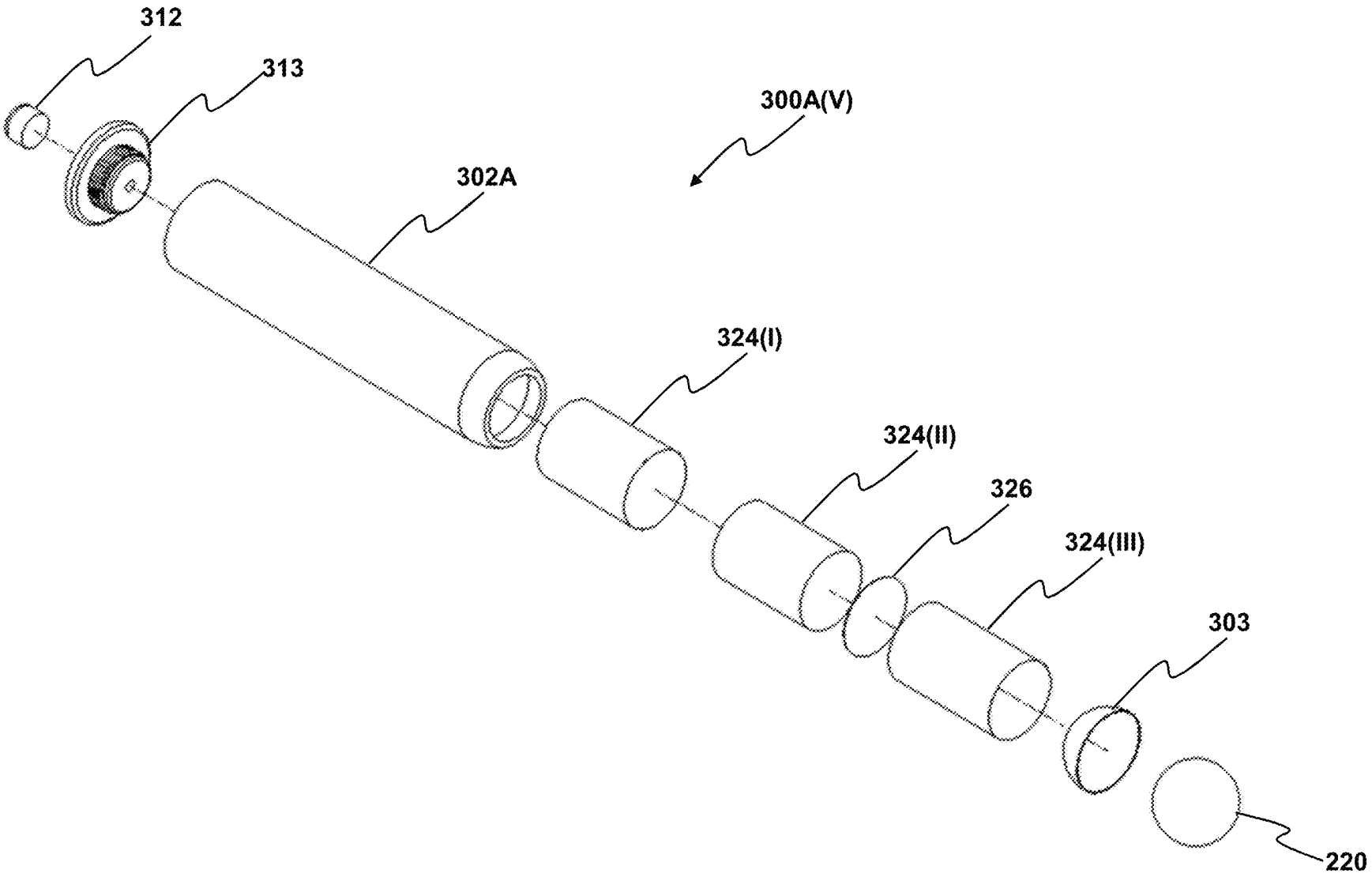
FIG. 11. An illustration of an exploded view of a projectile cartridge, according to certain embodiments, such as the projectile cartridge of FIG. 9. The projectile cartridge includes a separator, formed of a thin wax or silicone impregnated paper between a propellant sub-region and the tamp. The tamp can be high density closed cell foam or silicone coated clay or sand tamp. The cotton wadding covers the back half of the rounded projectile.
Figure 12:
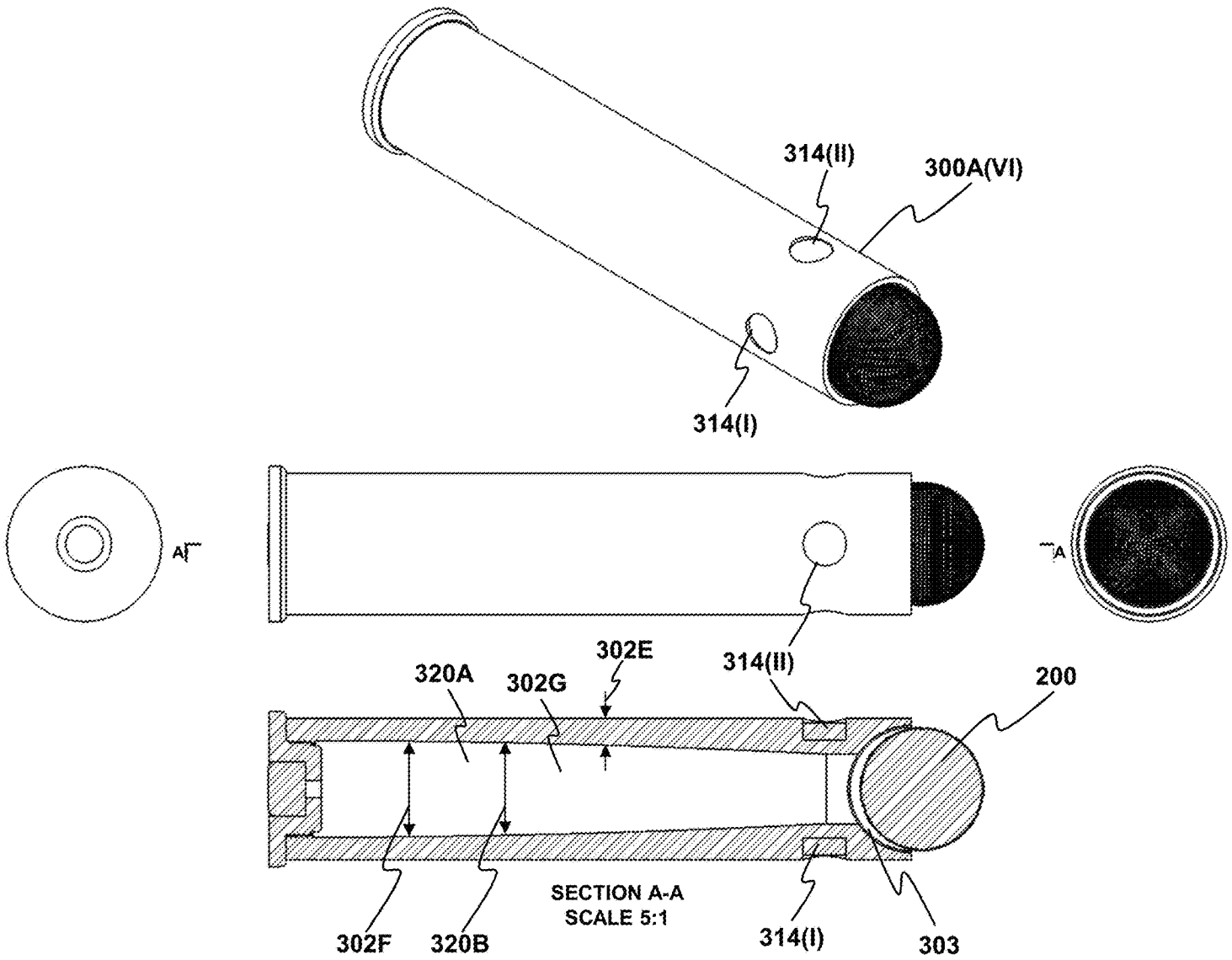
FIG. 12. Illustrations of different perspectives, including a cross-sectional view, of a projectile cartridge, according to certain embodiments. The projectile cartridge includes a curved profile with respect to the longitudinally varying inner diameter of the first shell lumen. This projectile cartridge includes magnets for trapping the rounded projectile, which comprises a magnetic material. In other embodiments, an alternative to having magnets including in the first cylindrical shell wall, the first shell wall can be formed of a magnetized material, such as a magnetized steel.
Figure 13:
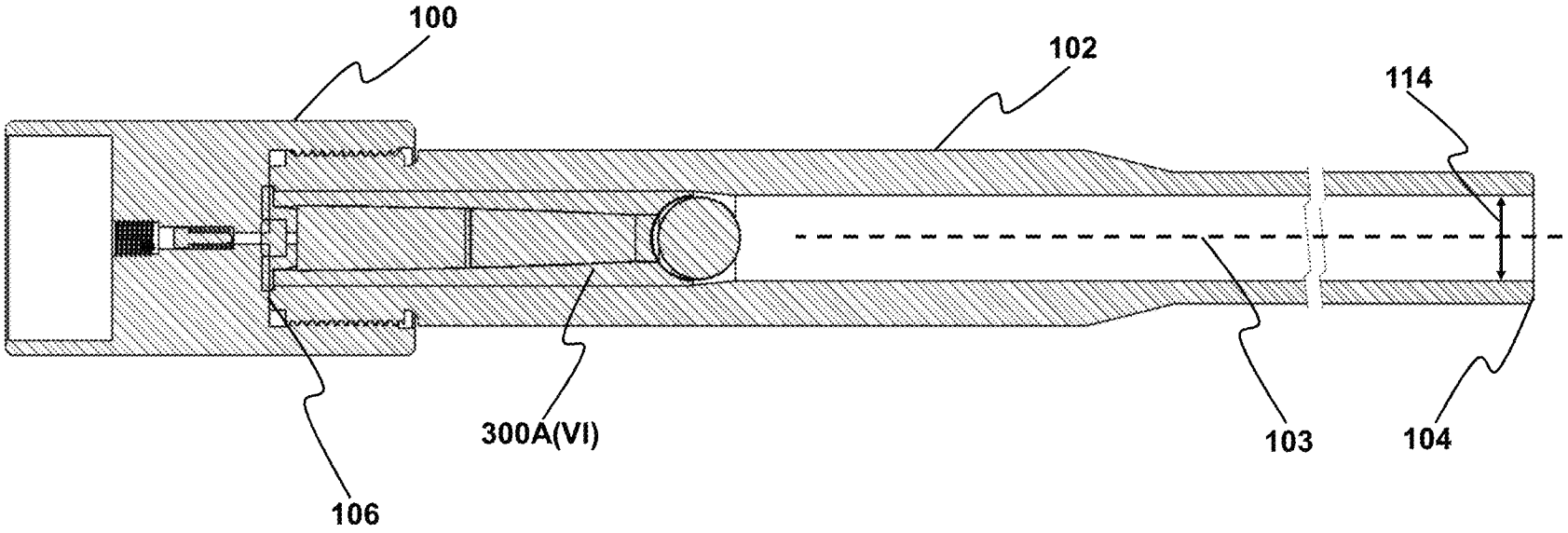
FIG. 13. Cross-sectional illustration of a PDD, including a barrel, showing a projectile cartridge, according to certain embodiments, loaded in the barrel. The projectile cartridge includes a curved profile with respect to the longitudinally varying inner diameter of the first shell lumen. This projectile cartridge includes magnets for trapping the rounded projectile, which comprises a magnetic material. In other embodiments, an alternative to having magnets including in the first cylindrical shell wall, the first shell wall can be formed of a magnetized material, such as a magnetized steel. The projectile cartridge includes a paper spacer comprising a water repellant material, and a high density closed cell foam or silicone coated fine sand or fine clay dust adjacent to cotton wadding as a tamp. The rounded projectile is positioned in the barrel's forcing cone.

Optionally, first shell distal end 302C is configured to include a crimp 305, where crimp 305 covers (directly or indirectly) at least a portion of RP 200. Preferably, wadding 303 is used even in the case of cartridge 300A comprising crimp 305. For example, projectile cartridge 300A(IV), shown in FIGS. 9-10, includes crimp 305. Crimp 305 covers (directly or indirectly) covers or extends over (with or without physical contact) a portion of RP distal end 202, as shown in FIGS. 9-10, for example. Crimp 305 traps RP 200 in first shell 302A until RP 200 is propelled out. Furthermore, crimp 305 is characterized by a critical failure pressure (formed by ignited propellant), at which crimp 305 fails and open or un-corks to release RP 200. The resistance provided by crimp 305 against release of RP 200 from first shell 302A allows gas pressure to build up until the selected critical pressure, which helps to increase the velocity of RP 200 when propelled.

Figure 14:
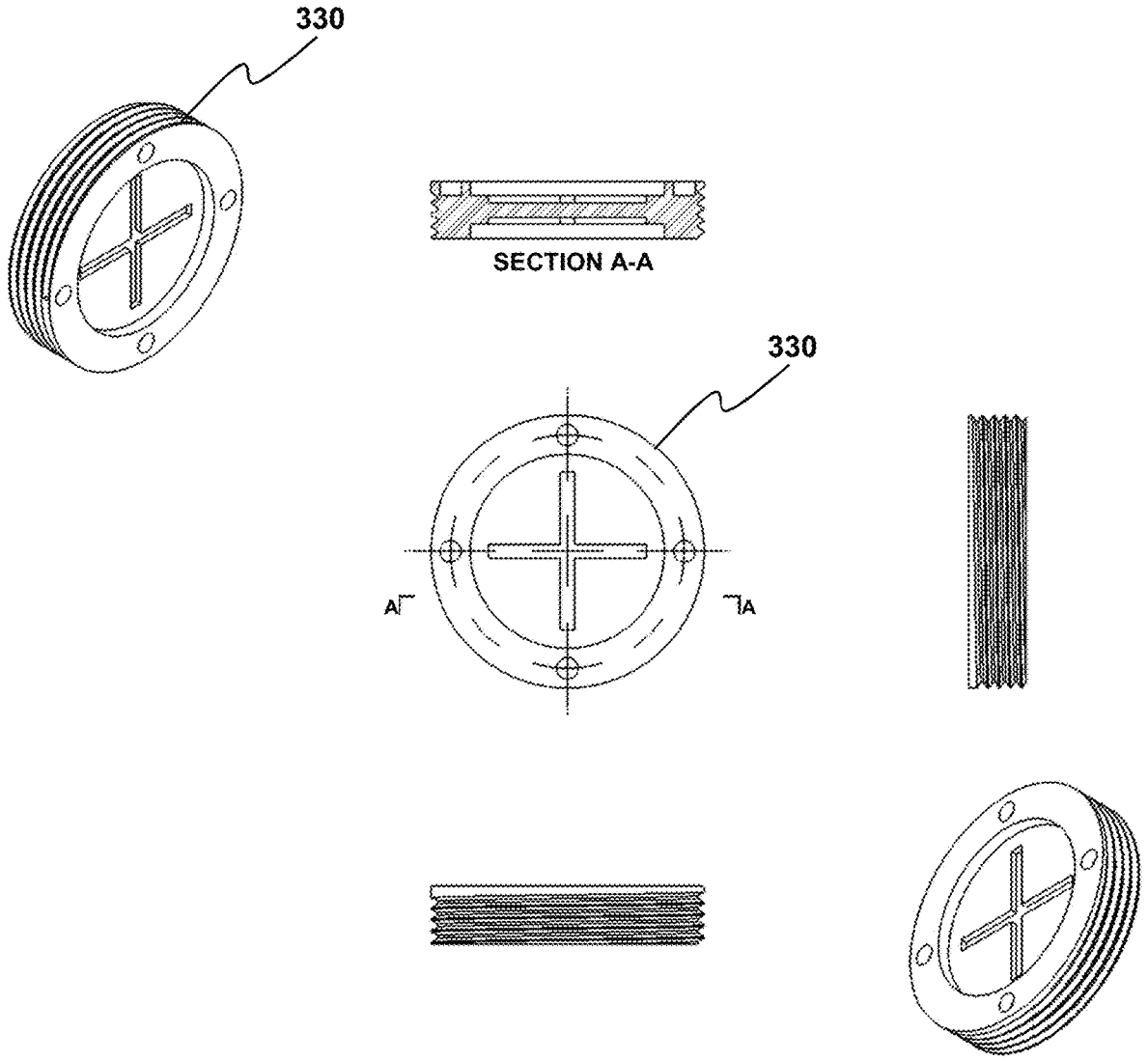
FIG. 14. Illustrations of different perspectives, including a cross-sectional view, of a rupture disk, according to certain embodiments. A rupture disk can be inserted in shell as method to increase shell pressure and uncorking effect to maximize burn rate of smokeless powder when a rounded projectile (RP), such as one formed of titanium, is used. For example, a rupture disk may be used instead of a crimp and fillers to confine powders. The disk is scored in a cruciform shape to promote failure and cause the disk to petal.
Figure 15:
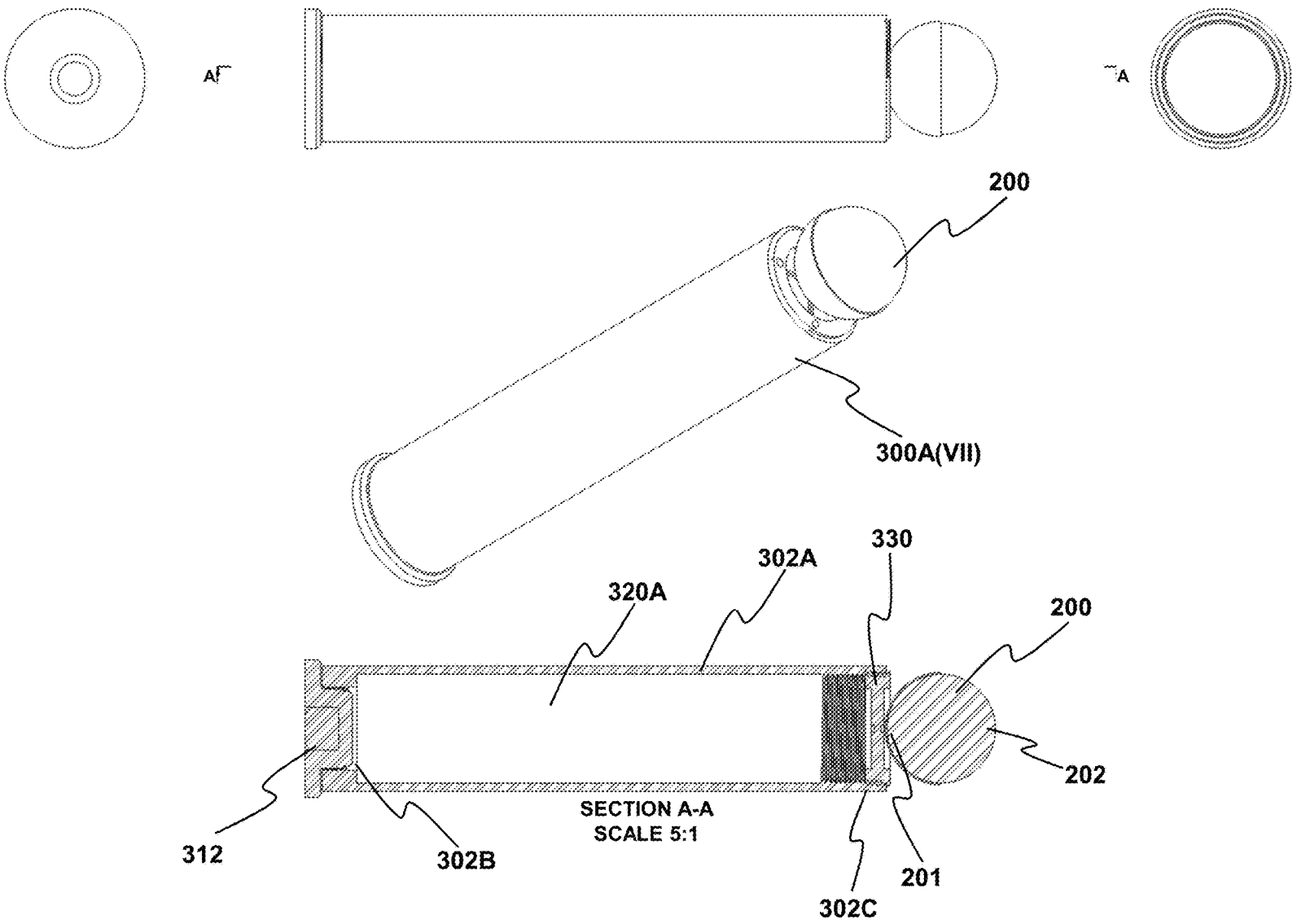
FIG. 15. Illustrations of different perspectives, including a cross-sectional view, of a projectile cartridge, according to certain embodiments. The projectile cartridge includes a rupture disk adjacent to a rounded projectile (RP), which can be positioned in the forcing cone lumen when loaded. A propellant and tamp are not shown but may be used.
Figure 16:
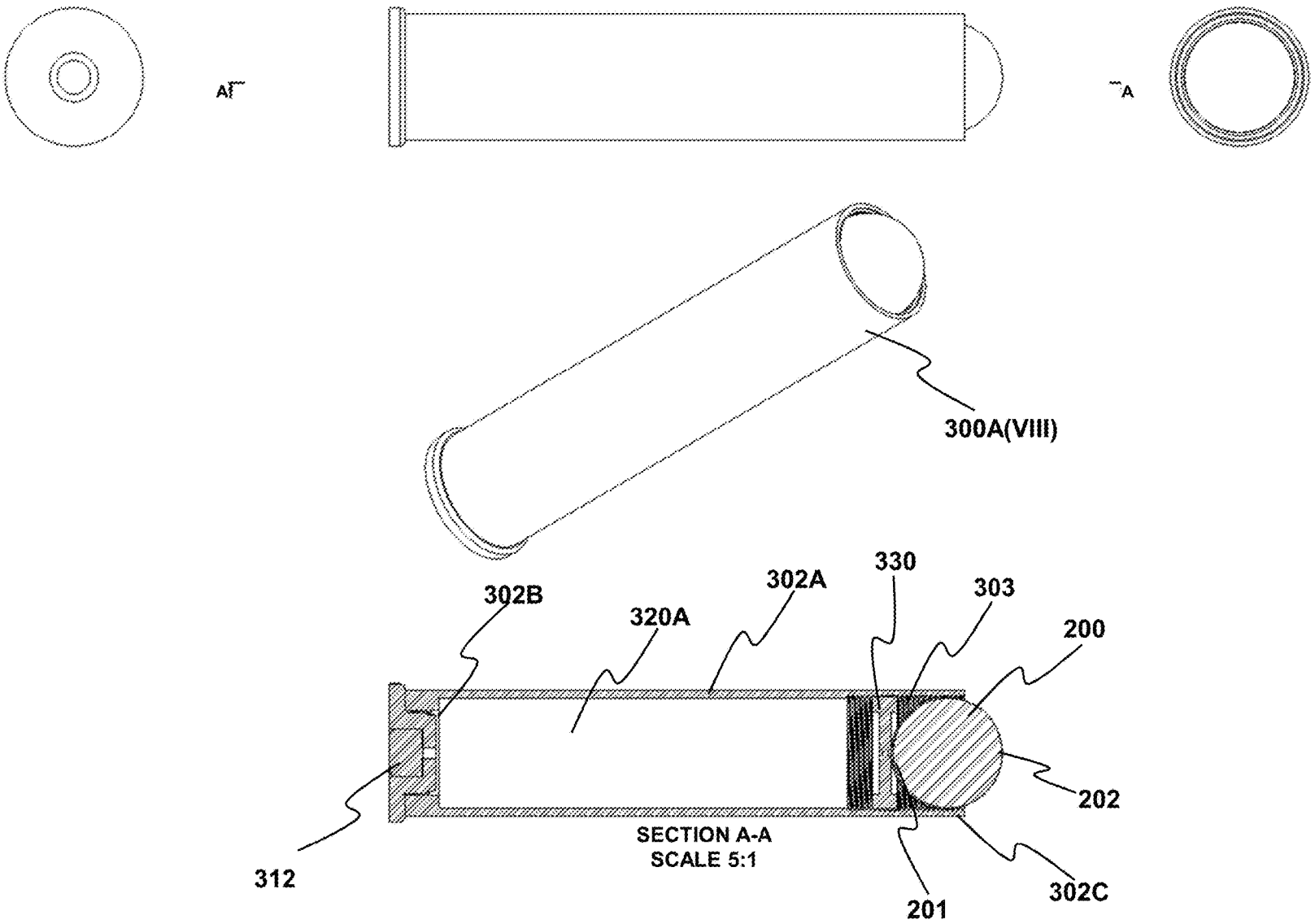
FIG. 16. Illustrations of different perspectives, including a cross-sectional view, of a projectile cartridge, according to certain embodiments. The projectile cartridge includes a rupture disk adjacent to a rounded projectile (RP), both of which are in the first cylindrical shell lumen.
Figure 17:
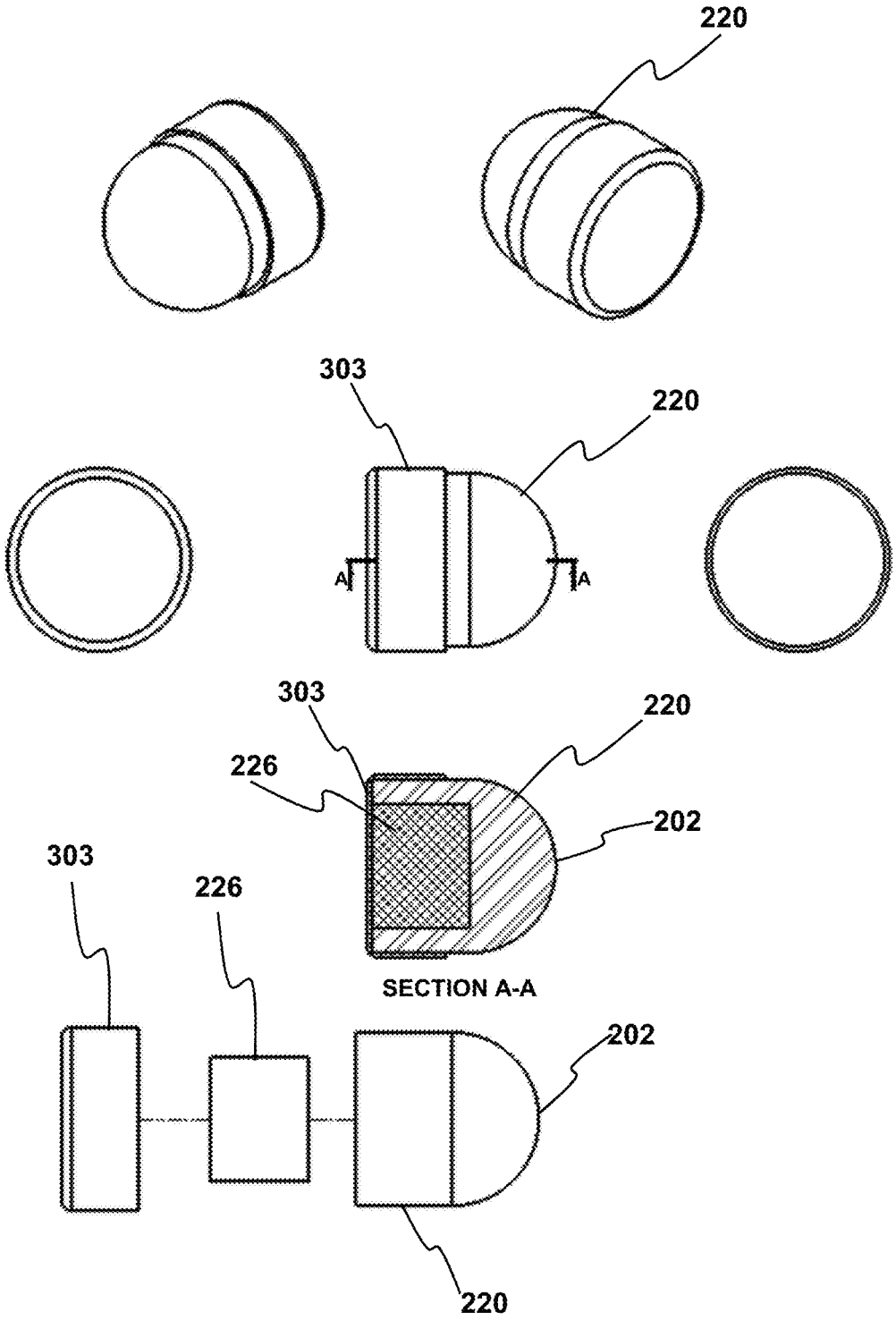
FIG. 17. Illustrations of different perspectives, including a cross-sectional view, of a rounded projectile having a half-capsule geometry, according to certain embodiments. The rounded projectile having the half-capsule geometry includes a cotton wadding for use with a smooth bore disrupter. The rounded projectile can be inserted in a shell of a cartridge. The straight or curved profile and crimp are compatible with this rounded projectile. A low density plastic filler or carbon fiber reinforced polymer is inserted in the back of the projectile. Knurled or tumbled/brushed surface can be used.

Projectile cartridge 300A optionally comprises a rupture disk 330. Alternatively, rupture disk can be muzzle loaded, rather than included as part of cartridge 300A, in the case of muzzle loading wadding 303 and RP 200. FIG. 14 shows various views of rupture disk 330 and FIGS. 15-16 show different configurations of projectile cartridge 300A and rupture disk 330. Rupture disk 330 facilitates an increase shell gas pressure (after ignition of propellant) and un-corking effect to maximize burn rate of propellant 322 and maximize RP velocity. This may be beneficial, for example, in the case of a titanium RP 200. Use of rupture disk 330 is optionally an alternative to use of a crimp and/or fillers or tamp 328 to confine propellant 322. Rupture disk 330 is scored, optionally in a cruciform geometry, to promote failure and rupture of the disk at a critical failure pressure. Rupture disk 330 is positioned between propellant 322 and RP 200. Rupture disk may be provided as part of cartridge 300A(VII) or inserted into first shell 302A separately. Rupture disk 330 may include threads, and first shell 302A may optionally include corresponding threads at its distal end, to facilitate screwing or threading rupture disk 330 into first shell 302A. RP 200 is optionally muzzle loaded, such as in the case of FIG. 15, or provided with cartridge 300A that has rupture disk 330, as shown in FIG. 16.

Figure 24:
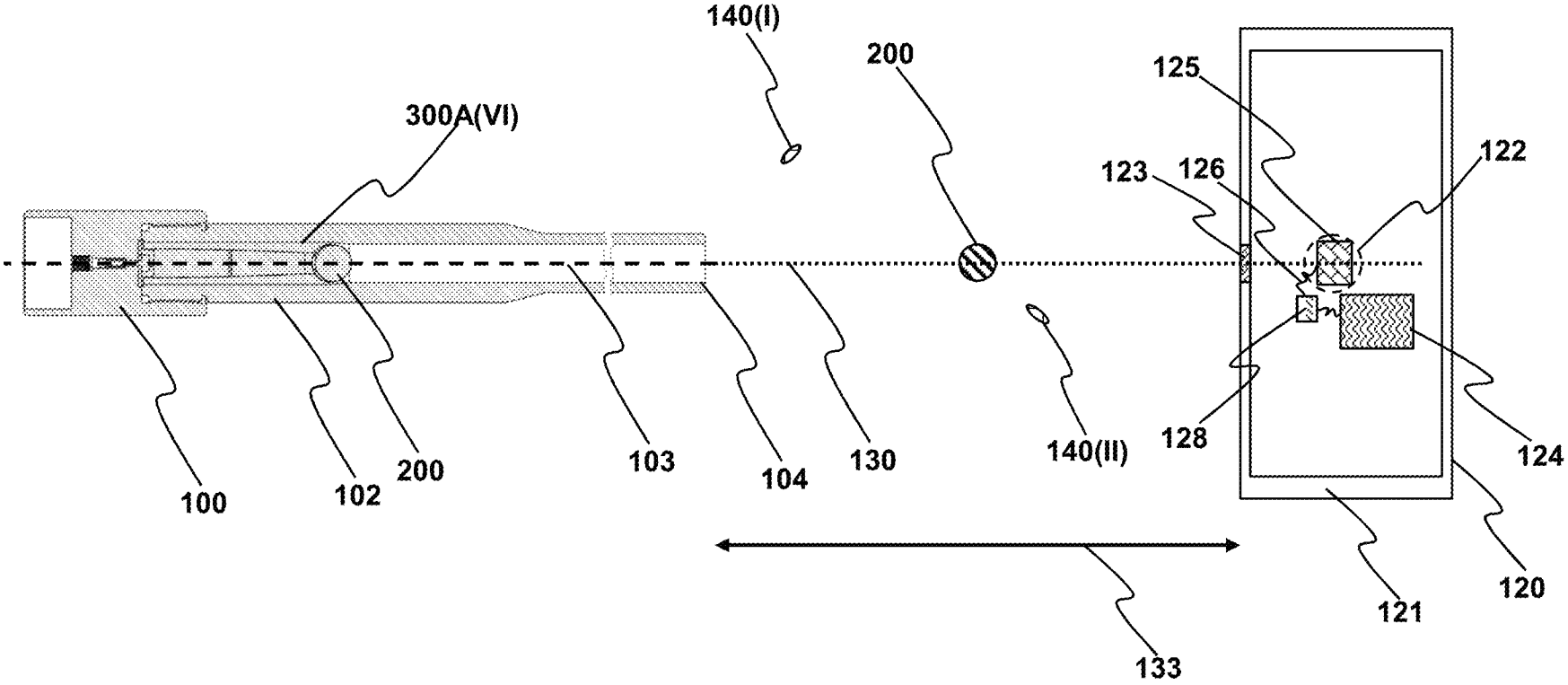
FIG. 24. Illustration of a rounded projectile propelled from a barrel toward an explosive device.

FIG. 24 illustrates use of RP 200, optionally with projectile cartridge 300A, to disrupt an explosive device 120. Explosive device 120 includes a barrier layer 121 and an explosive material 124. Optionally, explosive device 120 includes a power source 125, conductors, initiator, and a switch 128, and/or one or more electrical connections 126 therebetween. Preferably, RP 200 disrupts or disables power source 125, switch 128, and/or connection(s) 126 without detonating/initiating explosive material 124. Barrel 102 is first loaded with RP 200 and wadding 303, either via muzzle loading, breech loading, or optionally loaded via loading projectile cartridge 300A. PDD 100, or barrel 102 thereof, is aimed at a target portion 122 of explosive device 120, wherein the barrel muzzle end 104 and the explosive device are separated by stand-off distance 133. Target portion 122 may be, for example, the power source 125, and/or switch 128, and/or one or more electrical connections 126. The propellant is then ignited and RP 200 is propelled out of barrel muzzle end 104. Propelled RP 200 travels along linear trajectory 130, which is co-linear with barrel longitudinal axis 103 if barrel longitudinal axis 103 were visually extended between muzzle end 104 and target portion 122. Propelled RP 200 travels along linear trajectory 130 between muzzle end 104 and target portion 122, which preferably includes traversing a penetration distance through explosive device 120 along the same linear trajectory 130. Propelled RP 200 impacts with barrier portion 123 of explosive device 123. Barrier portion 123 is a portion of a barrier layer 121 of explosive device 120, where the barrier layer protects internal components of explosive device 120. During impact of RP 200 with barrier portion 123, at least a portion of barrier portion 123 preferably solid state welds or bonds to RP distal end 202 thereby forming composite projectile 210. Composite projectile 210 proceeds to traverse through explosive device 120 still following trajectory 130 for a penetration distance 131 until hitting target portion 122 to disrupt explosive device 120. FIG. 24 shows secondary projectiles 140(I) and 140(II) which are optional and are most preferably not formed, not propelled, or otherwise non-existent. Preferably, there is no secondary projectile 140(II) propelled ahead of RP 200 (i.e., no secondary projectile generally between RP distal end 202 and explosive device 120). Generally, the term secondary projectile refers to a physical element propelled (directly or indirectly via energy from ignited propellant 322) toward explosive device 120.

Figure 2:
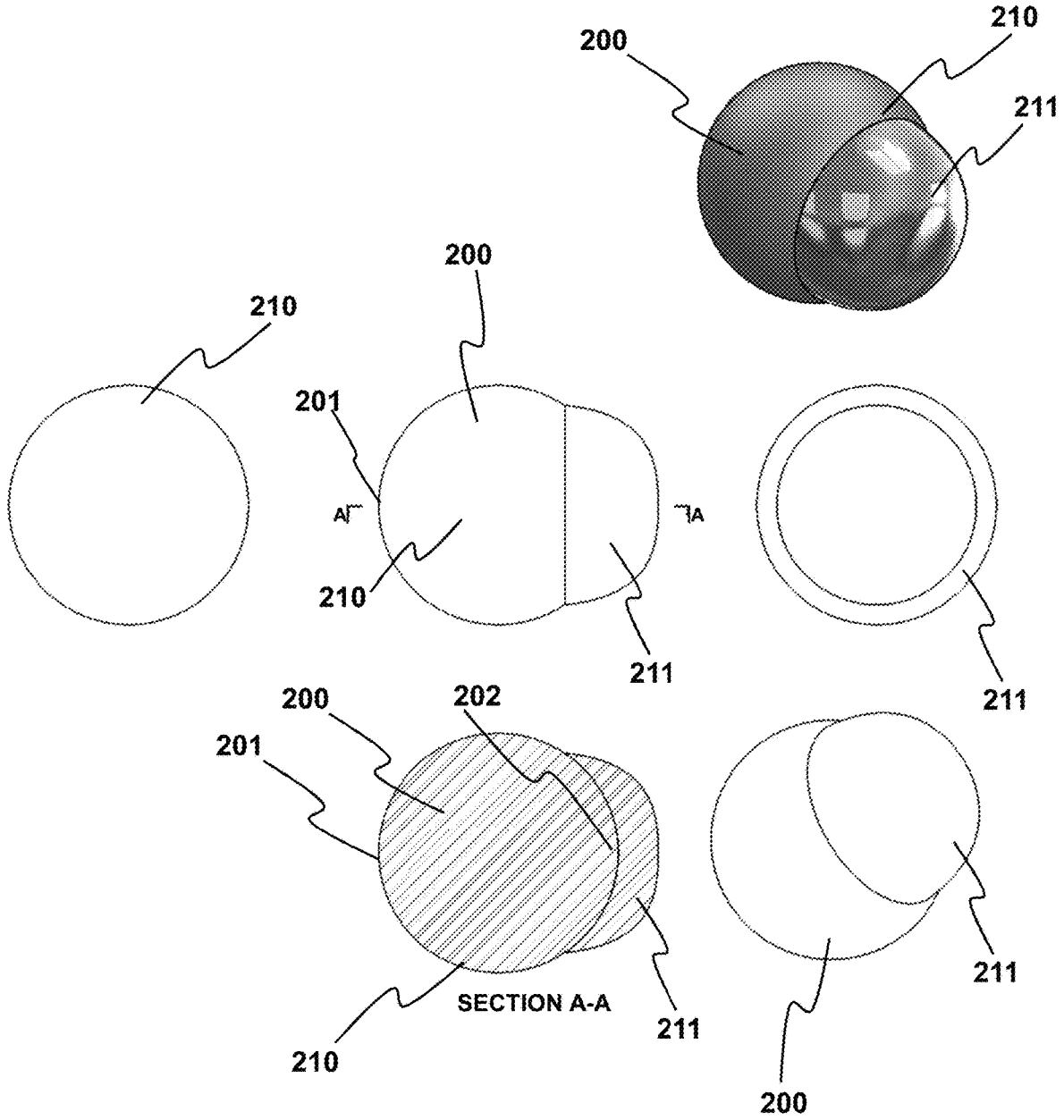
FIG. 2. Illustrations of different perspectives, including cross-sectional views, of a composite projectile, according to certain embodiments, which includes a rounded projectile bonded or welded to a barrier portion.
Figure 22:
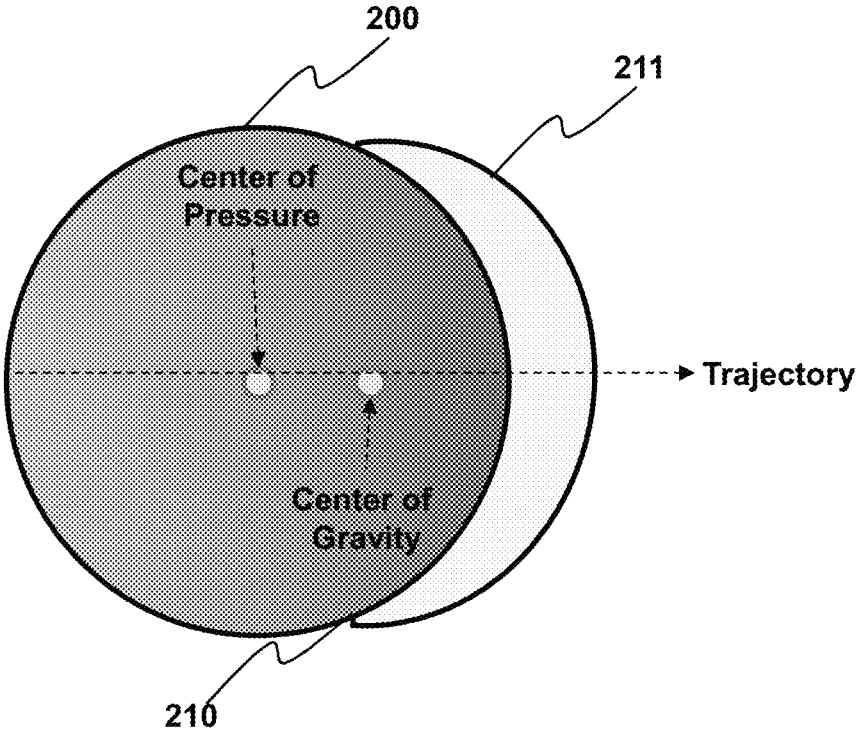
FIG. 22. Illustration of a composite projectile.
Figure 23:
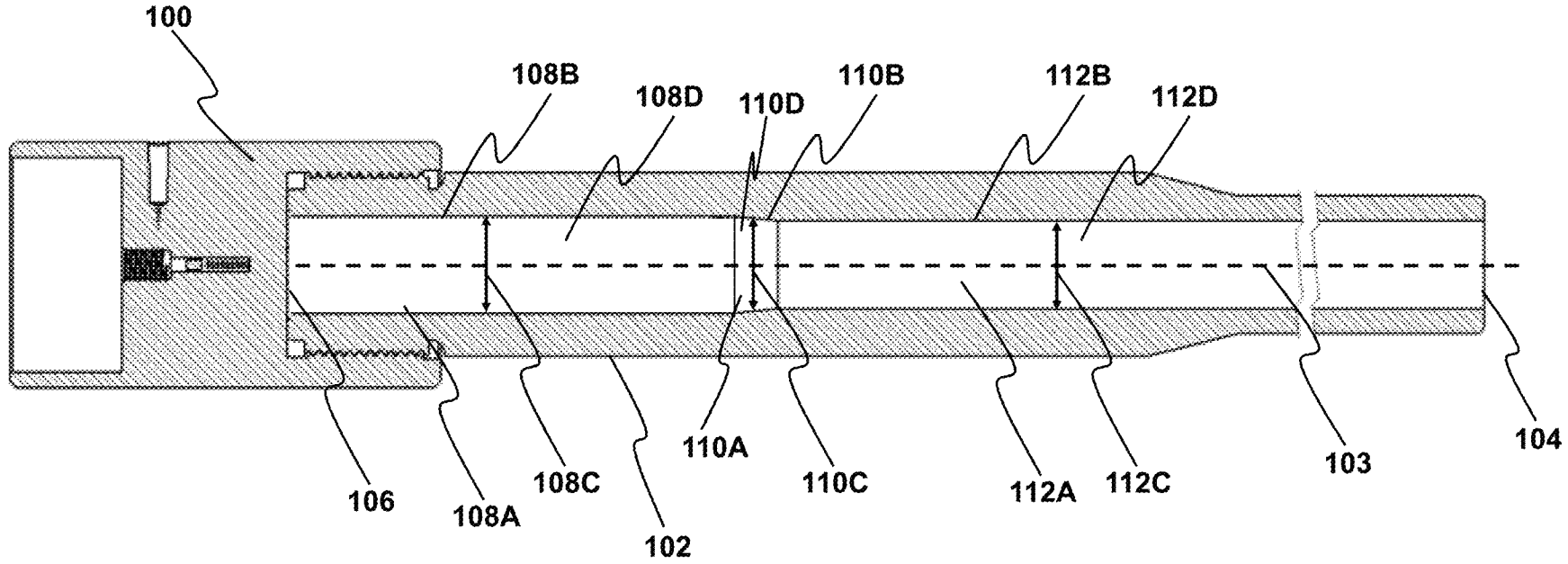
FIG. 23. Illustration of a cross-sectional view of a PDD with a barrel having a forcing cone, according to certain embodiments.
Figure 25A:
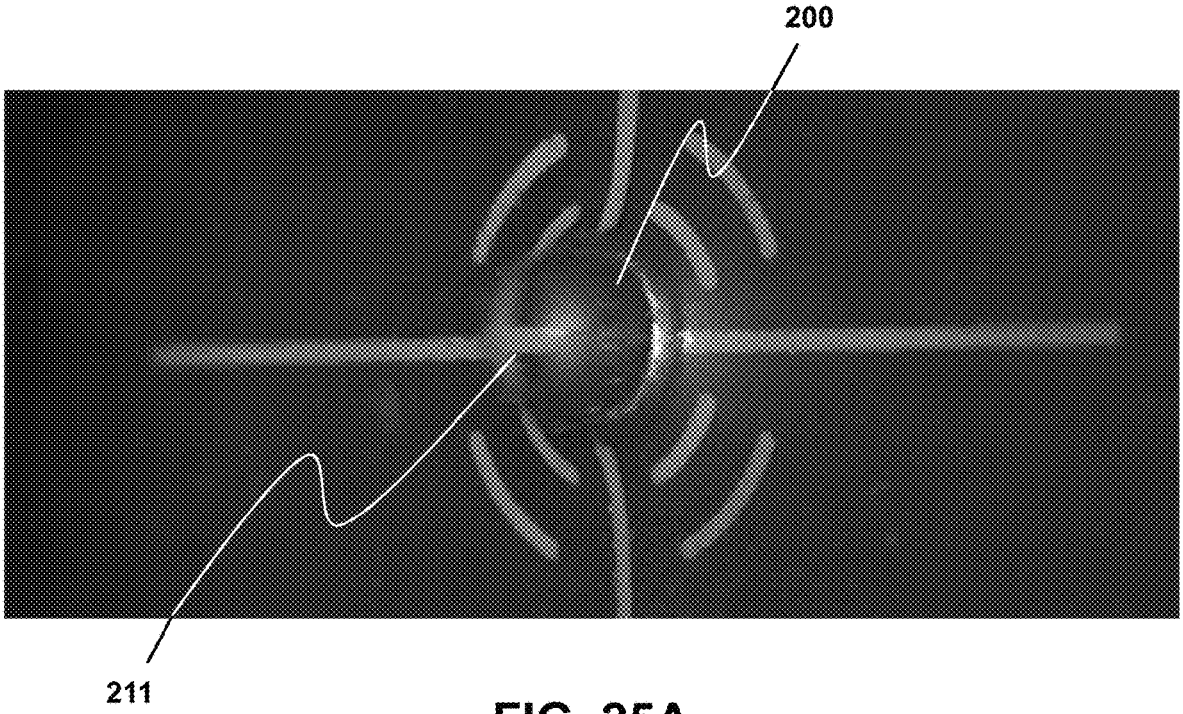
FIGS. 25A-25B. Frames from a video showing an RP impacting with a steel barrier (FIG. 25A) and forming a composite projectile (FIG. 25B) that exits the steel barrier and continues along the longitudinal direction, as indicated by the cross-hair on the barrier surface that is transferred in a tight bond configuration onto the distal end surface of the RP.
Figure 25B:
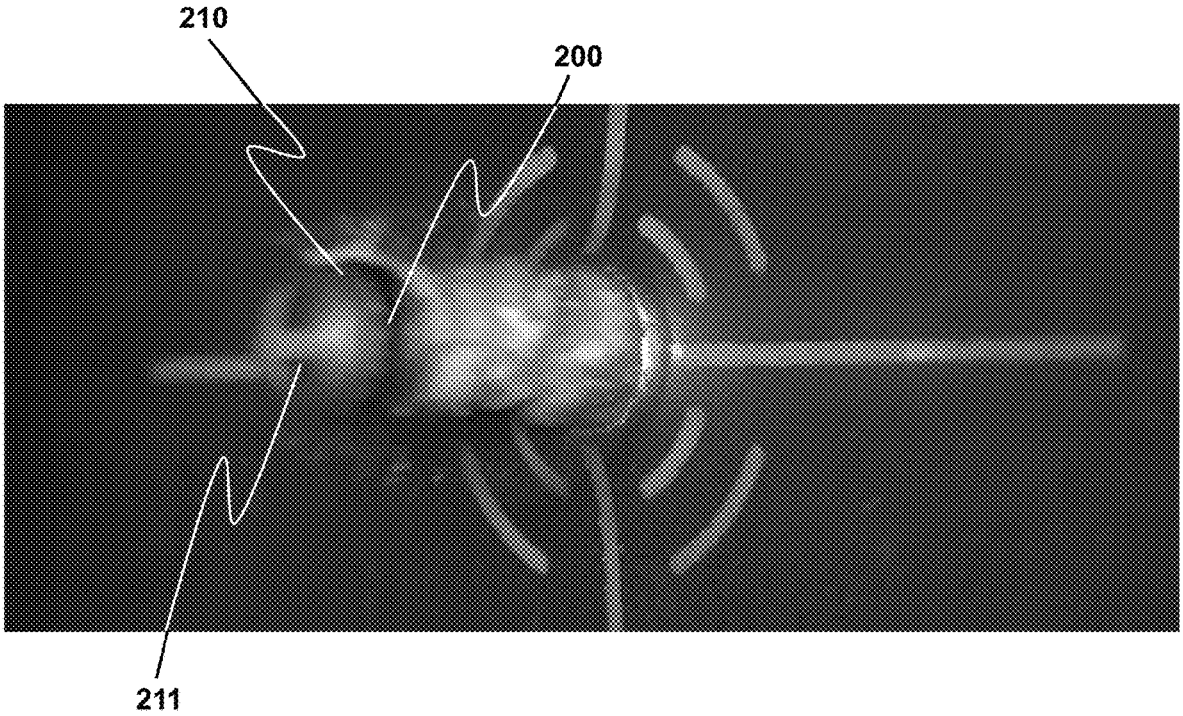
Figure 29:
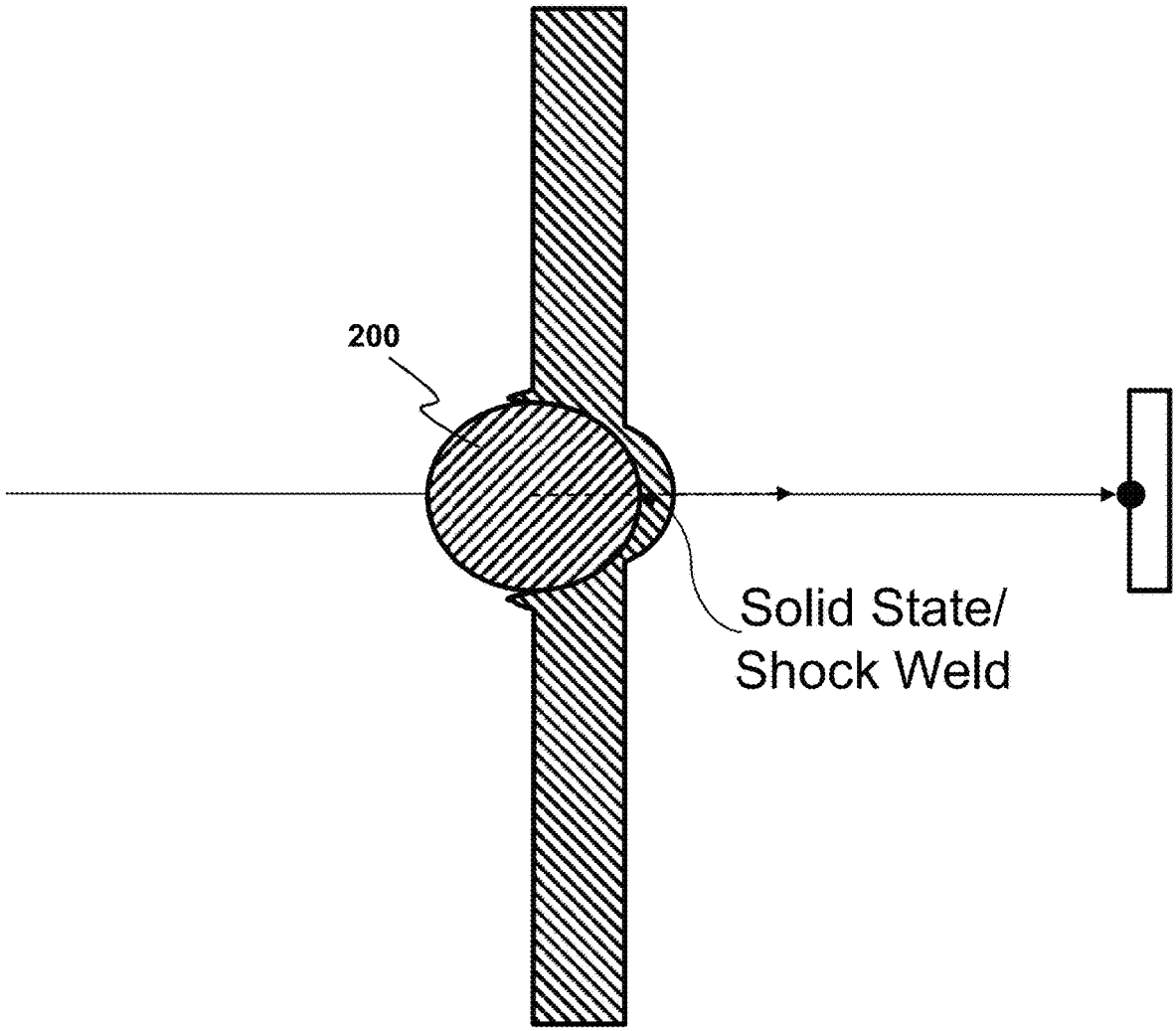
Figure 30:
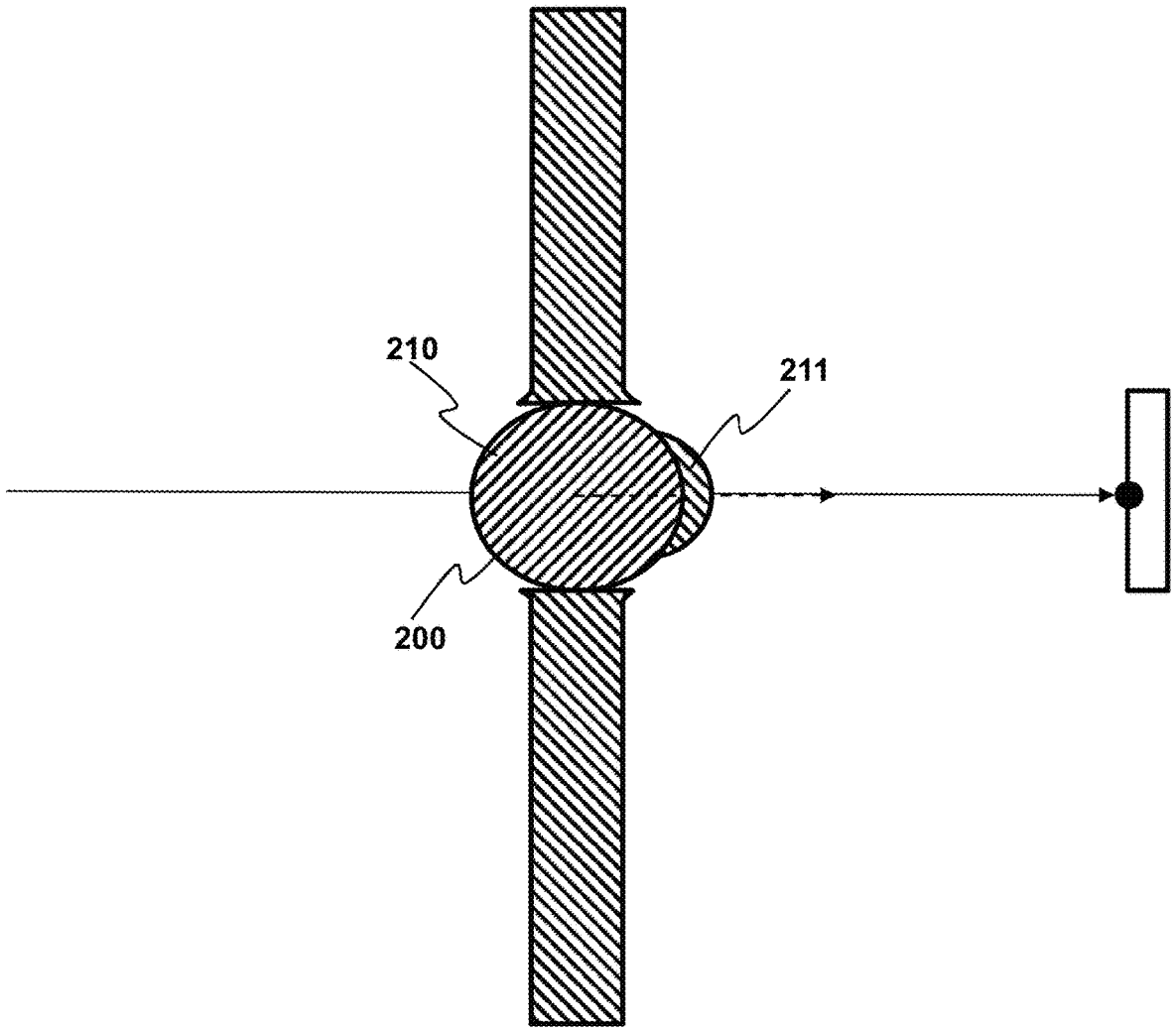
Figure 31:
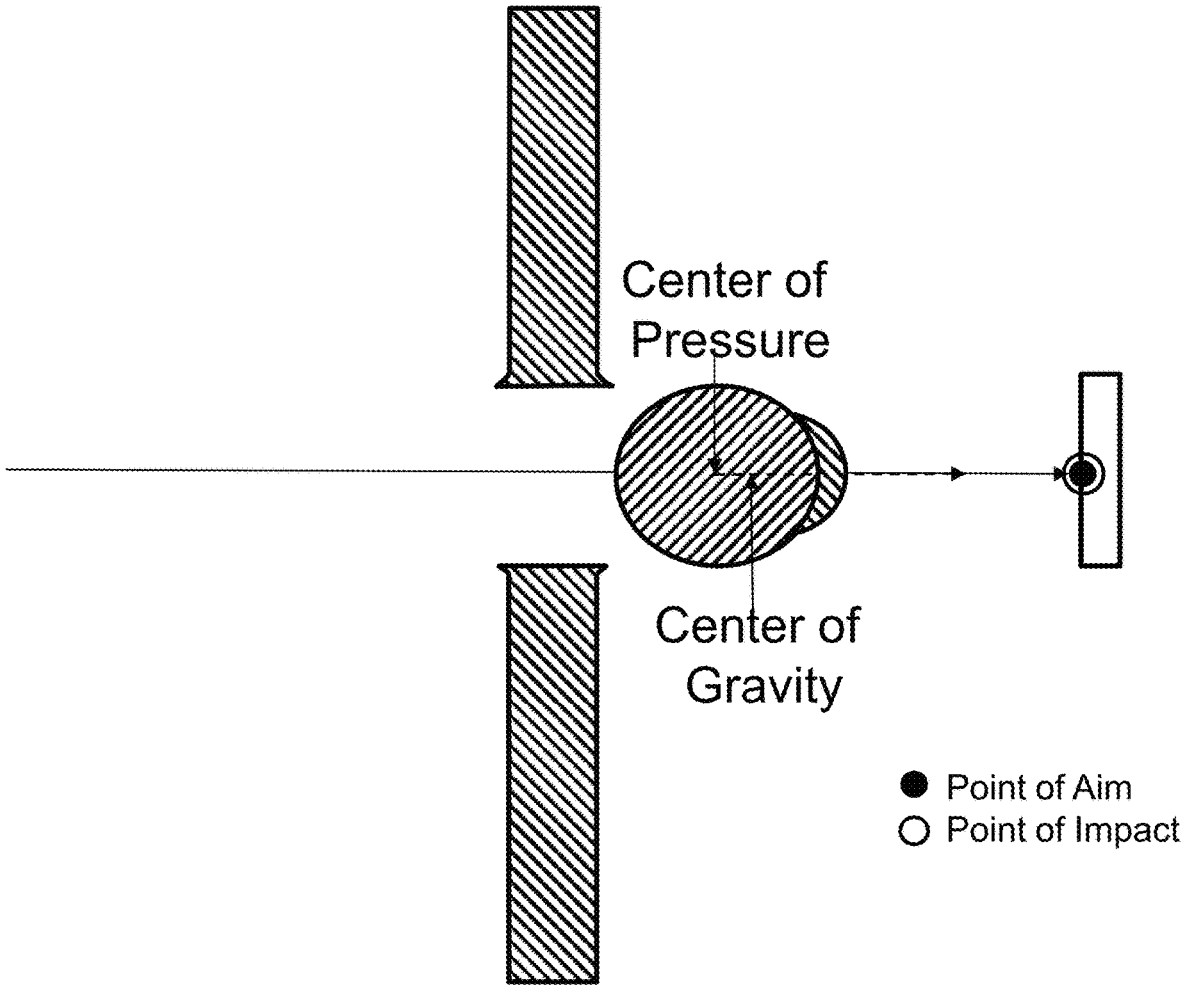

Composite projectile 210 is illustrated in FIGS. 2 and 22 (see also FIGS. 29-31). Composite projectile 210 comprises RP 200 and the welded/bonded barrier portion 211, which corresponds to at least a portion of impacted barrier portion 123. As noted above, despite the impact, solid state welding process, the increase in mass from that of RP 200 to that of composite projectile 210, and a change in momentum from that of RP 200 to that of composite projectile 210, composite projectile 210 traverses past barrier layer 121 and a penetration distance 131 through explosive device 120 along the same linear trajectory 130 with minimal deviation. FIGS. 25A and 25B show consecutive, respectively, screen grabs from a video showing an RP 200 impacting with a steel barrier and the resulting formation of composite projectile 210.

The invention can be further understood by the following non-limiting examples.

Example 1: Rounded Projectile (RP) Description

Described in this example are embodiments of a rounded projectile (RP), such as RP 200, which is also interchangeably referred to herein as a Supersphere (or supersphere). Also described are projectile cartridges, such as projectile cartridge 300A, having rounded projectiles, or Superspheres, and method of using these. The Supersphere, is an interchangeable disrupter/dearmer spherical projectile and cartridge system for precise disablement of an explosive device, such as explosive device 120, or ordnance structural components. A spherical shape is stable in flight and cannot pitch, yaw, tumble, nor wobble, all of which cause projectiles to veer off a trajectory. Superspheres (i.e., RPs) described herein are designed to be accurate after perforating single or multiple barriers and precisely destroy fuzing components or structures of interest inside of an improvised explosive device (IED) or military ordnance. Alternatively, they can be used in breaching of containers by precisely targeting locking mechanisms, hinges, and structural members. The Supersphere is versatile with respect to perforation of variety of barrier materials, such as of barrier layer 121, ranging from low strength plastic, fabric, or cardboard or high strength barriers composed of up to 0.75" thick steel. The projectiles are constructed of different materials depending on the target and can be seated in interchangeable cartridges containing different propellant weights and propellant mixtures to adjust projectile velocity. An important characteristic of the Supersphere projectile is its composition, selected such that it does not deform during nor after perforation of a barrier, because the material strength and hardness are several times greater than the impact pressures generated. Explosives impact dynamics are always a top concern when shooting into IEDs. The shocks resulting from an impact can initiate the explosives inside a bomb. Superspheres can perforate IEDs at low velocities to reduce the impact pressure, and because of their spherical shape the pressure wave is of short duration; the resultant shock impulse is relatively small. Impact pressure is also dependent on density. Low density polymer Superspheres have the added benefit of having shock Hugoniot properties similar to water and have been shown to not shock a primary explosive while moving at almost the speed of sound.

Current commercially available high velocity penetrator projectiles have poor accuracy post-penetration of barriers constructed of metal such as steel or aluminum greater than 0.0625" thickness. Most projectiles have poor aerodynamic properties because of their design. This is particularly the case for dearmer projectiles shot from smooth-bore disrupters as described below. Use of a rifled barrel to spin stabilize the projectiles has not improved their post-penetration accuracy through a thick steel barrier. During experiments, in many cases, the projectile, sabot, or cladding surrounding it deformed prior to exiting the disrupter and resulted in the projectiles wobbling. Shell components such as seals, wadding, cups or sabot material were sometimes observed to travel in front of the projectiles and impact barriers in advance of the penetrators. Some of these materials trailed the projectile and entered the target through the hole created by the bullet. Their trajectories were random and could cut or damage components, pre-triggering the bomb. The projectiles were shocked on impact with thick steel barriers and deformed, broke up, or deflected and thereby lost their flight stability after perforation. The fast moving projectiles created high intensity and long duration precursor shocks and rarefaction waves inside the barrier. These have been observed to cause spall particles or shock initiation of explosives adjacent to the barrier. Some penetrators created barrier plugs and fragments that were observed flying at random trajectories inside the target. The Supersphere shape and material properties mitigate many of the negative factors observed with other penetrators. The shell (e.g., first cylindrical shell 302A) internal structure proposed herein will minimize the deleterious effects of shell materials exiting the disrupter barrel.

The first evidence of spherical bullets dates back 400 years. These balls were fired from smooth bore firearms, which were driven by black powder charges. The use of round bullets may be as old as the 14th century. Ball shaped bullets were constructed of relatively low strength or brittle materials. Up and through the Civil War period, the most common material for "musket" balls was cast lead. The ball projectile could hit a man-sized object within approximately 100 yards. The velocity for such projectiles was typically subsonic, and they had a maximum velocity of approximately 1000 fps. Lead balls readily flatten even when shot into soft clay. They are not aerodynamic post-penetration and have random trajectories. Perhaps the most popular spherical projectiles were cannon balls which were made from a variety of materials such as stone or cast iron. Cannon balls were relatively inaccurate compared to musket balls. They were devastating due to their large size and mass. In some configurations, cannon balls contained explosives mixed with shrapnel. They were designed to shatter and splinter wood structures and compromise stone walls, or launched to land on a battle field. In the past, the sphericity tolerances and density uniformity of ball shaped projectiles were major factors in limiting their radial accuracy.

The Supersphere projectiles can have over eight times the material strength of mild steel. The Supersphere hardness on the Rockwell C scale ranges from 30 to 70. These material properties prevent deformation during impact on thick steel barriers. In addition, Superspheres constructed of ductile materials prevent fracture on impact caused by shock loading. Unlike their ancient predecessors, the Supersphere's spherical shape and high precision sphericity is perserved after penetration and thus they fly straight inside the target. The Supersphere projectile can be inserted inside the shell casing or loaded separately when used in conjunction with blank shells. The method of using blank loads to drive solid projectiles has been documented previously (U.S. Pat. No. 9,453,713). Dependent on the powder weight and projectile mass, Superspheres' velocity range is wide, ranging from subsonic speeds, approximately 500 fps, to supersonic speeds, up to 6,000 fps. Post-penetration, the projectiles produce minimal target barrier secondary fragments or spall. Furthermore, the internal shell materials are structured such that the resultant internal shell elements following the leading projectile minimize unwanted interactions within the target. The projectiles are designed to be fired from smooth bore disrupters/dearmers, however, optionally they can also be fired from rifled bore disrupters/dearmers. The latter is generally less preferable for reasons explained below.

The advantages of a smooth-bore disrupter eliminates the need for a sabot or projectile cladding required for a rifled bore, which often separate from the projectile upon target impact. The resultant high velocity liner fragments do not fly along the trajectory of the projectile post-penetration. The cladding on the projectile often deforms such that a spin stabilized projectile will wobble. Instead, the Supersphere is bore centered and cushioned by use of a fabric wrap (e.g., wadding 303) covering over ⅔ of the ball; common materials used are cotton fabric, or synthetic textiles such as but not limited to Kevlar™. The wrap acts as a gasket to keep propellant gases from escaping through the gap between the Supersphere and bore lumen and thus, maximizes the pressure driving the Supersphere forward. The wrap also can reduce friction between the projectile and the bore. Use of high strength, heat resistant, and low friction textiles such as Kevlar™ do not shread under the explosive pressure and thus block other shell components from squezzing through the gap between the Supersphere and bore. This insures the Supersphere impacts the target before any other materials from the shell. In one embodiment, where the Supersphere is not inserted into the shell (e.g., 302A), but loaded into the chamber separately, the wrap has an additional function of creating a friction fit so the Supersphere remains in place inside the chamber prior to firing. Barrel wear due to friction is also eliminated by the wrap. The wrap, being of low density fabric separates from the projectile due to air drag. It may follow the projectile inside the target, but has no negative effects.

Superspheres are precision made and can range in size from 0.22" to 2" in diameter. This size range allows for use in different caliber disrupters and applications. Tolerances in Supersphere diameter and spherocity are 0.0001" to 0.001". The current embodiment has a diameter no more than 0.04" smaller than the inner diameter of a 12-gauge disrupter bore. The projectiles are stable in free-flight and during penetration through barriers. At the higher end of the projectile velocity spectrum, the impact pressures exceed the elastic-plastic limit (EPL) of the material. Due to the projectile's spherical shape, the shock pressures drop quickly after impact and thus the shock impulse is reduced compared with common projectile geometries used in disrupter projectiles. This characteristic lowers the risk of shock initiation of explosives loaded inside of the bomb. The pressures exceeding the EPL cause the barrier material to flow at the interface with the projectile surface. The material is radially dispersed and flows backwards rather than forming fragments and spall that fly inside the bomb. High speed video shows a cratering effective and orange incandescing ejecta from the point of impact. The spherically shaped shock front disperses radially and thus spallation due to the divergent rarefaction wave is reduced.

The reduced shock impulse and lower impact pressures of a Supersphere impact also have the benefit of reducing the risk of shock initiation of explosives that may be adjacent the barrier penetrated by a Supersphere. Other projectiles use different geometries to reduce shock impulse to minimize the risk of shock initiation. In comparison, the Sherwood projectile (U.S. Pat. No. 6,439,127) has a cruciform point using a sharp four blade hunting arrow broadhead. This point geometry also reduces shock impulse, but in a very different way. The shocks are very high at the tip during impact, but expand in a parabolic shock front thus having a very short duration. The Short Pulse Intense Kinetic Energy (SPIKE) penetrator (see, U.S. application Ser. No. 16/209,643, filed Dec. 4, 2018, which is incorporated herein by reference in its entirety to the extent not inconsistent herewith) also has a pointed shape and has a similar pressure time history profile as a Sherwood projectile impact. The Sherwood projectile leads a water jet and was intended to cut a hole in thin skinned containers to provide a portal for a fluid jet. The SPIKE was designed for thin and thick barriers and like the Supersphere has the main function of destroying specific bomb components.

Standard penetrator projectiles in the art for disrupters/dearmers are cylindrical in shape and have flat fronts such as the AVON, steel slug, and aluminum slug 12-gauge disrupter projectiles. This projectile geometry can result in a high risk of shock initiating explosives if they are impacted or if they are adjacent to barriers which carry precursor shock waves that interact with explosives. These right-angle cylinder projectiles produce planar waves upon impact that are of high pressure and have linear time history. High velocity impacts produce long duration rarefaction waves and commonly produce spall. For thick barriers, projectile impacts can produce high velocity plugs. A plug is a chunk of barrier that pinches off and is approximately the same diameter of the projectile. It is a considerable hazard because it is effectively a secondary projectile that can move at a velocity equal to or higher than the intentionally fired projectile and it often does not fly in the desired flight path. The fragments and spall particles fly radially in front of the projectile and at random trajectories from the impact zone due to their size and shape. This radial spray can cause significant collateral damage inside the bomb that could result in a failed render safe procedure. It can hit critical bomb components and cause the bomb to pre-trigger or explode from impact initiation of the explosives. The Supershere disruption system, according to embodiments disclosed herein, minimizes the production of random fragments or spall when shot through steel, aluminum or other metal barrier. Furthermore, barrier plugs (e.g., 211) are trapped by the Supersphere and thus will fly along the desired trajectory riding on the front of the projectile. This trapping phenomenon will be explained in detail.

A novel characteristic of a Supersphere impact is the bonding of the projectile to a plug (e.g., 211) of metal barrier material forming a new drag-stabilized projectile (e.g., composite projectile 210) post-penetration. The initial impact occurs at a single point on the Supersphere; the area of interaction grows at the rate of penetration to be the surface of a hemisphere of the same diameter of the projectile. Pressure is by definition force per unit area and as such drops very quickly. As the pressure drops below the EPL during penetration, the barrier stops behaving hydrodynamically and the remaining barrier in the path of the Supersphere plastically deforms to the shape of the projectile in contact with it. This forged hemi-spheroid plug (e.g., 211) bonds to the projectile (e.g., 200). This bonding is due to the projectile shape, heat and exponential rate of pressure drop. Some materials promote bonding such as steel or titanium. The phenomenon of galling is an example of how steel or titanium experiencing high shear heating can cause two parts to seize and weld together. During the process of solid state welding or friction welding, the material of the two metallic objects plastically flow and mix at their interface due to extreme pressure and heat. This is not a fusion process because the materials have not reached melting temperatures. Friction welding will occur when there is relative motion between the objects at their surfaces which are under constant shear. The projectile penetrates the barrier whose material is hydrodynamically flowing along the surface of the Supersphere. As the pressure drops and plastic flow stops, the projectile becomes bonded to the barrier. Solid state welding is commonly used in industry to create a bimetallic bond between objects of different alloys or metals. For example, titanium and steel objects can bond in this fashion. Thus, regardless of projectile material, the Supersphere should effectively trap the plug. Supersphere surfaces can be polished, rough, or dimpled. The surface roughness can also be used to promote the novel phenomenon of barrier plug bonding.

Supersphere surface roughness (e.g., of outer surface 204) provides an additional advantage in flight by reducing drag. Rough surfaces create a boundary layer which air flows around reducing the slip stream size. The stagnation zone behind the ball is smaller, and thus the pressure differential that creates drag is reduced. An example of a rough surface to make a sphere more aerodynamic is the dimpled surface of a golf ball.

Experiments show the composite (e.g., 210) of projectile (e.g., 200) and plug (e.g., 211) forms a new dynamically mated composite projectile (e.g., 210). The resultant increase in mass of the composite projectile is dependent upon the material properties and thickness of the barrier. Recovered Superspheres were measured to have 30% higher mass when shot through ¼" thick steel and approximately 50% higher mass when shot through ½" thick steel. Momentum calculations have shown the composite projectile can preserve 95% of the pre-penetration momentum. In tests where the Supersphere was impacted normal to the barrier face, high speed video demonstrated the composite projectile was stable. It does not yaw nor tumble and it follows the pre-penetration trajectory. The composite projectile flies straight through multiple wood panels. An analysis of the projectile shape and mass distribution revealed the Supersphere-barrier plug composite projectile to be drag stabilized. This is the first time a projectile has metamorphosed into a new ballistically stable projectile of higher mass.

Accuracy measurements on witness panels set 12" and 24" behind ¼' thick mild steel plates produced a radial error with an average length of 0.063". This accuracy was held regardless of muzzle velocity in tests with projectiles moving from 1600 fps to 3400 fps. Minimal barrier deformation was observed and material flow was obvious by visual inspection of the barrier holes for all muzzle velocities evaluated.

At velocities below 1600 fps, the projectile-barrier plug bond was weak and the plug would partially or completely separate after hitting a witness panel 12" from the inside face of the barrier. The projectile held its accuracy through the witness panel, however, the composite projectile lost its symmetry and thus post-penetration accuracy at 24" was lost and the average radial error increased to 0.3" at this distance.

Superspheres are designed to be up to eight times the material strength of the target materials. Ideal materials are high strength, high ductility and hard metal alloys. Hardening of the Superspheres is also important, but care should be taken not to make the projectiles brittle. A hardness value of 30-70 Rockwell C has been shown to be effective against steel barriers. Surface/case hardening is also a method that can be used to reduce the risk of brittle failure and simultaneously prevent surface wear and projectile deformation. For steel barriers equal to or greater than 0.125" thickness, high strength chromium steel balls (density 7.8 g/cc) traveling at 1800 fps are effective. To increase the projectile speed, lighter metal alloys for a given propellant load can be used. The relative velocity increase is proportional to the ratio of the square root of the masses. For example, heated treated titanium 6Al-4V, titanium 10-2-3, or titanium Beta C have a density of approximately 4.4 g/cc. These titanium Superspheres, for the same diameter and propellant load used above, will travel at speeds estimated to be approximately 3,900 fps. Lighter projectiles may be ejected too quickly and may cause a drop in the peak pressure produced by smokeless powders in the chamber, which could result in considerably lower velocities than predicted. Smokeless powder (e.g., an exemplary propellant 322) burn rates are pressure dependent. Some solutions to address chamber pressure drops are the use of a rupture disk (e.g., 330) between the propellant (e.g., 322) and projectile (e.g., 200), or a shell crimp (e.g., 305) could be used to delay movement of the projectile. Alternatively, friction and press fitting could be used to delay movement of the projectile. Tamping materials can also aid in sustaining chamber pressures for longer periods. These methods allow time for the chamber pressure to build up. High burn rate powders (e.g., 322) should also be used, such as Alliant Bull's Eye smokeless powder.

Reducing the diameter (e.g., 203) of the Supersphere as a method to lower the mass of the projectile may have unexpected consequences. The combustion gases that accelerate the projectile can escape around it, even if the bore is sealed with a fabric wrap to fill the interstitial space between projectile surface and the inner bore. During experiments using a 12-gauge disrupter, reducing the Supersphere diameter from 0.708" to 0.687" caused a loss in muzzle velocity of up to 500 fps. Using sabots to create a better gas seal may create undesirable effects post barrier perforation.

Examples of Supersphere materials appropriate for steel barriers exceeding 0.0625" thickness include, but are not limited to tool steel alloys, high strength chromium steel, S2 steel, C300 and/or C350 steel, armor steel, heat treated Grade 5 titanium, titanium 10-2-3, titanium Beta C, nickel alloys, and tungsten alloys. For low strength barriers made from wood, plastic, fabric or thin steel (less than or equal to 0.0625"), synthetic rubber polymers and ceramics are highly effective Supersphere compositions. For example, high durameter (90) polyurethane, and carbon fiber reinforced polymers are effective. Experiments have demonstrated perforation of 0.0625" mild steel with polyurethane balls having tenstile strengths of 8,000 psi and 80 durameter. The projectiles were recovered intact. Muzzle velocity of polyurethane Superspheres is approximately 3,000 fps, which is largely due to their low density (1 g/cc). In addition to the high velocities, polymers such as polyurethane have exhibited benefits in minimizing unwanted interactions with the target. Because their shock Hugoniot properties are similar to water, polymer Superspheres exhibit low risk of shock initiation of common explosives on impact.

Superpheres may comprise brittle ceramics to make them frangible. If the desired post-penetration effect is rapid dispersal of the projectile, then a high strength brittle material could be chosen. Tactical breaching applications such as glass breaking, making gun ports, and door breaching are examples of objectives where the dispersion of the projectile post-perforation would be desired.

Impact tests against 9 VDC alkaline batteries showed the Supersphere to effectively and quickly kill batteries. Batteries under test are configured to be under load conditions during a power dump into an initiator. The batteries exploded into small fragments before the projectile exited the back face of the power source. A black ejecta from the batteries was observed in high speed video. Batteries died so quickly it was difficult to measure the duration of power output. The black material is the paste-like redox reagents inside the battery cells. The Supersphere was shown to precisely destroy IED fuzing components with minimal collateral effects.

The cartridges (e.g., 300A) for the Supersphere exceed standard lengths for disrupters or standard shotgun shells. They may exceed 5" in length and are made to seat the projectile adjacent to the bore or extend into the bore (e.g., 112A) to avoid the projectile from traversing through the forcing cone (e.g., 110A). The forcing cone is an inner diameter reducer element in shotguns and most disrupters and is the region between the chamber (e.g., 108A) and bore (e.g., 112A). Standard shotgun and disrupter shells contain the projectile which is seated inside such that the projectile does not extend beyond the chamber. For a standard 12-gauge disrupter the chamber diameter is 0.83" and the bore diameter is approximately 0.729" in diameter. A projectile that is fully seated inside the chamber deflects off the walls of the forcing cone which can cause it to deform. Gases can escape around the projectile and cause inconsistency in velocity which will reduce accuracy.

In order for projectiles to reach 4,000 fps to 6,000 fps, Supersphere cartridge shells (e.g., shell 302A) contain propellant grain weights (e.g., propellant 322, in propellant region 320A) that are two to five times the standard shotgun shell. The propellant weights can be 90 grains to 200 grains by weight of double base smokeless powder. Rather than using common shell (e.g., 302A) materials such as plastic, brass or aluminum, the Supersphere casing (e.g., 302A, or wall 302D thereof) is made from high strength steel. An example of appropriate steel alloys is heat treated C300 or 715. Casing (e.g., 302A) expansion using softer materials will result in the shell becoming jammed requiring a ram rod to free it. In extreme cases, shells have fragmented under excessive propellant loads. The steel body of the shell will have a wall thickness ranging from 0.04" near its opening to 0.125" at its base to contain pressures exceeding up to four times the Standard Arms and Ammunition Manufacturers' Institute (SAAMI) maximum pressure ratings. To prevent galling during extraction, the shell will be lubricated (e.g., cartridge outer layer 310) using common anti-seize lubricants or cladded with titanium carbide or copper, anodized or other coatings (e.g., cartridge outer layer 310) that prevent galling. A carbon fiber reinforced polymer liner (e.g., cartridge outer layer 310) can be used to prevent galling and increase shell strength.

In the mid-1990's, Christopher R. Cherry designed the custom blank loads for the PAN disrupter. Cherry observed that propellant grain weights exceeding 90 grains can burn erratically. Erratic burning would result in varied pressure-time histories in the breech and unpredictable and varied projectile velocities shot-to-shot for the same blank cartridge. A deflagration to detonation transition can happen with powders containing high nitroglycerin content by weight due to the extreme confinement and large volume in the shell. To address this issue of erratic burning, several approaches are used and described in the following paragraphs.

In the first method of controlling burn rate and preventing erratic burning, different propellants are mixed or layered such that the composition will burn progressively at a lower rate with respect to distance from the shell base to the projectile. A high strength primer, such as a 50 caliber primer, will be used to initiate the propellant. The propellants will be layered in a stratified way with powders having higher characteristic burn rates near the shell base and lower burn rates near the projectile. Generally speaking, the burn rate of double base smokeless powders is dependent on nitroglycerin content by weight, shape and size of the grains. An example of powder mixtures that gradually decrease in burn rate with respect to distance from the shell base will be set forth. In one embodiment, the powder adjacent to the primer, can be a smokeless powder with high nitroglycerin (NG) content such as Alliant Bull's Eye double base smokeless powder (40% by weight NG) and decreases in NG content such as Alliant Red Dot double base smokeless powder (20% by weight NG), followed by Alliant Green Dot, and next Alliant Blue Dot and so forth. Additives can be mixed in a gradient fashion with the powder such as silicone that would reduce burn rate with distance from the shell base.

In the second method to control burn rate and to prevent erratic burning, the internal diameter (e.g., 302F or 320B) of the space holding the propellant (320A) will be reduced progressively from the base of the shell to its opening. A long axis bisection of the shell will reveal a parabolic or a conical shape which is widest at the base of the shell and is reduced to a defined opening diameter. The inner volume will be axially symmetric such that a cross sectional slice anywhere in the volume would be circular. It is known that the length to diameter ratio effects the burn rate in standard shells. Reducing the inner diameter (e.g., 302F or 320B) relative to shell length slows the burn rate.

The Supersphere does not have to be fully seated inside the cartridge. In one embodiment, the Supersphere can be glued or magnetically attached to the opening of the cartridge. The depth of seating of the Supersphere body inside the cartridge can be 20%, 50% or 100%. The reduced depth has the advantage of projecting the Supersphere body partially inside the forcing cone, fully inside the forcing cone, or past the forcing cone such that the Supersphere is inside the bore after the shell is inserted into the chamber.

When using blank commercially available shotgun shells to propel the Supersphere, one method to position the projectile in the bore is to use high density closed cell foam as a spacer. Co-volume is the volume taken up by the powder and void in front of the propellant. Co-volume can dramatically effect propellant burn rates. Large air voids between the propellant and bullet will increase the co-volume. Blank cartridges use commercial shotgun wadding, synthetic beads, natural and synthetic fiber fillers to reduce the co-volume inside the shell and to provide inertial and resistive tamping. Cardboard disks seal the shell opening. Some disrupter shell manufacturers use epoxy. These materials are ejected in a trail behind the projectile. High speed video showed the wadding and internal shell filler materials follow the high density pulverized foam which trails behind the Supersphere. The Supersphere creates a low pressure zone at its rear that causes the shell material to follow it through the barrier hole. The pulverized foam does not damage witness panels. If using commercially available disrupter blank shells, the internal materials including the cardboard can penetrate plywood witnesses. This means that these shell materials can potentially sever wires and damage other components that were not targeted for destruction. The specialized Supersphere shell described above will not contain components that can cause damage post-penetration of a barrier. No cardboard disk will be used to seal the shell. If there is a void in front of the propellant and Supersphere, a dry clay dust followed by high density closed cell foam will take up the space and seal the shell. In the embodiment where the Supersphere is inside the shell, the projectile will seal the opening of the shell.

As a filler, ceramic microspheres may be used as a filler in place of foam, including hollow ceramic microspheres. Plug bonding is observed for steel or titanium RP impacting aluminum barrier. Steel and titanium RPs are hardened. A high degree of accuracy is achieved, including for up to a 30° oblique angle, including for thick steel barriers.

Example 2: Rounded Projectile as a Fluid Plug

Any of the rounded projectiles provided herein may be used to seal a distal end of fluid, such as water, that is positioned in a disrupter barrel. In this manner, the rounded projectile acts as a cap to ensure the fluid does not leak out of the barrel. A preferred rounded projectile is a synthetic rubber spherical ball that is of sufficiently high strength such that the ball can withstand the exerted forces during use without visible damage. In this manner, the rounded projectile plus ReVJeT configuration (e.g., water in a portion of the barrel) provides a number of important functional benefits, including the ability to reliably penetrate a larger barrier layer thickness, good performance at a greater standoff distance, and a reduced risk of impact initiation of explosives in an IED. For at least these reasons, it is advantageous to use a rounded projectile as an improved water seal (e.g., "hydrosphere") for disruption of medium to hard shell (barrier) IEDs. See, e.g., U.S. patent application Ser. No. 16/987,942 filed Aug. 7, 2020, which is specifically incorporated by reference herein.

Replacing a cap element to contain the water in the disrupter barrel with the instant rounded projectile advantageously avoids puncture or creasing during insertion, thereby avoiding unwanted leakage or bypass.

The rounded projectile, such as a sphere, is preferably made of polyurethane, with similar density and shock properties to water. As explained in Ser. No. 16/987,942, when used with a Reverse Velocity Jet Tamper (ReVJeT) configuration, the spherical projectile accelerates with the water jet tip. Upon exiting the barrel the spherical projectile remains at the jet tip. A thin layer of water flows around the spherical projectile and exerts pressure on the outside of the spherical projectile keeping it in-line with the flight path of the water jet. The spherical projectile dramatically reduces air drag and shocks in the water jet.

ReVJet configuration includes as explained in U.S. Pat. Nos. 10,451,378, 10,760,872, 10,794,660. The fluid may be water, or may be a High Energy Efficient Transfer Fluid (HEET), including as described in the above patents and/or U.S. patent application Ser. No. 15/731,874 filed Aug. 18, 2017, each of which are specifically incorporated by reference herein, including for the ReVJet configuration and HEET fluids. Briefly, ReVJet refers to a configuration of a disrupter barrel partially filled with liquid (e.g., water or HEET) at a proximal end (e.g., toward the explosive cartridge) and an air void between the disrupter barrel muzzle and distal end of the liquid column. The air void allows the front of the liquid to accelerate for a longer period of time under confinement. The jet tip velocity is increased, making it closer to the velocity of the rear of the water jet. In addition, wall shear forces act on the back portion of the water column longer and thus reduces its velocity. The result is a decrease in the reverse velocity gradient in the liquid jet; the front and rear of the liquid jet is at the same or close to the same velocity. This aspect in combination with a rounded projectile cap provides numerous functional advantages, including relative to liquid without the rounded projectile or rounded projectile without the liquid.

Example 3: Oblique Angle of Attack on Target

In real-world situations, it is not realistic to always have an exact perpendicular line of attack between the liquid jet and solid projectile relative to the target, as illustrated in FIG. 24.

Schematic illustrations of impact mechanics for a perpendicular and oblique angle of attack are provided in FIGS. 26-31 and 32-39, respectively. Illustrated is a rounded projectile, barrier layer, desired contact point internal relative to the barrier layer. The trajectory of the rounded projectile (RP) is indicated by the arrow, with D representing the distance between the internal surface of the barrier layer and point of aim within the target.

Figure 26:
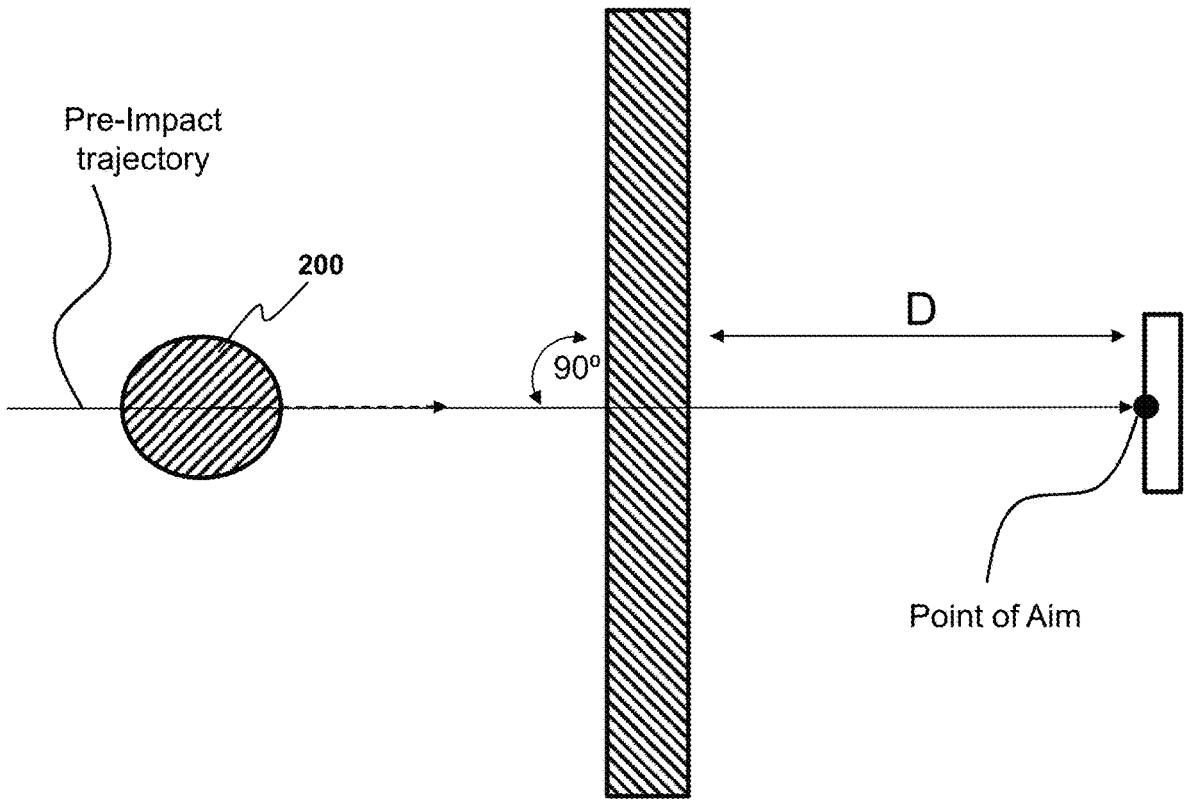
FIGS. 26-31 are a series of time lapse schematics of a rounded projectile (RP) fired toward a target with a barrier layer between desired internal target component and the disrupter-fired RP, wherein the line of flight of the projectile is normal (perpendicular) at the point of contact of the barrier layer outer-facing surface.

FIG. 26 illustrates the RP with a perpendicular pre-impact trajectory.

Figure 27:
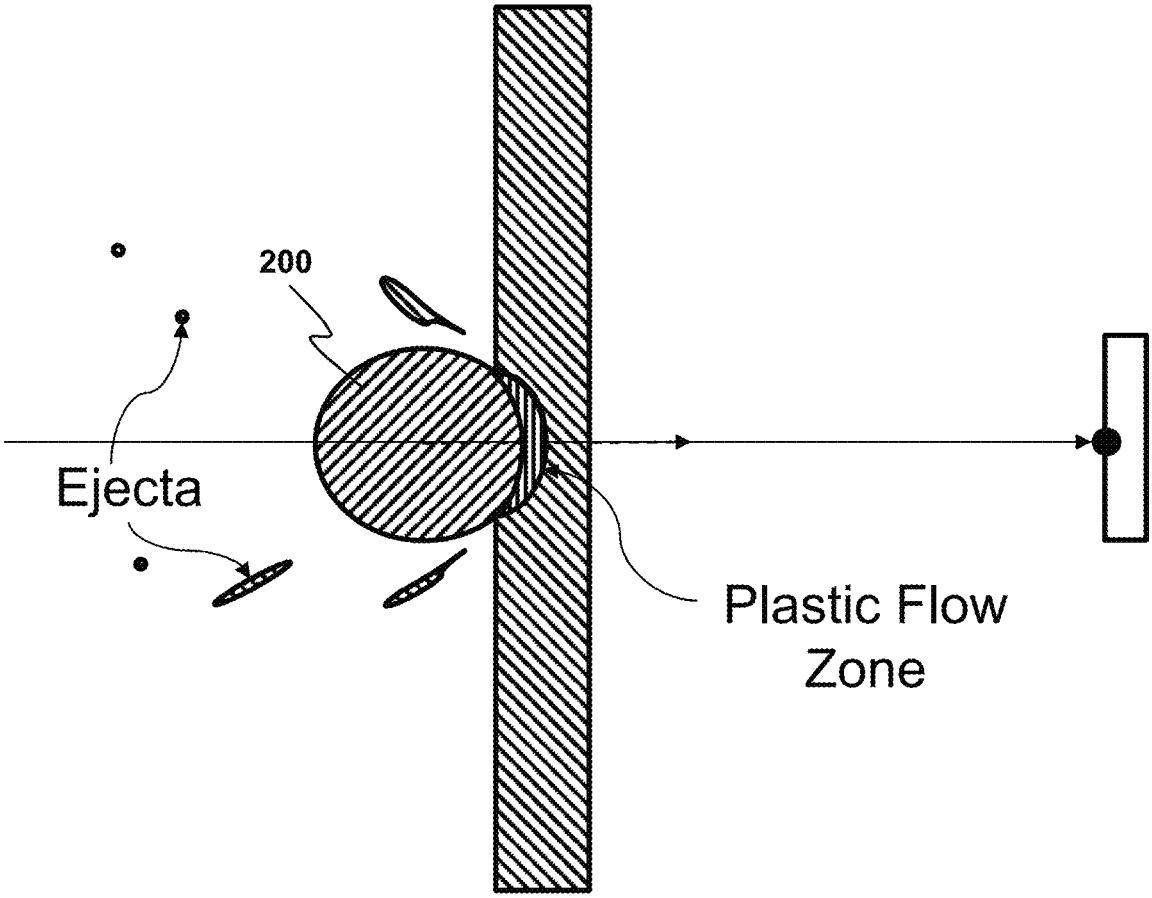

FIG. 27 illustrates the RP initial impact with the barrier layer, where the impact pressure exceeds the barrier layer material's elastic-plastic limit, thereby forming a channel inside the barrier layer that effectively "guides" the RP through the barrier layer.

Figure 28:
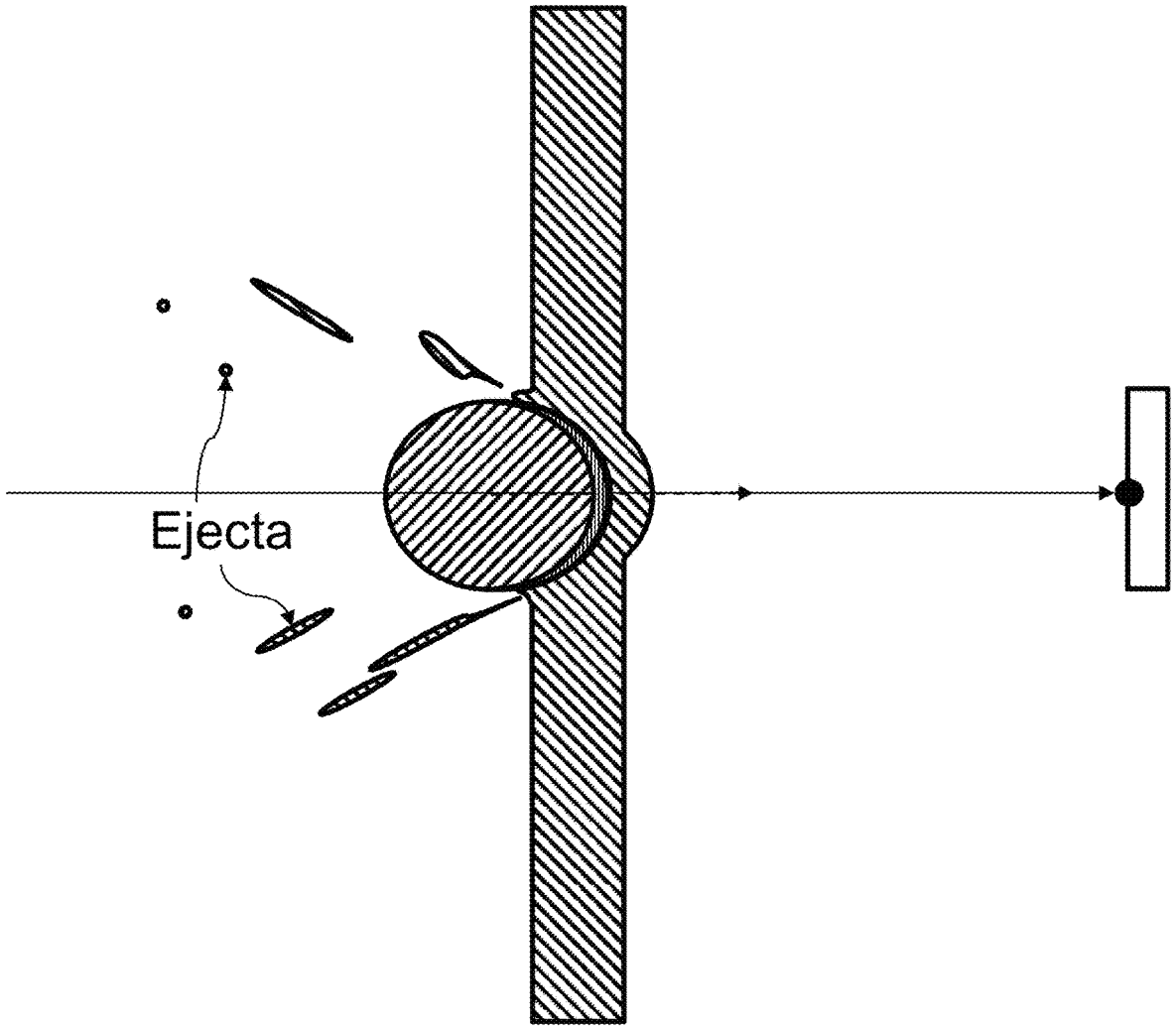

FIG. 28 illustrates the ejecta from the barrier layer is ejected in a direction that is opposite to the projectile trajectory (e.g., away from the target). The pressure between the RP and the barrier layer drops as the contact surface area between the RP and barrier layer increases ($P=F/A$). There is mixing of barrier and projectile materials over the RP surface due to metal flow. As the pressure drops below the elastic-plastic limit, a solid state weld forms at the RP-barrier layer interface (FIG. 29). As the RP passes through the barrier layer, a plug of the barrier layer pinches off from the adjacent barrier (FIG. 30). FIG. 31 illustrates the resultant hybrid RP, with attendant drag stabilization as the center of gravity is shifted distal relative to the center of pressure due to the added barrier layer material on the distal surface of the RP. The drag stabilization further facilitates accurate aim, with the point of impact aligned with the point of aim.

Figure 32:
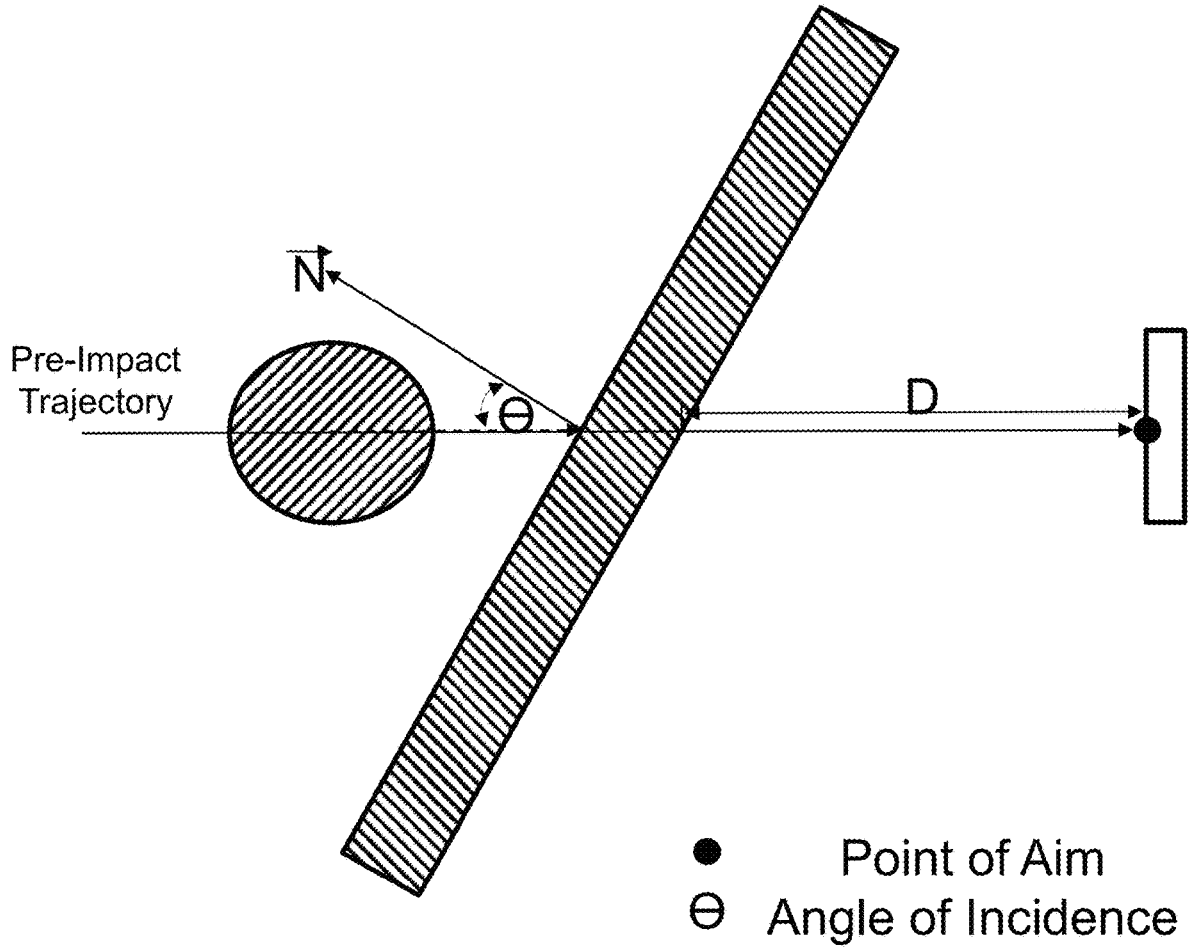
FIGS. 32-39 are a series of time lapse schematics of a rounded projectile (RP) fired toward a target with a barrier layer between desired internal target component and the disrupter-fired RP, wherein the line of flight of the projectile is at an oblique angle (e.g., the angle relative to perpendicular (normal) to a surface) at the point of contact of the barrier layer outer-facing surface.

The devices and methods provided herein are also compatible with oblique impact angles relative to the barrier face (FIGS. 32-39). Referring to FIG. 32, the RP is aimed at a target portion of the explosive device, with the line of flight of the propelled RP indicated by the pre-impact trajectory line. The normal line relative to the barrier layer is labeled N, with the angle of incidence defined relative to normal, labeled e. Distance between barrier layer relevant inner portion of the target is labeled D, with aim point on the desired target location labeled with a dot.

Figure 33:
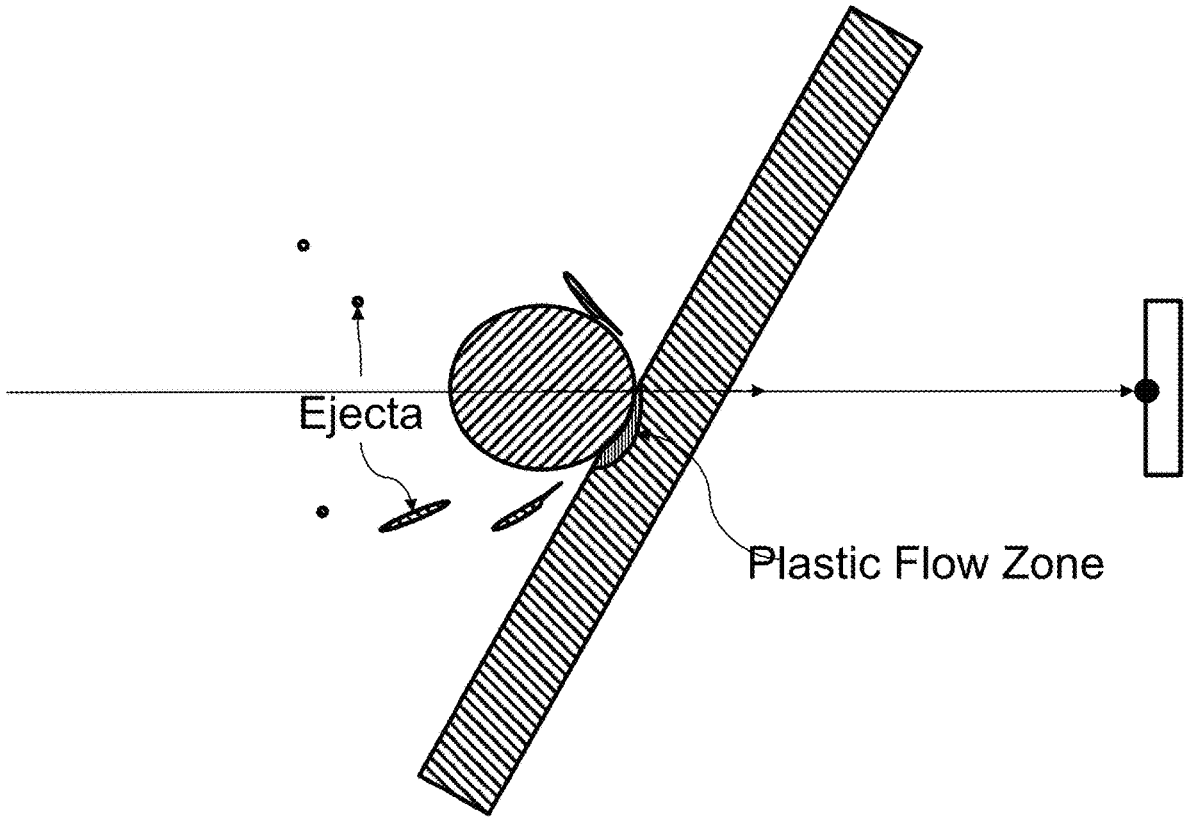
Figure 34:
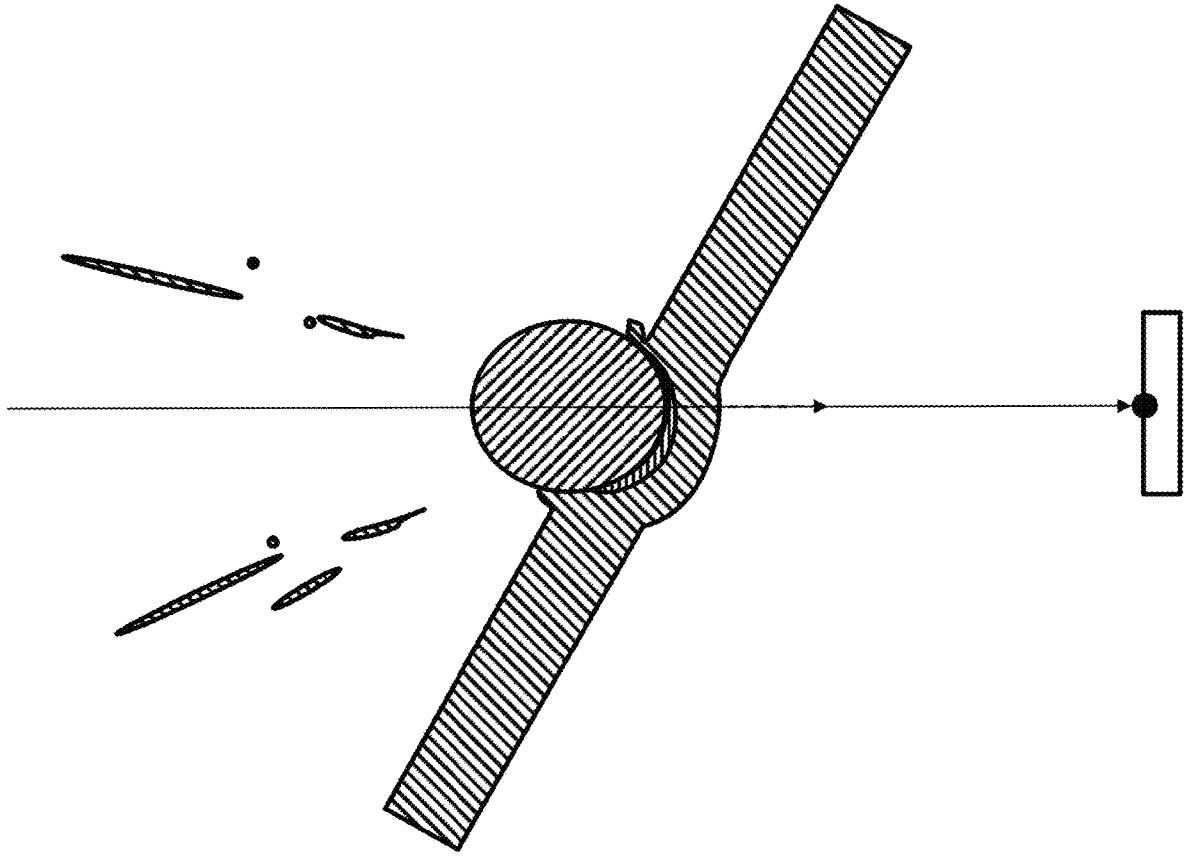

FIG. 33 illustrates the RP impacting the barrier portion of the explosive device. Because the impact pressure between the RP and barrier exceeds the elastic-plastic limit, a portion of the barrier flows outward creating a channel. Due to the oblique angle geometry, net pressure is in the downward direction as only a bottom portion of the RP initially impacts the barrier. FIG. 33 and FIG. 34 illustrates barrier ejecta flying in an opposite direction relative to the RP trajectory. The barrier continues to deform, including as the impact pressure begins to decrease and approaches the elastic-plastic limit of the barrier material.

Figure 35:
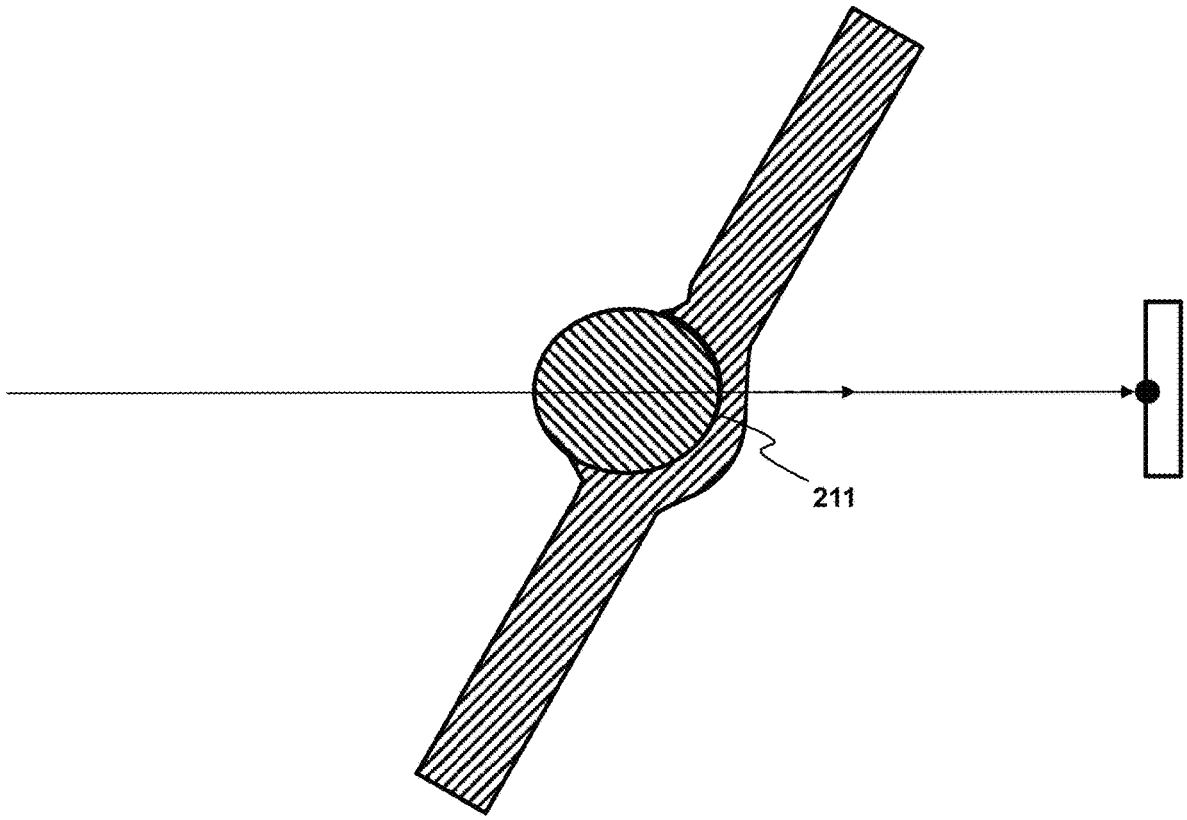
Figure 36:
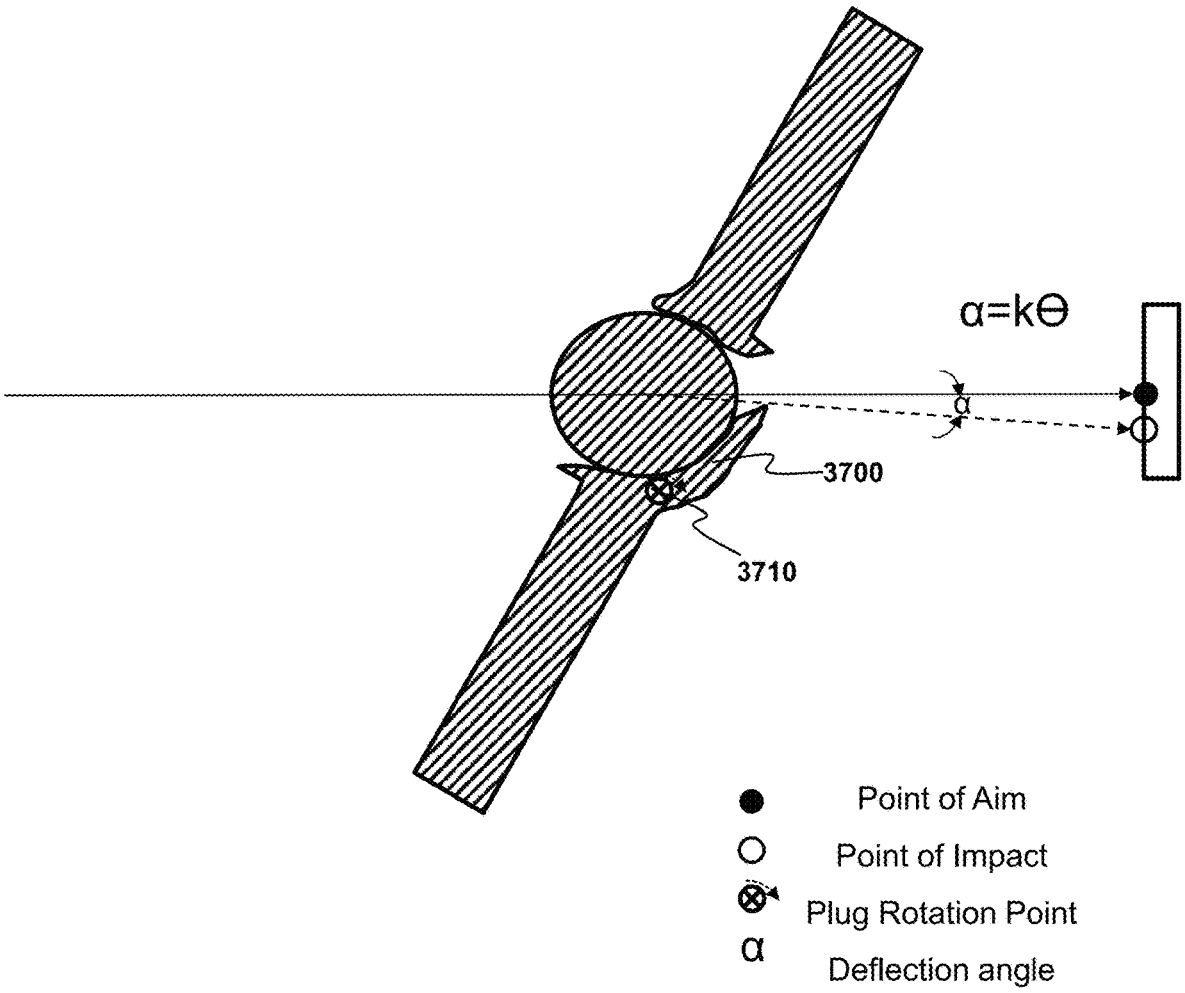

FIG. 35 illustrates formation of a solid state or shock weld as the pressure between the RP and barrier falls below the elastic-plastic limit. The barrier material continues to stretch and move downward due to pressure and inertial forces. FIG. 36 illustrates that as the differential pressure drives a barrier plug 3700 downward at an angle, the barrier plug stretches and at a certain point, exceeds the barrier material fracture strain. The RP is deflected downward at a deflection angle, $\alpha$. The deflection angle is proportional to the angle of incidence, $\theta$, such that $\alpha=k\theta$. k is a constant that can be empirically determined based on the RP, barrier material, and application geometry (including, for example, stand-off distance, disrupter type, fluid, explosive cartridge). The deflection angle accordingly influences the location of the point of impact on the internal target. As illustrated, the deflection angle results in the point of impact that deviates from the point of aim, wherein the point of aim aligns with the pre-impact trajectory of the RP. Also illustrated is the plug rotation point 3710.

Figure 37:
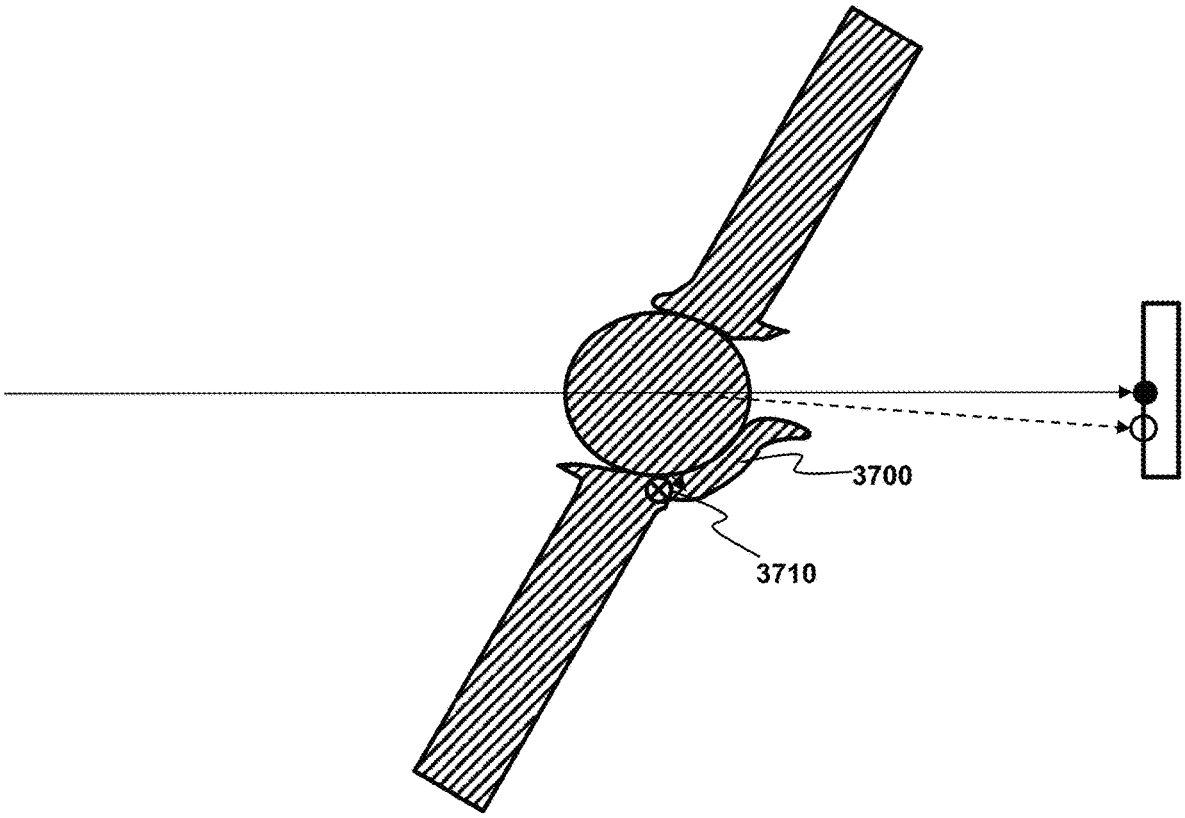

As illustrated in FIG. 37, the barrier plug rotates about a bottom connection between the RP and the barrier material. The plug stretches due to the weld with the RP. The plug is anchored at the bottom and is, therefore, under tension.

Figure 38:
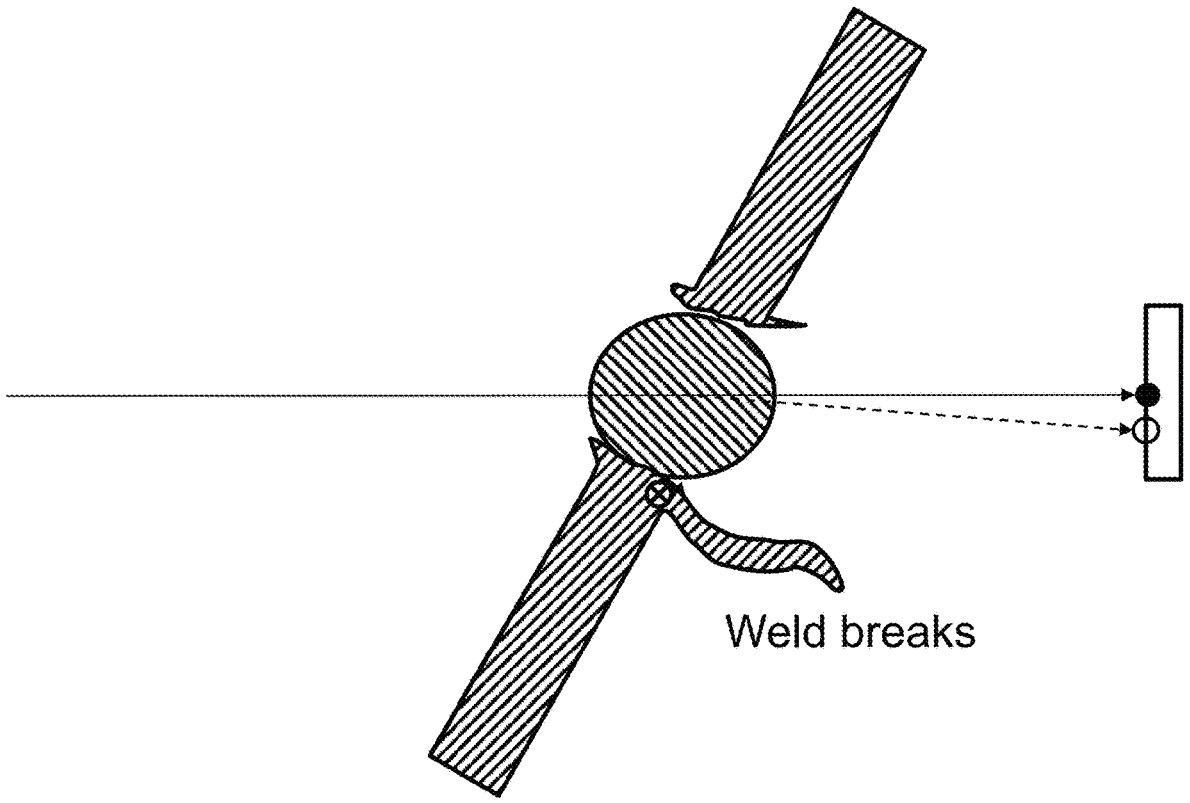
Figure 39:
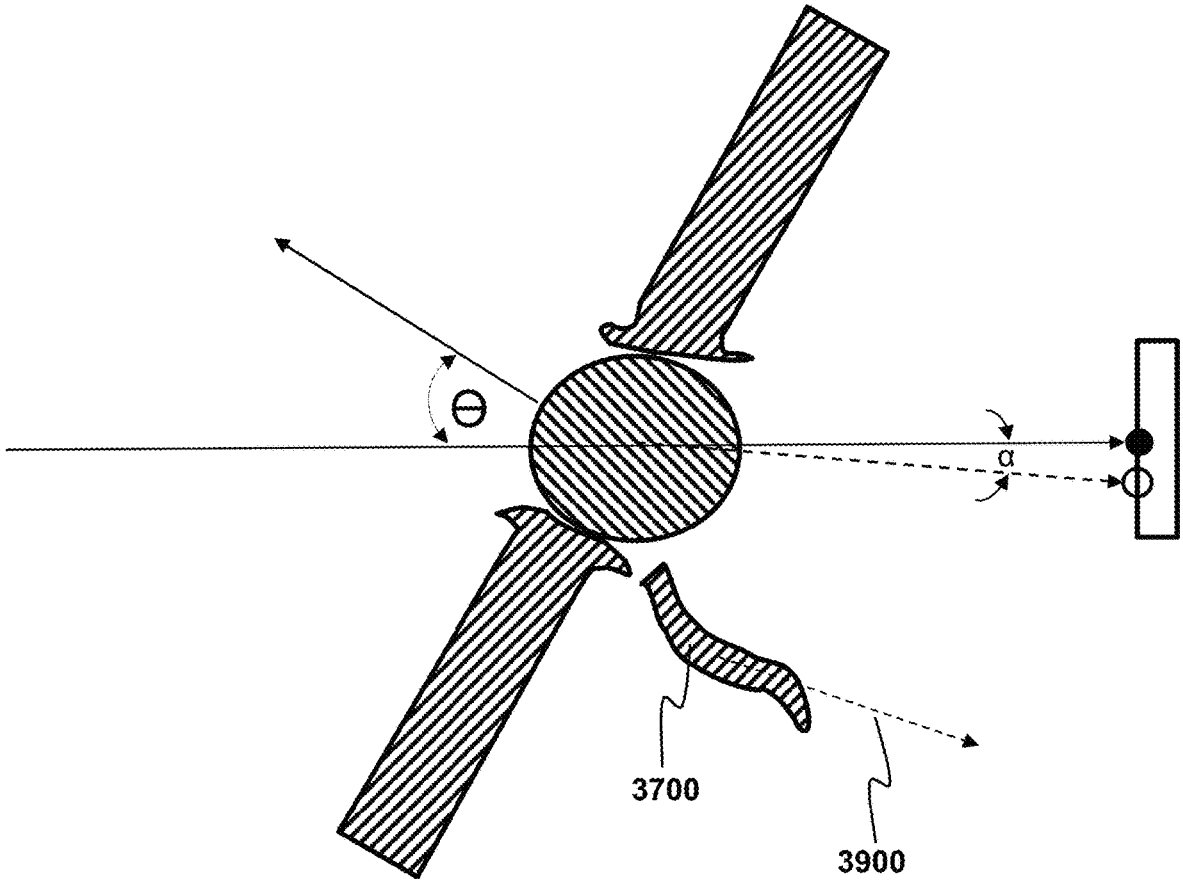

The weld between the barrier plug and RP breaks while the RP is in the barrier channel as the tensor and shear stresses exceed the weld strength. The channel in the barrier layer guides the projectile and, therefore, a mild deflection represented by a, occurs. Inertia causes the plug to continue to rotate about the rotation point (FIG. 38). FIG. 39 illustrates that as the RP is free of the barrier it follows a new trajectory. The slight deviation in trajectory, α, is predictable so that an aiming adjustment can be made to compensate if the angle of incidence, θ, is known. The plug 3700 breaks free of the barrier and follows a plug downward trajectory 3900.

Accordingly, any of the methods provided herein may further comprise the step of determining the angle of incidence between the RP and the barrier, and compensating for the resultant deflection angle of the RP that exits the barrier by adjusting the aim of the disrupter on the target by a corresponding deflection angle. Effectively, the disrupter in the illustration of FIG. 39 is aimed slightly above the desired target impact location, including by an angle α.

TABLE 1

Element Identification Numbers

| Item Number | Item Description |
|---|---|
| 100 | Propellant driven disrupter (PDD) |
| 102 | Disrupter barrel |
| 103 | Longitudinal axis of disrupter barrel |
| 104 | Disrupter barrel muzzle end |
| 106 | Disrupter barrel breech end |
| 108A | Disrupter barrel chamber region |
| 108B | Chamber wall |
| 108C | Chamber inner diameter |
| 108D | Chamber lumen |
| 110A | Disrupter barrel forcing cone |
| 110B | Forcing cone wall |
| 110C | A forcing cone inner diameter |
| 110D | Forcing cone lumen |
| 112A | Disrupter barrel bore |
| 112B | Barrel bore wall |
| 112C | Barrel bore inner diameter |
| 112D | Barrel bore lumen |
| 120 | Explosive device |
| 121 | Barrier layer of explosive device |
| 122 | Target portion of the explosive device |
| 123 | Barrier portion of the explosive device |
| 124 | Explosive of the explosive device |
| 125 | Power source of the explosive device |
| 126 | Electrical connection of the explosive device |
| 128 | Switch of the explosive device |
| 130 | Linear trajectory of RP |
| 131 | Penetration distance of projectile within explosive device |
| 132 | Deviation distance |
| 133 | Standoff distance |
| 140 | Secondary projectile |
| 200 | Rounded projectile (RP) |
| 201 | RP proximal end |
| 202 | RP distal end |
| 203 | RP maximal outer diameter |
| 204 | RP outer surface |
| 205 | RP outer layer |
| 210 | Composite projectile |
| 211 | Welded/bonded barrier portion |
| 220 | RP having half-capsule geometry |
| 221 | Internal low-density region of RP |
| 222 | Liner for RP |
| 224 | Threads of RP |
| 225 | Threads of Liner |
| 226 | Filler material (of internal low-density region of RP) |
| 228 | Threaded surface of RP (having half-capsule geometry) |
| 300A | Projectile cartridge |
| 300B | Cartridge longitudinal length |
| 301 | Projectile cartridge longitudinal axis |
| 302A | First cylindrical shell |
| 302B | First shell proximal end |
| 302C | First shell distal end |
| 302D | First shell wall |
| 302E | First shell wall thickness |
| 302F | First shell inner diameter |

TABLE 1-continued

Element Identification Numbers

| Item Number | Item Description |
|---|---|
| 302G | First shell lumen |
| 303 | Wadding |
| 305 | Crimp |
| 310 | Cartridge outer layer |
| 312 | Primer |
| 313 | Primer seat and cartridge base |
| 314 | Magnet |
| 320A | Propellant region |
| 320B | Propellant region diameter |
| 322 | Propellant (or, propellant layer or propellant mixture; optionally including additive) |
| 324 | Propellant sub-region (e.g., 324(I) is $1^{st}$ propellant sub-region, etc.) |
| 326 | Separator (multiple separators identified using Roman numerals, e.g., "326(I)") |
| 328 | Tamp |
| 330 | Rupture disk |
| 3700 | Plug (formed from barrier) |
| 3710 | Plug rotation point |
| 3900 | Plug downward trajectory |

STATEMENTS REGARDING INCORPORATION BY REFERENCE AND VARIATIONS

All references throughout this application, for example patent documents including issued or granted patents or equivalents; patent application publications; and non-patent literature documents or other source material are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention. The specific embodiments provided herein are examples of useful embodiments of the present invention and it will be apparent to one skilled in the art that the present invention may be carried out using a large number of variations of the devices, device components, methods and steps set forth in the present description. As will be obvious to one of skill in the art, methods and devices useful for the present embodiments can include a large number of optional device components, compositions, materials, combinations and processing elements and steps.

Every device, system, combination of components or method described or exemplified herein can be used to practice the invention, unless otherwise stated.

When a group of substituents is disclosed herein, it is understood that all individual members of that group and all subgroups, including any device components, combinations, materials and/or compositions of the group members, are disclosed separately. When a Markush group or other grouping is used herein, all individual members of the group and all combinations and subcombinations possible of the group are intended to be individually included in the disclosure.

Whenever a range is given in the specification, for example, a number range, a flow-rate range, a size range, a pressure range, a velocity range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements and/or limitation or limitations, which are not specifically disclosed herein.

One of ordinary skill in the art will appreciate that compositions, materials, components, methods and/or processing steps other than those specifically exemplified can be employed in the practice of the invention without resort to undue experimentation. All art-known functional equivalents, of any such compositions, materials, components, methods and/or processing steps are intended to be included in this invention. The terms and expressions which have been employed are used as terms of description and not of limitation, and there is no intention in the use of such terms and expressions of excluding any equivalents of the features shown and described or portions thereof, but it is recognized that various modifications are within the scope of the invention claimed. Thus, it should be understood that although the present invention has been specifically disclosed by exemplary embodiments and optional features, modification and variation of the concepts herein disclosed may be resorted to by those skilled in the art, and that such modifications and variations are considered to be within the scope of this invention as defined by the appended claims.

It must be noted that as used herein and in the appended claims, the singular forms "a", "an", and "the" include plural reference unless the context clearly dictates otherwise. Thus, for example, reference to "a layer" includes a plurality of layers and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described.

I claim:

1. A method for disrupting an explosive device using a propellant driven disrupter (PDD), the method comprising the steps of:

loading a projectile cartridge comprising a rounded projectile (RP) into a disrupter barrel of the PDD;

aiming the PDD at a target portion of the explosive device;

propelling the RP out of the barrel and toward the target portion of the explosive device;

wherein the RP travels along a linear trajectory defined by a barrel longitudinal axis extending between a barrel muzzle end and the target portion;

impacting the RP with a barrier portion of the explosive device, the barrier portion being between the barrel muzzle end and the target portion along said linear trajectory;

wherein the step of impacting comprises forming a composite projectile via a solid state weld between the barrier portion of the explosive target to a RP distal end, to control generation of spalls and fragments into the explosive device; and traversing the RP or the composite projectile a penetration distance through the explosive device;

wherein the RP or composite projectile traverses the penetration distance substantially along said linear trajectory, such that the RP follows said linear trajectory during the steps of propelling, impacting, and traversing; and disrupting the explosive device without detonating an explosive of the explosive device.

2. A projectile cartridge for use in a propellant driven disrupter (PDD) for disrupting an explosive device, the projectile cartridge comprising:

a first cylindrical shell having a first shell proximal end and a first shell distal end, the first shell proximal end configured to face a barrel breech end of a barrel of the PDD, and the first shell distal end configured to face a barrel muzzle end of the PDD;

wherein the first cylindrical shell is at least partially formed of a metallic material;

a rounded projectile (RP) having:

a RP proximal end facing toward the disrupter barrel breech end when loaded in the barrel;

a RP distal end opposed to the proximal end and facing toward the disrupter barrel muzzle end when loaded in the barrel; and a RP maximal outer diameter being between 90% and 100% of an inner diameter of the disrupter barrel;

wherein the RP is characterized by a tensile strength selected from the range of 160 KSI to 390 KSI and/or a Rockwell hardness selected from the range of C40 to C70; and wherein the RP is positioned at least partially within the first cylindrical shell at the first shell distal end;

a wadding or liner in physical contact with and covering the RP proximal end, wherein the wadding covers at least 50% of a surface area of the RP; and a propellant region comprising a propellant; wherein the propellant region is inside the first cylindrical shell.

3. The projectile cartridge of claim 2 comprising the wadding, wherein the wadding covers the proximal end of the RP, and the wadding physically separates the first cylindrical shell and the RP and the wadding is not in physical contact with the RP distal end.

4. The projectile cartridge of claim 2, wherein the RP is at least partially positioned within a forcing cone lumen and/or within a bore lumen of the PDD barrel when the cartridge is loaded in the PDD barrel.

5. The projectile cartridge of claim 2, wherein the first cylindrical shell is at least partially formed of a steel alloy.

6. The projectile cartridge of claim 2, wherein the cartridge propellant region comprises a plurality of types of propellant grains arranged as a mixture and/or as a plurality of layers; wherein the cartridge propellant region comprises more of a first type of propellant grains toward the cartridge proximal end and more of a second type of propellant grains toward the cartridge distal end; and wherein the first type of propellant grains are characterized by a higher characteristic burn rate than the second type of propellant grains.

7. The projectile cartridge of claim 2, wherein the propellant region comprises a plurality of propellant sub-regions, each propellant sub-region comprising a different propellant or propellant mixture than each other propellant sub-region.

8. The projectile cartridge of claim 2, wherein a propellant sub-region closer to the cartridge proximal end comprises a propellant having a higher characteristic burn rate than that of a different propellant-region closer to the cartridge distal end.

9. The projectile cartridge of claim 2, wherein the first cylindrical shell further comprises a tamp at the cartridge distal end positioned between the propellant region and the wadding or liner;

wherein the tamp comprises silicone, sand, clay, hollow ceramic microspheres, a high energy efficient transfer fluid (HEET), and/or a high density closed cell foam.

10. The projectile cartridge of claim 9, wherein the first cylindrical shell comprises a blank cartridge.

11. The projectile cartridge of claim 2, wherein the first cylindrical shell distal end comprises a crimp configured to trap the RP within the first cylindrical shell.

12. The projectile cartridge of claim 2, wherein the RP has a spherical geometry or a half-capsule geometry.

13. The projectile cartridge of claim 2, wherein the RP has a spherical geometry and the PDD barrel's bore is not rifled.

14. The projectile cartridge of claim 2, wherein the RP has a half-capsule geometry and PDD barrel's bore is rifled, further comprising the liner in physical contact with and covering the RP proximal end.

15. The projectile cartridge of claim 2, wherein the RP has a half-capsule geometry; and wherein the RP comprises an internal low-density region; wherein the internal low-density region is an empty cavity or a cavity filled with a filler material, the filler material having a lower density than that of the rest of the RP.

16. The projectile cartridge of claim 2 comprising the liner, wherein the RP has a half-capsule geometry; and wherein the liner is formed of a heat and friction resistant plastic, polycarbonate, aluminum, copper, and/or brass.

17. The projectile cartridge of claim 2, wherein 20% to 100% of the RP is seated within the first cylindrical shell.

18. The projectile cartridge of a claim 2, wherein the RP has a maximal outer diameter that is between 96% and 99.9% of an internal diameter of the PDD barrel's bore.

19. The projectile cartridge of claim 2, wherein the RP is characterized by:

a tensile strength selected from the range of 160 KSI to 390 KSI and a Rockwell hardness selected from the range of C40 to C70;

a durameter selected from the range of 70 to 90; or a density selected from the range of 4.5 to 16 $g/cm_3$.

20. The projectile cartridge of claim 2, wherein the RP has an outer rough surface characterized by a surface roughness characterized by each of a spacing between surface texture peaks and a height between surface texture and surface texture valleys selected from the range of 0.0001" to 0.01".

21. The projectile cartridge of claim 2, wherein the RP is a composite comprising a core material and an outer layer that surrounds the core material selected to: avoid target barrier secondary fragments or spall; minimize interaction between shell elements and target, and have a decreased risk of unwanted shock initiation of a target explosive.

* * * * *